US010878989B2

(12) United States Patent
Mayumi et al.

(10) Patent No.: US 10,878,989 B2
(45) Date of Patent: Dec. 29, 2020

(54) INDUCTANCE ADJUSTING DEVICE

(71) Applicants: NIPPON STEEL & SUMITOMO METAL CORPORATION, Tokyo (JP); EGUCHI HIGH FREQUENCY CO., LTD., Tokyo (JP)

(72) Inventors: Yasuhiro Mayumi, Tokyo (JP); Kazuya Tsurusaki, Tokyo (JP); Yohei Eguchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 280 days.

(21) Appl. No.: 16/096,591

(22) PCT Filed: Jul. 4, 2017

(86) PCT No.: PCT/JP2017/024537
§ 371 (c)(1),
(2) Date: Oct. 25, 2018

(87) PCT Pub. No.: WO2018/012354
PCT Pub. Date: Jan. 18, 2018

(65) Prior Publication Data

US 2019/0139691 A1 May 9, 2019

(30) Foreign Application Priority Data

Jul. 13, 2016 (JP) ..... 2016-138655

(51) Int. Cl.
*H01F 27/28* (2006.01)
*H01F 21/04* (2006.01)
*H01F 27/24* (2006.01)

(52) U.S. Cl.
CPC ..... *H01F 27/28* (2013.01); *H01F 21/04* (2013.01); *H01F 27/24* (2013.01)

(58) Field of Classification Search
CPC ..... H01F 27/28; H01F 21/04; H01F 27/24; H01F 29/12; H05B 6/36
See application file for complete search history.

(56) References Cited

U.S. PATENT DOCUMENTS 6,559,560 B1 5/2003 Jin et al.
9,019,065 B2 * 4/2015 Gianesello ..... H01F 17/0006 336/226
9,697,938 B2 * 7/2017 Yan ..... H01F 41/041
(Continued)

FOREIGN PATENT DOCUMENTS

JP 03-008034 Y 7/1928
JP 58-147107 A 9/1983
(Continued)

OTHER PUBLICATIONS

International Search Report for PCT/JP2017/024537 dated Sep. 19, 2017.

(Continued)

*Primary Examiner* — Tuyen T Nguyen
(74) *Attorney, Agent, or Firm* — Birch, Stewart, Kolasch & Birch, LLP

(57) ABSTRACT

Coil surfaces of a first coil (1) and a second coil (3) are parallel in a state of having an interval therebetween. When the first coil (1) rotates, a combined inductance by the first coil (1) and the second coil (3) changes.

13 Claims, 30 Drawing Sheets

(56) References Cited

U.S. PATENT DOCUMENTS

| | | | | |
|---|---|---|---|---|
| 10,186,371 | B2 * | 1/2019 | Olyunin | H01F 38/14 |
| 2002/0023718 | A1 | 2/2002 | Choi et al. | |
| 2002/0057164 | A1 | 5/2002 | Jin et al. | |
| 2005/0195063 | A1 | 9/2005 | Mattsson | |
| 2008/0211614 | A1 | 9/2008 | Mecke et al. | |
| 2017/0103850 | A1 | 4/2017 | Furiya et al. | |

FOREIGN PATENT DOCUMENTS

| | | | |
|---|---|---|---|
| JP | 4-302409 | A | 10/1992 |
| JP | 7-320942 | A | 12/1995 |
| JP | 2002-176035 | A | 6/2002 |
| JP | 2004-30965 | A | 1/2004 |
| JP | 2007-288741 | A | 11/2007 |
| JP | 2014-212198 | A | 11/2014 |
| JP | 2016-9790 | A | 1/2016 |
| KR | 10-2000-0068364 | A | 11/2000 |

OTHER PUBLICATIONS

Written Opinion of the International Searching Authority for PCT/JP2017/024537 (PCT/ISA/237) dated Sep. 19, 2017.

English translation of International Preliminary Report on Patentability and Written Opinion dated Jan. 24, 2019, in PCT/JP2017/024537 (Forms PCT/IB/338, PCT/IB/373, and PCT/ISA/237).

Extended European Search Report dated Feb. 26, 2020 of the corresponding European application No. 17827483.3.

Indian Office Action dated Feb. 25, 2020, for corresponding Indian Application No. 201817039229.

Korean Office Action for Korean Application No. 10-2018-7031198, dated Jul. 22, 2019, with English translation.

* cited by examiner

INDUCTANCE ADJUSTING DEVICE

TECHNICAL FIELD

The present invention relates to an inductance adjusting device, and is suitable when used for adjusting an inductance of an electric circuit, in particular.

BACKGROUND ART

The needs for reducing the emission of greenhouse effect gas such as carbon dioxide have been high up to now in order to prevent global warming. For example, in the field of steel, operating an induction heating device intended for performing hardening at high frequencies with high efficiency has been achieved. Further, the introduction of induction heating devices as an alternative technique to a gas heating furnace whose heating efficiency is poor has been increasing recently. Further, in the field of automobiles, the development of a technique to feed power to an electric vehicle in a non-contact manner has been in progress.

These techniques are a technique in which a capacitor (electrostatic capacitance C) and a load coil (inductance L) are connected in series or parallel to a high frequency generating device to generate voltage resonance or current resonance. In these techniques, it is possible to heat an object to be heated in a non-contact manner by magnetic fluxes generated when a resonant current flows through the load coil. Further, in these techniques, it is possible to feed power in a non-contact manner by utilizing an electromagnetic induction phenomenon based on the magnetic fluxes generated when the resonant current flows through the load coil. Incidentally, the resonant current indicates a current whose frequency is a resonance frequency.

In the case of utilizing a resonance phenomenon as above, the capacitor (electrostatic capacitance C) and a heating coil (the inductance L) are determined, and thereby the frequency (resonance frequency) in the high frequency generating device is determined unambiguously. Therefore, when the actual frequency deviates from a target frequency at start-up of the device, it is necessary to adjust a reactance. As a means for it, a means that adjusts the electrostatic capacitance C of a circuit has been employed up to now in order to obtain the target frequency.

Concretely, a method has been considered in which a previously-prepared capacitor for fine adjustment is connected to or disconnected from the circuit including the capacitor and the load coil, to thereby adjust the electrostatic capacitance C of the circuit. However, this method requires installation of the capacitor for fine adjustment additionally. Therefore, the device becomes expensive. Further, in the case of switching the frequency during operation, it is necessary to cut the power supply once, automatically switch a power feeding terminal of the capacitor for fine adjustment remotely, turn on the power again, and continue the operation. In this case, a terminal switch that enables remote manipulation is required. Therefore, the device becomes expensive. Further, it is not technically easy to continuously vary the electrostatic capacitance C of the circuit under the large current.

Therefore, adjustment of the inductance L of the circuit is considered. As a technique of adjusting the inductance L of the circuit, there are techniques described in Patent Literatures 1 to 3 below.

In Patent Literature 1, there has been disclosed a method of adjusting the inductance L by moving a magnetic core in a solenoid coil as a technique relating to induction heating.

In the technique described in Patent Literature 1 concretely, the inductance L is adjusted by moving the magnetic core having high relative permeability in the solenoid coil, to thereby change an occupancy ratio of the magnetic core in the solenoid coil.

In Patent Literature 2, there has been disclosed a method of adjusting the inductance L by extending and contracting a solenoid coil without using a magnetic core as a technique relating to non-contact power feeding.

In Patent Literature 3, there has been disclosed a method of adjusting the inductance L by changing relative positions between two coils as a technique relating to a high-frequency electronic circuit to be used on a substrate. Concretely, in the technique described in Patent Literature 3, two coils having the same shape are used. The gap between the two coils is changed, or the two coils are rotated about ends of the coils made as a shaft or opened/closed, and thereby a rotation angle or opening/closing angle of the two coils is changed.

CITATION LIST

Patent Literature

Patent Literature 1: Japanese Laid-open Patent Publication No. 2004-30965

Patent Literature 2: Japanese Laid-open Patent Publication No. 2016-9790

Patent Literature 3: Japanese Laid-open Patent Publication No. 58-147107

SUMMARY OF INVENTION

Technical Problem

However, in the technique described in Patent Literature 1, the magnetic core is inserted in the solenoid coil. Therefore, when a larger current is applied to the solenoid coil, magnetic fluxes generated from the solenoid coil concentrate on the magnetic core. Thus, in the technique described in Patent Literature 1, the loss of the magnetic core (core loss or hysteresis loss) increases. Further, in the technique described in Patent Literature 1, by the magnetic fluxes concentrating on ends of the magnetic core, the solenoid coil is inductively heated. Accordingly, in the technique described in Patent Literature 1, it is not easy to improve the heating efficiency.

Further, in the technique described in Patent Literature 2, the inductance L is adjusted by extending and contracting the solenoid coil. Therefore, it is necessary to increase the amount of extension and contraction of the solenoid coil according to a variable magnification of the inductance L. Thus, in the technique described in Patent Literature 2, the entire device increases. Further, in the technique described in Patent Literature 2, a support structure that supports deformation of the coil becomes complicated. Incidentally, the variable magnification of the inductance L is a value obtained by dividing the maximum value of the inductance L by the minimum value of the inductance L.

Further, since the technique described in Patent Literature 3 is the technique relating to the high-frequency electronic circuit to be used on a substrate, it is not easy to apply a large current to the high-frequency electronic circuit. Further, even if a state where a large current is allowed to be applied to the high-frequency electronic circuit is made, in the technique described in Patent Literature 3, the ends of the coils serve as a shaft, and the rotation angle or opening/ closing angle is changed. When a large current of several hundred to several thousand amperes is applied like the case of performing the induction heating, excessive repulsive force and attractive force occur between the two coils. In the technique described in Patent Literature 3, due to the structure in which the ends of the coils serve as a shaft, the previously-described repulsive force and attractive force occur, resulting in that it is not easy to accurately adjust the inductance L. Furthermore, in the technique described in Patent Literature 3, there is a possibility that the inductance adjusting device is broken because the previously-described repulsive force and attractive force occur. Thus, in the technique described in Patent Literature 3, it is necessary to employ a special structure in order to apply a large current. Further, in the technique described in Patent Literature 3, the change in the inductance L is proportional to the gap or a logarithm of the angle. Therefore, in the technique described in Patent Literature 3, the relationship between the gap or rotation angle of the two coils and the inductance L largely deviates from the linear relationship. Therefore, in the technique described in Patent Literature 3, it is not easy to control the frequency with high accuracy.

The present invention has been made in consideration of the above-described problems, and an object thereof is to enable an inductance of an electric circuit to be adjusted accurately with a simple and compact structure.

Solution to Problem

The inductance adjusting device of the present invention is an inductance adjusting device that adjusts an inductance of an electric circuit, the inductance adjusting device including: a first coil having a first circumferential portion, a second circumferential portion, and a first connecting portion; and a second coil having a third circumferential portion, a fourth circumferential portion, and a second connecting portion, in which the first circumferential portion, the second circumferential portion, the third circumferential portion, and the fourth circumferential portion each are a portion circling so as to surround an inner region thereof, the first connecting portion is a portion that connects one end of the first circumferential portion and one end of the second circumferential portion mutually, the second connecting portion is a portion that connects one end of the third circumferential portion and one end of the fourth circumferential portion mutually, the first coil and the second coil are connected in series or parallel, the first circumferential portion and the second circumferential portion exist on the same plane, the third circumferential portion and the fourth circumferential portion exist on the same plane, a set of the first circumferential portion and the second circumferential portion and a set of the third circumferential portion and the fourth circumferential portion are arranged in a parallel state with an interval provided therebetween, at least one of the first coil and the second coil rotates about a shatt of the first coil and the second coil as a rotation shaft, the shaft is a shaft passing through a middle position between the center of the first circumferential portion and the center of the second circumferential portion and a middle position between the center of the third circumferential portion and the center of the fourth circumferential portion, the first circumferential portion and the second circumferential portion are arranged so as to maintain a state where at least one of the first coil and the second coil is displaced by 180° in terms of angle in a rotation direction, and the third circumferential portion and the fourth circumferential portion are arranged so as to maintain a state where at least one of the first coil and the second coil is displaced by 180° in terms of angle in the rotation direction.

DESCRIPTION OF EMBODIMENTS

Hereinafter, there will be explained embodiments of the present invention with reference to the drawings.

First Embodiment

First, a first embodiment will be explained.

<Structure of an Inductance Adjusting Device>

Figure 1A:
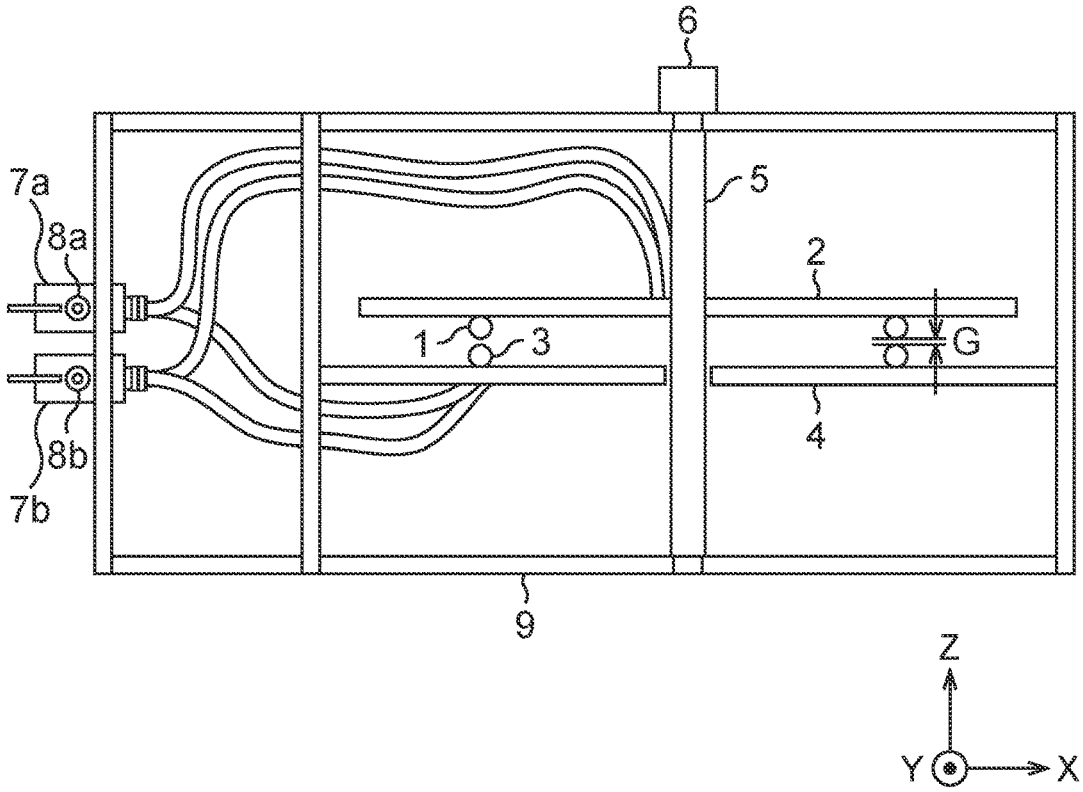
FIG. 1A is a view illustrating a first example of a structure of an inductance adjusting device.
Figure 1B:
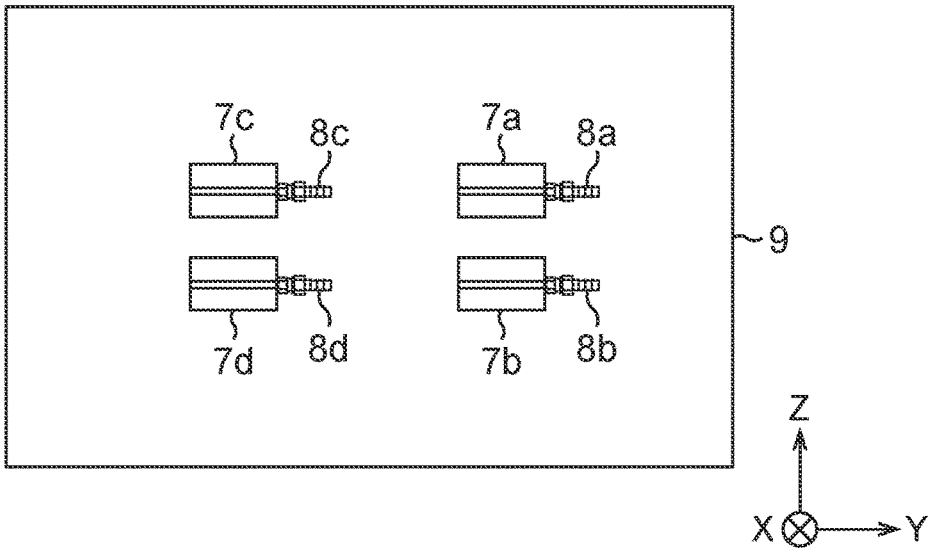
FIG. 1B is a view illustrating one example of an appearance of a surface where power feeding terminals of the inductance adjusting device in FIG. 1A are arranged.

FIG. 1A and FIG. 1B are views each illustrating one example of a structure of an inductance adjusting device in this embodiment. Incidentally, X, Y, and Z coordinates illustrated in each drawing indicate the relationship of directions in each drawing. The mark of ● added inside ○ indicates the direction from the far side of the sheet toward the near side. The mark of X added inside ○ indicates the direction from the near side of the sheet toward the far side.

FIG. 1A is a view illustrating one example of the structure of the inductance adjusting device in this embodiment. FIG. 1B is a view illustrating one example of an appearance of a surface where power feeding terminals 7*a* to 7*d* of the inductance adjusting device in FIG. 1A are arranged.

The inductance adjusting device includes: a first coil 1, a first supporting member 2, a second coil 3, a second supporting member 4, a center shaft 5, a drive unit 6, the power feeding terminals 7*a* to 7*d*, water feeding terminals 8*a* to 8*d*, and a casing 9. In FIG. 1A, the inside of the casing 9 is illustrated fluoroscopically. Incidentally, the inductance adjusting device in this embodiment does not include a core for adjusting an inductance.

Figure 2A:
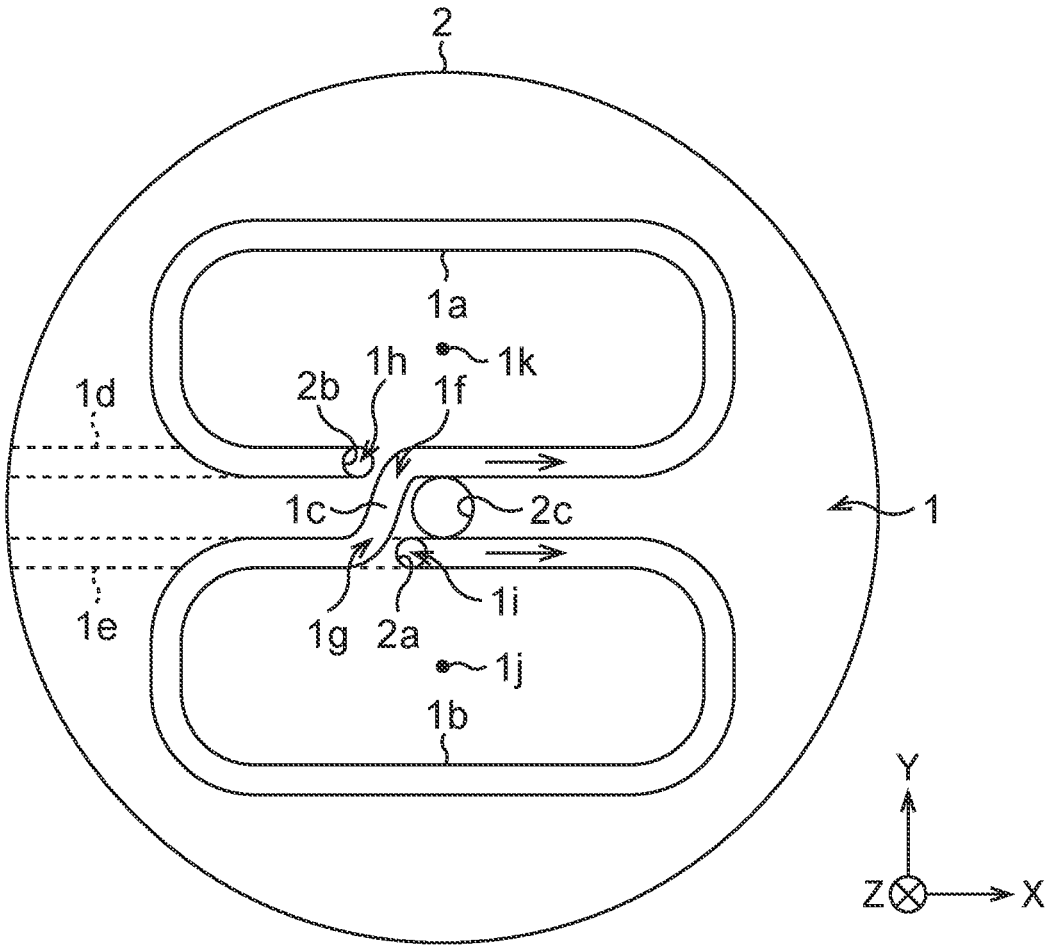
FIG. 2A is a view illustrating a first example of a first coil and a first supporting member.
Figure 2B:
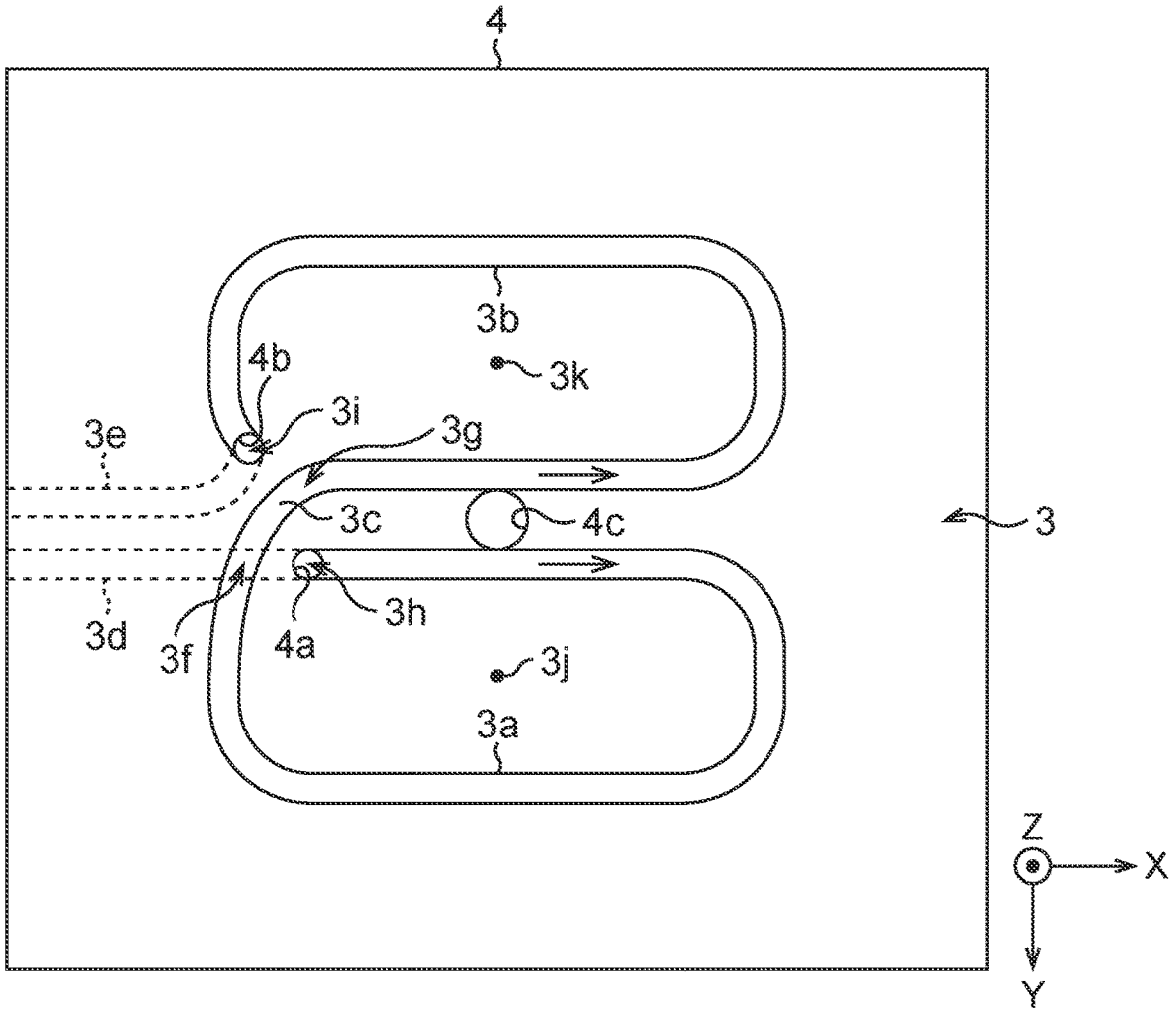
FIG. 2B is a view illustrating a first example of a second coil and a second supporting member.
Figure 3A:
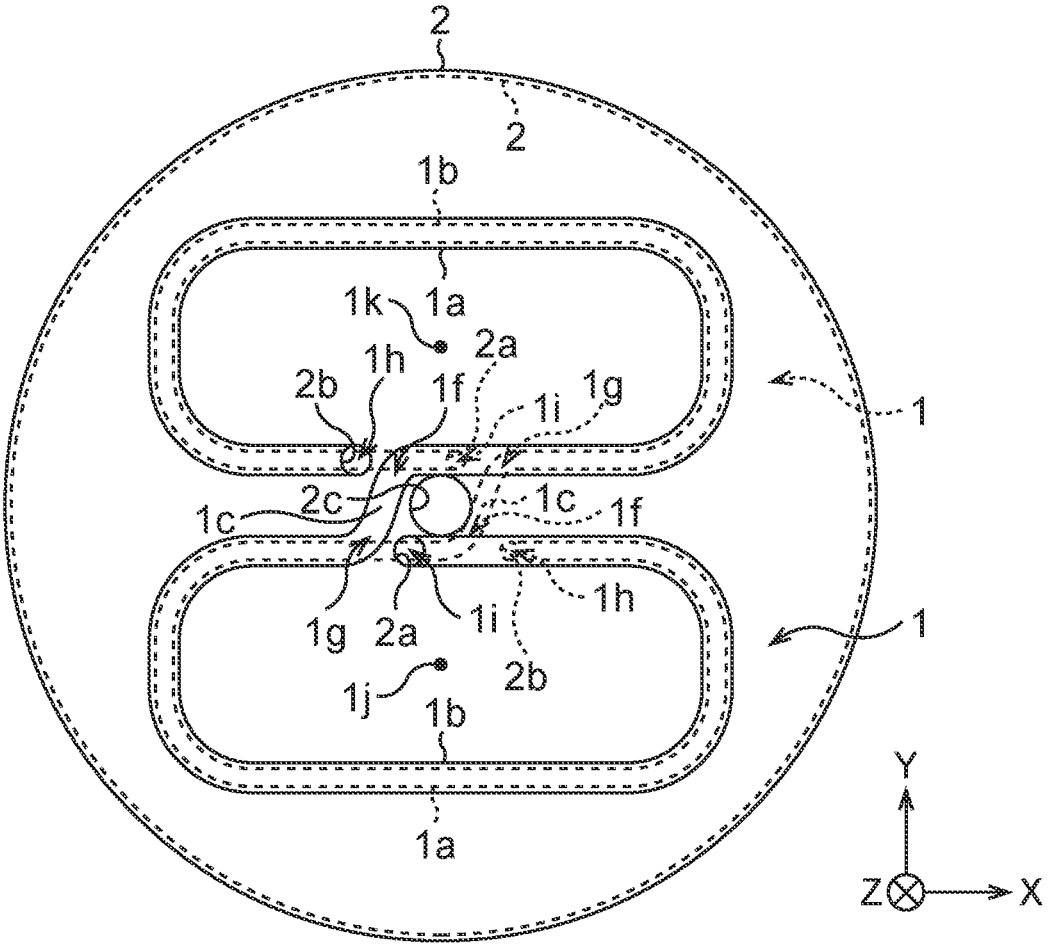
FIG. 3A is a view illustrating the first coil in a certain state and the first coil in a state of being rotated by 180° about a center shaft as a rotation shaft from the certain state in an overlapping manner.
Figure 3B:
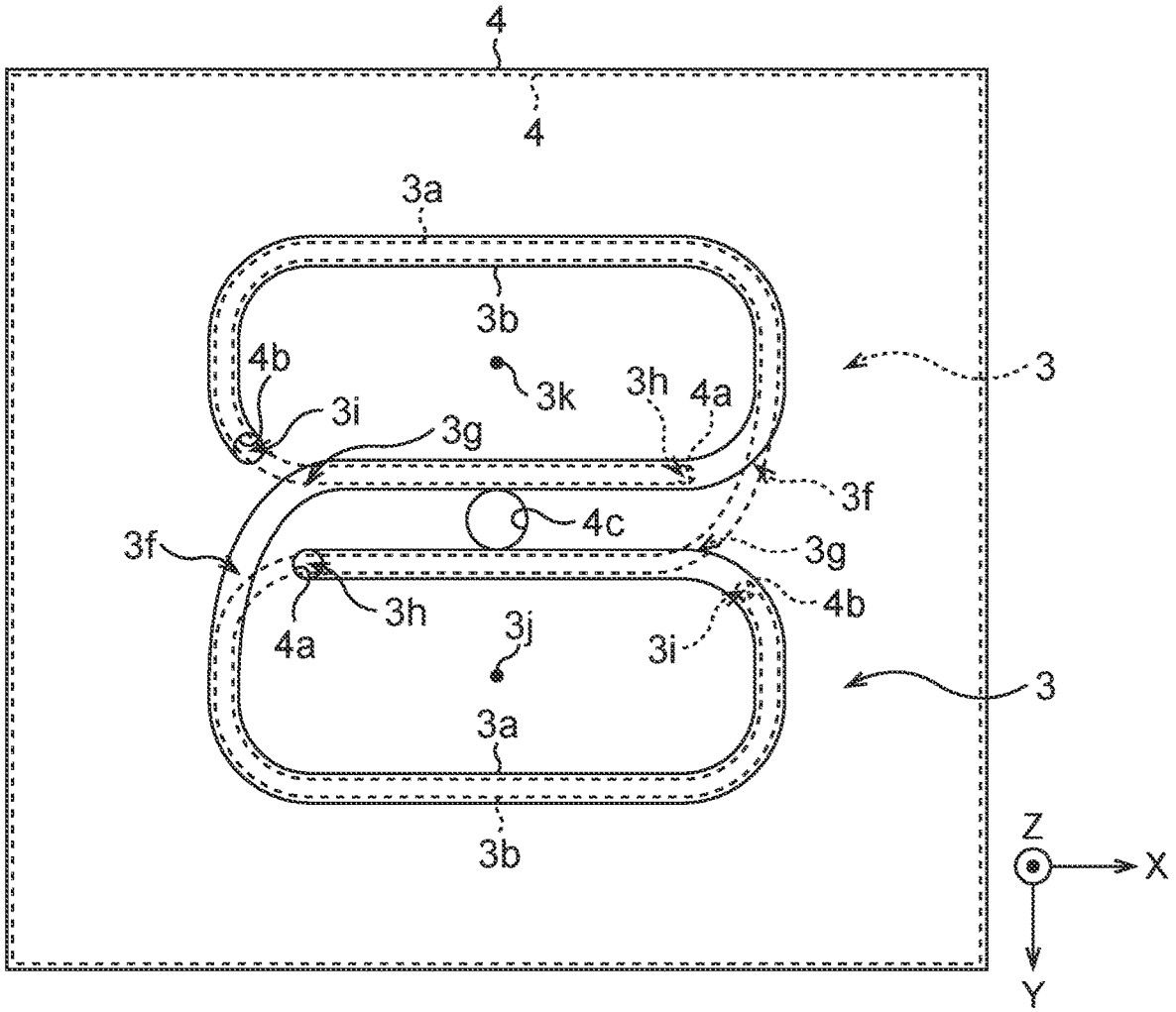
FIG. 3B is a view illustrating the second coil in a certain state and the second coil in a state of being rotated by 180° about the center shaft as a rotation shaft from the certain state in an overlapping manner.

FIG. 2A is a view illustrating one example of the first coil 1 and the first supporting member 2. FIG. 2B is a view illustrating one example of the second coil 3 and the second supporting member 4. FIG. 3A is a view illustrating the first coil 1 in a certain state and the first coil 1 in a state of being rotated by 180° about the center shaft 5 as a rotation shaft from the certain state in an overlapping manner. In FIG. 3A, for convenience of illustration, one of these two first coils 1 is illustrated by a solid line, and the other of them is illustrated by a dotted line. FIG. 3B is a view illustrating the second coil 3 in a certain state and the second coil 3 in a state of being rotated by 180° about the center shaft 5 as a rotation shaft from the certain state in an overlapping manner. In FIG. 3B as well, similarly to FIG. 3A, for convenience of illustration, one of these two second coils 3 is illustrated by a solid line, and the other of them is illustrated by a dotted line. Incidentally, the second coil 3 does not rotate as will be described later, but in FIG. 3B, the second coil 3 is assumed to rotate.

FIG. 2A and FIG. 3A each are a view where a surface of the first supporting member 2 facing the second supporting member 4 is seen along the Z axis in FIG. 1A. FIG. 2B and FIG. 3B each are a view where a surface of the second supporting member 4 facing the first supporting member 2 is seen along the Z axis in FIG. 1A. Incidentally, in FIG. 2A and FIG. 2B, the arrow lines illustrated in the first coil 1 and the second coil 3 are directions of alternating currents at the same time. The directions of the alternating currents flowing through the first coil 1 and the second coil 3 will be described later with reference to FIG. 4.

First, the first coil 1 and the first supporting member 2 will be explained.

The first supporting member 2 is a member for supporting the first coil 1. The first coil 1 is attached to the first supporting member 2 to be fixed on the first supporting member 2. As illustrated in FIG. 2A, in the first supporting member 2, holes 2*a*, 2*b* intended for attaching the first coil 1 are formed.

As illustrated in FIG. 2A, the planar shape of the first supporting member 2 is circular. The first supporting member 2 is formed of an insulating and non-magnetic material that has strength capable of supporting the first coil 1 so as to prevent the position of the first coil 1 in the Z-axis direction from changing. The first supporting member 2 is formed by using a thermosetting resin, for example.

As illustrated in FIG. 2A, in the center of the first supporting member 2, a hole 2*c* intended for attaching the first supporting member 2 to the center shaft 5 is formed. The center shaft 5 is passed through the hole 2*c*, and thereby the first supporting member 2 is attached (fixed) to the center shaft 5 so as to be coaxial with the center shaft 5, and rotates with rotation of the center shaft 5. The first coil 1 is supported by the first supporting member 2. That is, the first coil 1 is fixed on the first supporting member 2. Therefore, the first coil 1 rotates with rotation of the first supporting member 2. As above, the first coil 1 is arranged so as to make a rotation axis thereof coaxial with the center shaft 5.

In FIG. 2A, the first coil 1 has a first circumferential portion 1*a*, a second circumferential portion 1*b*, a first connecting portion 1*c*, a first lead-out portion 1*d*, and a second lead-out portion 1*e*. The first circumferential portion 1*a*, the second circumferential portion 1*b*, the first connecting portion 1*c*, the first lead-out portion 1*d*, and the second lead-out portion 1*e* are integrated.

In this embodiment, the number of turns of the first coil 1 is one [turn]. Further, in this embodiment, the case where the figure of 8 in Arabic numerals is formed by the first circumferential portion 1*a*, the second circumferential portion 1*b*, and the first connecting portion 1*c* will be explained as an example. Incidentally, in FIG. 3A, for convenience of illustration, illustrations of the first lead-out portion 1*d* and the second lead-out portion 1*e* are omitted. Further, in FIG. 3A, the reference numeral is added to each of the first coils 1 illustrated in an overlapping manner.

The first circumferential portion 1*a* is a portion circling so as to surround an inner region thereof. The second circumferential portion 1*b* is also a portion circling so as to surround an inner region thereof. The first circumferential portion 1*a* and the second circumferential portion 1*b* are arranged on the same horizontal plane (X-Y plane).

The first connecting portion 1*c* is a portion that connects a first end if of the first circumferential portion 1*a* and a first end 1*g* of the second circumferential portion 1*b* mutually, and is a non-circumferential portion.

The first lead-out portion 1*d* is connected to a second end 1*h* of the first circumferential portion 1*a*. The second end 1*h* of the first circumferential portion 1*a* is positioned at the hole 2*b*. The second lead-out portion 1*e* is connected to a second end 1*i* of the second circumferential portion 1*b*. The second end 1*i* of the second circumferential portion 1*b* is positioned at the hole 2*a*.

The first lead-out portion 1*d* and the second lead-out portion 1*e* each become a lead-out wire for connecting the first coil 1 to an external part. In FIG. 2A, the first lead-out portion 1*d* and the second lead-out portion 1*e* are each illustrated by a dotted line, to thereby indicate that the first lead-out portion 1*d* and the second lead-out portion 1*e* exist on a surface opposite to the surface of the first supporting member 2 illustrated in FIG. 2A.

In FIG. 3A, the first coil 1 is brought into a state illustrated by a dotted line from a state illustrated by a solid line when being rotated about the center shaft 5 as a rotation shaft by 180°.

The center shaft 5 is arranged in the hole 2*c*. Thus, the center shaft 5 is arranged at a position including the middle position between the center 1*k* of the first circumferential portion 1*a* and the center 1*j* of the second circumferential portion 1*b*. The first circumferential portion 1*a* and the second circumferential portion 1*b* are positioned on the sides opposite to each other across the hole 2*c* (center shaft 5). That is, the first circumferential portion 1*a* and the second circumferential portion 1*b* are arranged so as to maintain a state where the first coil 1 is displaced by 180° in terms of angle in its rotation direction. This angle is an angle formed by a virtual straight line mutually connecting the center of the hole 2*c* (shaft core of the center shaft 5) and the center 1*k* of the first circumferential portion 1*a* by the most direct way and a virtual straight line mutually connecting the center of the hole 2*c* (shaft core of the center shaft 5) and the center 1*j* of the second circumferential portion 1*b* by the most direct way. Incidentally, in FIG. 3A, the center 1*k* of the first circumferential portion 1*a* and the center 1*j* of the second circumferential portion 1*b* are points illustrated virtually, and are not existent points.

The first circumferential portion 1*a*, the second circumferential portion 1*b*, a third circumferential portion 3*a*, and a fourth circumferential portion 3*b* are most preferred to be the same completely in shape and size. However, as illustrated in FIG. 2A and FIG. 2B, it is sometimes impossible to make the first circumferential portion 1*a*, the second circumferential portion 1*b*, the third circumferential portion 3*a*, and the fourth circumferential portion 3*b* the same completely in shape and size.

Unless the state of magnetic fluxes penetrating the inside of each of the first circumferential portion 1*a*, the second circumferential portion 1*b*, the third circumferential portion 3*a*, and the fourth circumferential portion 3*b* greatly differs from that in the case where the first circumferential portion 1*a*, the second circumferential portion 1*b*, the third circumferential portion 3*a*, and the fourth circumferential portion 3*b* are the same completely in shape and size when the alternating current is applied to the first coil 1 and the second coil 3, the first circumferential portion 1*a*, the second circumferential portion 1*b*, the third circumferential portion 3*a*, and the fourth circumferential portion 3*b* do not need to be the same completely in shape and size.

The present inventors changed, of various inductance adjusting devices including inductance adjusting devices in first to fifth embodiments, the sizes of the first coil and the second coil, the gap (interval in the Z-axis direction) between the first coil and the second coil, the shapes of the first coil and the second coil, and so on, to then measure variable magnifications β, However, the first circumferential portion, the second circumferential portion, the third circumferential portion, and the fourth circumferential portion were set the same completely in shape and size. As a result, the variable magnification β ranged from about 2.3 to 5.6 magnifications. A coupling coefficient k corresponding to this range ranges from about 0.4 to 0.7. Incidentally, the coupling coefficient k is expressed by (2) Equation to be described later. Thus, as a value of a standard coupling coefficient ks between the first coil and the second coil, an average value in this range (=0.55 (=(0.4 0.7) 2)) is employed. This standard coupling coefficient ks becomes a representative value of the coupling coefficient in the case where the first circumferential portion, the second circumferential portion, the third circumferential portion, and the fourth circumferential portion are the same completely in shape and size.

Here, a minimum value β min of the variable magnification β of a combined inductance GL when seen from an alternating-current power supply circuit is assumed to be 2.0. The variable magnification β of the combined inductance GL when seen from the alternating-current power supply circuit is expressed by (4) Equation to be described later. When the minimum value β min of the variable magnification β (=2.0) is substituted in (4) Equation, a minimum value kmin of the coupling coefficient between the first coil and the second coil becomes about 0.33. When the minimum value kmin of the coupling coefficient (=0.33) is divided by the standard coupling coefficient ks (=0.55), 0.6 (=0.33/0.55) is found. That is, 0.33 is required as the minimum value kmin of the coupling coefficient in order to secure the minimum value β min of the variable magnification β (=2.0). In order to achieve 0.33 as the minimum value kmin of the coupling coefficient, the shapes and the sizes of the first circumferential portion, the second circumferential portion, the third circumferential portion, and the fourth circumferential portion only need to be the same in a portion of 60% of the total length of these. Further, the minimum value β min of the variable magnification β is preferred to be 2.5 and more preferred to be 3.0 practically. In order to correspond to this, from the result of the calculation similar to that described previously, the shapes and the sizes of the first circumferential portion, the second circumferential portion, the third circumferential portion, and the fourth circumferential portion are preferred to be the same in a portion of 78% of the total length of these, and more preferred to be the same in a region of 91% or more.

From the above-described viewpoints, as long as the shapes and the sizes of the first circumferential portion 1*a*, the second circumferential portion 1*b*, the third circumferential portion 3*a*, and the fourth circumferential portion 3*b* are the same in a portion of 60% or more of the total length of these, it is possible to regard the first circumferential portion 1*a*, the second circumferential portion 1*b*, the third circumferential portion 3*a*, and the fourth circumferential portion 3*b* as being the same in shape and size. However, in the above explanation, 60% is preferred to be 78%, and more preferred to be 91% according to the minimum value β min of the variable magnification β.

From the above, regarding the shapes and the sizes of the first circumferential portion 1*a* and the second circumferential portion 1*b*, the following can be said.

When the first coil 1 rotates about the center shaft 5 as a rotation shaft by 180°, a portion having a length of 60% or more of the entire length of the first circumferential portion 1*a* overlaps with a region where the second circumferential portion 1*b* existed before the aforementioned rotation. The entire length of the first circumferential portion 1*a* is a length from the first end if to the second end 1*h* of the first circumferential portion 1*a*.

In FIG. 3A, when it is set that the state illustrated by the solid line is brought into the state illustrated by the dotted line, in FIG. 3A, the portion having a length of 60% or more of the entire length of the first circumferential portion 1*a* illustrated by a dotted line on the lower side overlaps with the second circumferential portion 1*b* illustrated by a solid line on the lower side.

Further, when the first coil 1 rotates about the center shaft 5 as a rotation shaft by 180°, a portion having a length of 60% or more of the entire length of the second circumferential portion 1*b* overlaps with a region where the first circumferential portion 1*a* existed before the aforementioned rotation. The entire length of the second circumferential portion 1*b* is a length from the first end 1*g* to the second end 1*i* of the second circumferential portion 1*b*.

In FIG. 3A, when it is set that the state illustrated by the solid line is brought into the state illustrated by the dotted line, in FIG. 3A, the portion having a length of 60% or more of the entire length of the second circumferential portion 1*b* illustrated by a dotted line on the upper side overlaps with the first circumferential portion 1*e* illustrated by a solid line on the upper side.

Incidentally, as described previously, in the above explanation, 60% is preferred to be 78%, and more preferred to be 91% according to the minimum value β min of the variable magnification β.

Next, the second coil 3 and the second supporting member 4 will be explained.

The second supporting member 4 is a member for supporting the second coil 3. The second coil 3 is attached to the second supporting member 4 to be fixed on the second supporting member 4. As illustrated in FIG. 2B, in the second supporting member 4, holes 4*a*, 4*b* intended for attaching the second coil 3 are formed.

As illustrated in FIG. 2B, the planar shape of the second supporting member 4 is rectangular. The second supporting member 4 is formed of an insulating and non-magnetic material that has strength capable of supporting the second coil 3 so as to prevent the position of the second coil 3 in the Z-axis direction from changing. The second supporting member 4 is formed by using a thermosetting resin, for example.

As illustrated in FIG. 1A, the second supporting member 4 is attached to the casing 9 so as to be coaxial with the center shaft 5 and is fixed to the casing 9. As illustrated in FIG. 2B, in the center of the second supporting member 4, there is formed a hole 4*c* intended for arranging the second supporting member 4 coaxially with the center shaft 5. As illustrated in FIG. 1A, the hole 4*c* is formed so as to have an interval between the second supporting member 4 and the center shaft 5 when the center shaft 5 is passed through the hole 4*c*. In this manner, even when the center shaft 5 rotates, the second supporting member 4 is brought into a state of being fixed to the casing 9 without rotation.

In FIG. 2B, the second coil 3 has the third circumferential portion 3*a*, the fourth circumferential portion 3*b*, a second connecting portion 3*c*, a third lead-out portion 3*d*, and a fourth lead-out portion 3*e*. The third circumferential portion 3*a*, the fourth circumferential portion 3*b*, the second connecting portion 3*c*, the third lead-out portion 3*d*, and the fourth lead-out portion 3*e* are integrated.

In this embodiment, the number of turns of the second coil 3 is one [turn]. Further, in this embodiment, the case where the figure of 8 in Arabic numerals is formed by the third circumferential portion 3*a*, the fourth circumferential portion 3*b*, and the second connecting portion 3*c* will be explained as an example. Incidentally, in FIG. 3B, for convenience of illustration, illustrations of the third lead-out portion 3*d* and the fourth lead-out portion 3*e* are omitted. Further, in FIG. 3B, the reference numeral is added to each of the second coils 3 illustrated in an overlapping manner.

The third circumferential portion 3*a* is a portion circling so as to surround an inner region thereof. The fourth circumferential portion 3*b* is also a portion circling so as to surround an inner region thereof. The third circumferential portion 3*a* and the fourth circumferential portion 3*b* are arranged on the same horizontal plane (X-Y plane).

The second connecting portion 3*c* is a portion that connects a first end 3*f* of the third circumferential portion 3*a* and a first end 3*g* of the fourth circumferential portion 3*b* mutually, and is a non-circumferential portion.

The third lead-out portion 3*d* is connected to a second end 3*h* of the third circumferential portion 3*a*. The second end 3*h* of the third circumferential portion 3*a* is positioned at the hole 4*a*. The fourth lead-out portion 3*e* is connected to a second end 3*i* of the fourth circumferential portion 3*b*. The second end 3*i* of the fourth circumferential portion 3*b* is positioned at the hole 4*b*.

The third lead-out portion 3*d* and the fourth lead-out portion 3*e* each become a lead-out wire for connecting the second coil 3 to an external part. In FIG. 2B, the third lead-out portion 3*d* and the fourth lead-out portion 3*e* are each illustrated by a dotted line, to thereby indicate that the third lead-out portion 3*d* and the fourth lead-out portion 3*e* exist on a surface opposite to the surface of the second supporting member 4 illustrated in FIG. 2B.

As described previously, in this embodiment, the second coil 3 does not rotate. However, in FIG. 3B, it is assumed that the second coil 3 rotates about the center shaft 5 as a rotation shaft. Then, the second coil 3 is brought into a state illustrated by a dotted line from a state illustrated by a solid line by rotating about the center shaft 5 as a rotation shaft by 180°.

The center shaft 5 is arranged in the hole 4*c* Thus, the center shaft 5 is arranged at a position including the middle position between the center 3*j* of the third circumferential portion 3*a* and the center 3*k* of the fourth circumferential portion 3*b*. The third circumferential portion 3*a* and the fourth circumferential portion 3*b* are positioned on the sides opposite to each other across the hole 4*c* (center shaft 5). That is, the third circumferential portion 3*a* and the fourth circumferential portion 3*b* are arranged so as to maintain a state where the first coil 1 is displaced by 180° in terms of angle in its rotation direction. This angle is an angle formed by a virtual straight line mutually connecting the center of the hole 4*c* (shaft core of the center shaft 5) and the center 3*j* of the third circumferential portion 3*a* by the most direct way and a virtual straight line mutually connecting the center of the hole 4*c* (shaft core of the center shaft 5) and the center 3*k* of the fourth circumferential portion 3*b* by the most direct way. Incidentally, in FIG. 3B, the center 3*j* of the third circumferential portion 3*a* and the center 3*k* of the fourth circumferential portion 3*b* are points illustrated virtually, and are not existent points.

As described previously, the center shaft 5 is arranged at the position including the middle position between the center 1*j* of the first circumferential portion 1*a* and the center 1*k* of the second circumferential portion 1*b* and the position including the middle position between the center 3*j* of the third circumferential portion 3*a* and the center 3*k* of the fourth circumferential portion 3*b*. Thus, the center shaft 5 passes through the middle position between the center 1*j* of the first circumferential portion 1*a* and the center 1*k* of the second circumferential portion 1*b* and the middle position between the center 3*j* of the third circumferential portion 3*a* and the center 3*k* of the fourth circumferential portion 3*b*. In the example illustrated in FIG. 1A, the center shaft 5 extends in the Z-axis direction.

Further, regarding the shapes and the sizes of the third circumferential portion 3*a* and the fourth circumferential portion 3*b*, the following can be said.

When it is assumed that the second coil 3 rotates about the center shaft 5 as a rotation shaft by 180°, a portion having a length of 60% or more of the entire length of the third circumferential portion 3*a* overlaps with a region where the fourth circumferential portion 3*b* existed before the aforementioned rotation. The entire length of the third circumferential portion 3*a* is a length from the first end 3*f* to the second end 3*h* of the third circumferential portion 3*a*.

In FIG. 3B, when it is assumed that the state illustrated by the solid line is brought into the state illustrated by the dotted line, in FIG. 3B, the portion having a length of 60% or more of the entire length of the third circumferential portion 3*a* illustrated by a dotted line on the upper side overlaps with the fourth circumferential portion 3*b* illustrated by a solid line on the upper side.

Further, when it is assumed that the second coil 3 rotates about the center shaft 5 as a rotation shaft by 180°, a portion having a length of 60% or more of the entire length of the fourth circumferential portion 3*b* overlaps with a region where the third circumferential portion 3*a* existed before the aforementioned rotation. The entire length of the fourth circumferential portion 3*b* is a length from the first end 3*g* to the second end 3*i* of the fourth circumferential portion 3*b*.

In FIG. 3B, when it is set that the state illustrated by the solid line is brought into the state illustrated by the dotted line, in FIG. 3B, the portion having a length of 60% or more of the entire length of the fourth circumferential portion 3*b* illustrated by a dotted line on the lower side overlaps with the third circumferential portion 3*a* illustrated by a solid line on the lower side.

Incidentally, in the above explanation, 60% is preferred to be 78%, and more preferred to be 91% according to the minimum value β min of the variable magnification β.

Next, the positional relationship between the first coil 1 and the second coil 3 will be explained.

Figure 4:
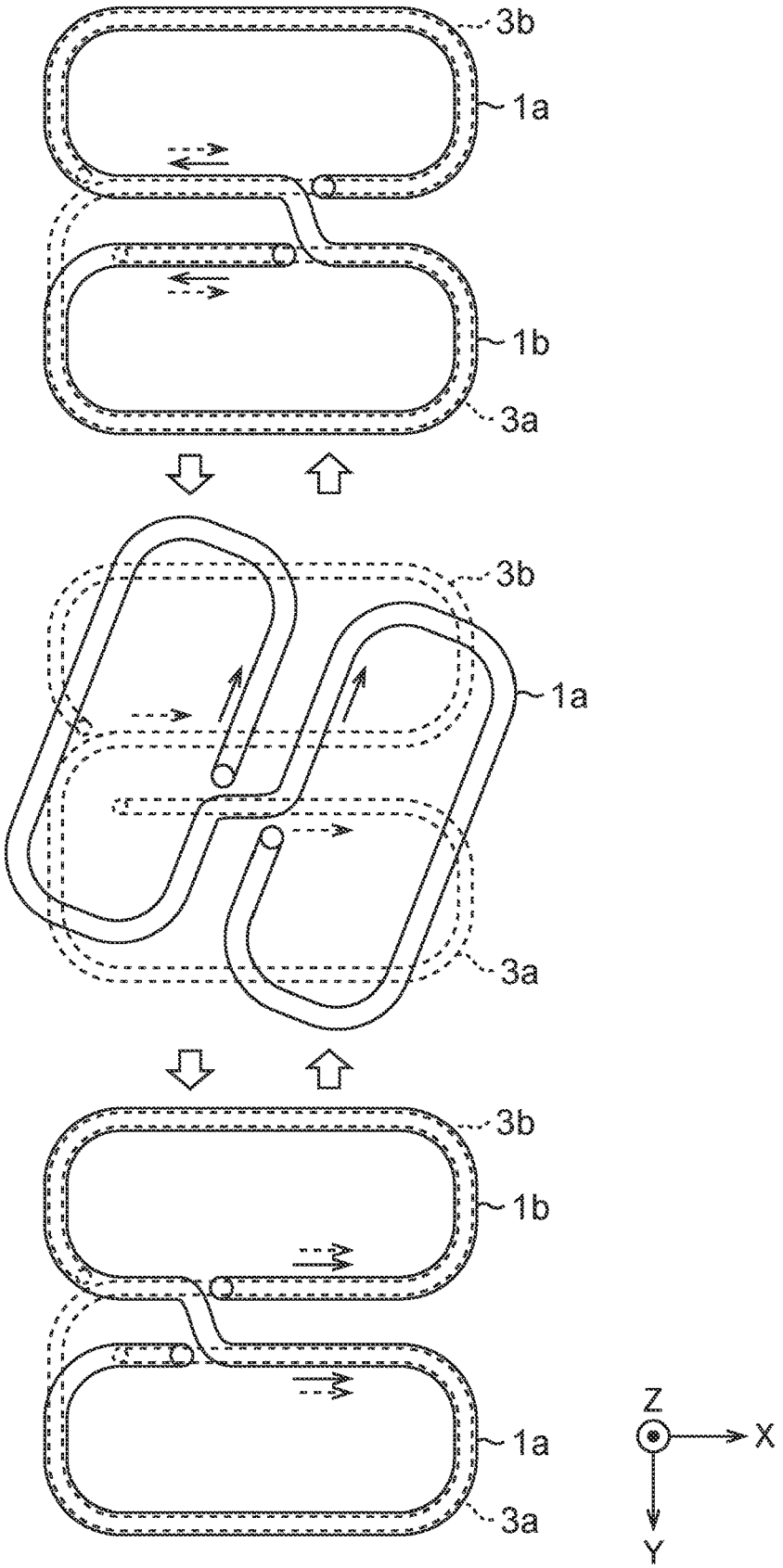
FIG. 4 is a view illustrating one example of the positional relationship between the first coil and the second coil.

FIG. 4 is a view illustrating one example of the positional relationship between the first coil 1 and the second coil 3. On the top of FIG. 4, an arrangement of the first coil 1 and the second coil 3 when the combined inductance GL by the first coil 1 and the second coil 3 becomes the minimum value is illustrated. On the bottom of FIG. 4, an arrangement of the first coil 1 and the second coil 3 when the combined inductance GL by the first coil 1 and the second coil 3 becomes the maximum value is illustrated. In the middle of FIG. 4, an arrangement of the first coil 1 and the second coil 3 when the combined inductance GL by the first coil 1 and the second coil 3 becomes an intermediate value (value greater than the minimum value and lower than the maximum value) is illustrated.

In FIG. 4, for convenience of illustration, the first coil 1 is illustrated by a solid line, and the second coil 3 is illustrated by a dotted line. Further, in FIG. 4, the arrow lines indicated by a solid line and a dotted line indicate the directions of alternating currents flowing through the first coil 1 and the second coil 3 (in the case of being seen from the same direction at the same time) respectively.

The state illustrated on the bottom of FIG. 4 is set as a first state. Further, the state illustrated on the top of FIG. 4 is set as a second state.

As illustrated on the bottom of FIG. 4, the first state is a state where the first circumferential portion 1*a* of the first coil 1 and the third circumferential portion 3*a* of the second coil 3 are at positions facing each other and the second circumferential portion 1*b* of the first coil 1 and the fourth circumferential portion 3*b* of the second coil 3 are at positions facing each other.

As illustrated on the top of FIG. 4, the second state is a state where the first circumferential portion 1*a* of the first coil 1 and the fourth circumferential portion 3*b* of the second coil 3 are at positions facing each other and the second circumferential portion 1*b* of the first coil 1 and the third circumferential portion 3*a* of the second coil 3 are at positions facing each other.

Here, regarding the shapes and the sizes of the first circumferential portion 1*a* and the second circumferential portion 1*b* and the shapes and the sizes of the third circumferential portion 3*a* and the fourth circumferential portion 3*b*, the following can be said.

In the first state illustrated on the bottom of FIG. 4, in the case where the first coil 1 and the second coil 3 are seen from the direction along the center shaft 5 (Z-axis direction), the portion having a length of 60% or more of the entire length of the first circumferential portion 1*a* and the portion having a length of 60% or more of the entire length of the third circumferential portion 3*a* overlap with each other. Further, in the first state, in the case where the first coil 1 and the second coil 3 are seen from the direction along the center shaft 5 (Z-axis direction), the portion having a length of 60% or more of the entire length of the second circumferential portion 1*b* and the portion having a length of 60% or more of the entire length of the fourth circumferential portion 3*b* overlap with each other.

In the second state illustrated on the top of FIG. 4, in the case where the first coil 1 and the second coil 3 are seen from the direction along the center shaft 5 (Z-axis direction), the portion having a length of 60% or more of the entire length of the first circumferential portion 1*a* and the portion having a length of 60% or more of the entire length of the fourth circumferential portion 3*b* overlap with each other. Further, in the second state, in the case where the first coil 1 and the second coil 3 are seen from the direction along the center shaft 5 (Z-axis direction), the portion having a length of 60% or more of the entire length of the second circumferential portion 1*b* and the portion having a length of 60% or more of the entire length of the third circumferential portion 3*a* overlap with each other.

Incidentally, in the above-described explanation, 60% is preferred to be 78%, and more preferred to be 91% according to the minimum value β min of the variable magnification β.

Here, each length of the first connecting portion 1*c* and the second connecting portion 3*c* is shorter as compared to each length of the first circumferential portion 1*a*, the second circumferential portion 1*b*, the third circumferential portion 3*a*, and the fourth circumferential portion 3*b*. Thus, it is little different substantially even when the shapes and the sizes of the first coil 1 (the first circumferential portion 1*a*, the second circumferential portion 1*b*, and the first connecting portion 1*c*) and the second coil 3 (the third circumferential portion 3*a*, the fourth circumferential portion 3*b*, and the second connecting portion 3*c*) are the same in the portion of 60% or more (preferably 78% or more, more preferably 91% or more) of the total length of these. Thus, the aforementioned prescription made in the aforementioned explanation may be made with the shapes and the sizes of the first coil 1 (the first circumferential portion 1*a*, the second circumferential portion 1*b*, and the first connecting portion 1*c*) and the second coil 3 (the third circumferential portion 3*a*, the fourth circumferential portion 3*b*, and the second connecting portion 3*c*), in place of the shapes and the sizes of the first circumferential portion 1*a*, the second circumferential portion 1*b*, the third circumferential portion 3*a*, and the fourth circumferential portion 3*b*.

Next, there will be explained members forming the first coil 1 and the second coil 3.

In this embodiment, the first coil 1 and the second coil 3 are formed by using a water-cooled cable. The water-cooled cable includes a hose and an electric wire passing through the inside of the hose, for example. The hose and the electric wire both are set to have flexibility. Thus, the first coil 1 and the second coil 3 also have flexibility. Incidentally, the hose is formed of an insulating material. Further, the electric wire may be formed of a single wire, or may also be formed of a plurality of wires. In the case where the electric wire is formed of a plurality of wires, the electric wire may be set to a Litz wire, for example.

Next, the arrangement of the first coil 1 and the second coil 3 in the inductance adjusting device will be explained.

In this embodiment, coil surfaces of the first coil 1 and the second coil 3 are designed to be parallel in a state of having constant intervals G therebetween when the first coil 1 and the second coil 3 are arranged as illustrated in FIG. 1A. The size of the interval G can be set according to the maximum value of the inductance changeable in the inductance adjusting device, or the like, for example. The coil surface of the first coil 1 is a horizontal plane (X-Y plane) in a region surrounded by the first circumferential portion 1*a* and the second circumferential portion 1*b*. The coil surface of the second coil 3 is a horizontal plane (X-Y plane) in a region surrounded by the third circumferential portion 3*a* and the fourth circumferential portion 3*b*.

As described previously, the center shaft 5 is to rotate the first coil 1. The center shaft 5 is rotatably attached to the casing 9 via a bearing or the like. The drive unit 6 is a driving source for rotating the center shaft 5, and includes a motor and so on.

Next, connection between the first coil 1 and the second coil 3 will be explained.

The power feeding terminals 7*a* to 7*d* are terminals for supplying alternating-current power, which is supplied from the not-illustrated alternating-current power supply circuit, to the first coil 1 and the second coil 3. As illustrated in FIG. 1A and FIG. 1B, the power feeding terminals 7*a* to 7*d* are attached (fixed) to the casing 9 so that their tip-side regions are exposed.

In this embodiment, out of both end portions of the first coil 1, one end portion led out through the hole 2*a* of the first supporting member 2 (the second end 1*i* of the second circumferential portion 1*b*) is connected to the power feeding terminal 7*a*. On the other hand, out of the both end portions of the first coil 1, the other end portion led out through the hole 2*b* of the first supporting member 2 (the second end 1*h* of the first circumferential portion 1*a*) is connected to the power feeding terminal 7*d*.

Further, out of both end portions of the second coil 3, one end portion led out through the hole 4*a* of the second supporting member 4 (the second end 3*h* of the third circumferential portion 3*a*) is connected to the power feeding terminal 7*b*. On the other hand, out of the both end portions of the second coil 3, the other end portion led out through the hole 4*b* of the second supporting member 4 (the second end 3*i* of the fourth circumferential portion 3*b*) is connected to the power feeding terminal 7*c*.

The not-illustrated alternating-current power supply circuit is electrically connected to the power feeding terminals 7*a*, 7*c*. Further, the power feeding terminals 7*b* and 7*d* are electrically connected to each other.

In the above manner, the first coil 1 and the second coil 3 are connected in series. That is, the alternating current supplied from the alternating-current power supply circuit flows through a path of the "alternating-current power supply circuit→the power feeding terminal 7*a*→the first coil 1→the power feeding terminal 7*d*→the power feeding terminal 7*b*→the second coil 3→the power feeding terminal 7*c*→the alternating-current power supply circuit" and a path of the "alternating-current power supply circuit→the power feeding terminal 7*c*→the second coil 3→the power feeding terminal 7*b*→the power feeding terminal 7*d*→the first coil 1→the power feeding terminal 7*a*→the alternating-current power supply circuit" alternately.

As illustrated in FIG. 2A, the directions (when seen from the same direction) of the alternating currents flowing through linear portions on the center shaft 5 side of the first circumferential portion 1*a* and the second circumferential portion 1*b* of the first coil 1 (at the same time) become the same (see the arrow lines added to the first coil 1 in FIG. 2A). In the same manner, as illustrated in FIG. 2B, the directions (when seen from the same direction) of the alternating currents flowing through linear portions on the center shaft 5 side of the third circumferential portion 3*a* and the fourth circumferential portion 3*b* of the second coil 3 (at the same time) become the same (see the arrow lines added to the second coil 3 in FIG. 2B).

The power feeding terminals 7*a* to 7*d* each have a hollow portion. When the first coil 1 and the second coil 3 are connected to the power feeding terminals 7*a* to 7*d* as above, these hollow portions and the insides of the hoses forming the first coil 1 and the second coil 3 communicate with each other.

The water feeding terminals 8*a* to 8*d* are terminals for supplying a cooling water, which is supplied by using a not-illustrated pump, or the like, into the insides of the first coil 1 and the second coil 3. Incidentally, the insides of the first coil 1 and the second coil 3 mean the insides of the hoses forming the first coil 1 and the second coil 3. The water feeding terminals 8*a* to 8*d* each have a hollow portion. The water feeding terminals 8*a* to 8*d* are attached to the tip-side regions of the power feeding terminals 7*a* to 7*d* (regions exposed from the casing 9) respectively so that the hollow portions of the power feeding terminals 7*a* to 7*d* and the hollow portions of the water feeding terminals 8*a* to 8*d* communicate with each other.

The water feeding terminals 8*b* and 8*d* are connected to each other by a not-illustrated hose. On the other hand, to each of the water feeding terminals 8*a* and 8*c*, a not-illustrated hose for supplying the cooling water is attached. The cooling water flows out from and flows into the water feeding terminals 8*a*, 8*c* through the hoses attached to the water feeding terminals 8*a*, 8*c*.

In the above manner, it is possible to form flow paths for the cooling water in the first coil 1 and the second coil 3. Thus, it is possible to cool the first coil 1 and the second coil 3, and apply a large current to the first coil 1 and the second coil 3. For example, it is possible to apply a current of 100 [A] or more, preferably a current of 500 [A] or more to the first coil 1 and the second coil 3.

<Inductance Adjustment>

Next, there will be explained one example of a method of adjusting the inductance in the inductance adjusting device with reference to FIG. 4, FIG. 5A, FIG. 5B, FIG. 6A, and FIG. 6B. The inductance in the inductance adjusting device is the combined inductance GL by the first coil 1 and the second coil 3. The combined inductance GL by the first coil 1 and the second coil 3 is set to the inductance when seen from the aforementioned alternating-current power supply circuit. Further, in the following explanation, the combined inductance GL by the first coil 1 and the second coil 3 will be abbreviated as the combined inductance GL as necessary.

Figure 5A:
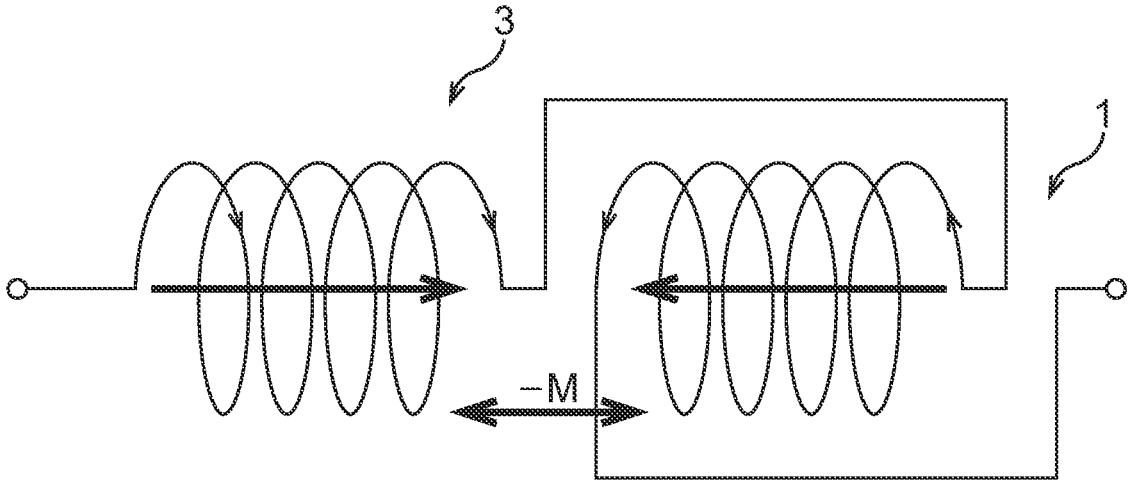
FIG. 5A is a view illustrating a first example of directions of magnetic fluxes generated in the first coil and the second coil, together with circuit symbols of the first coil and the second coil.
Figure 5B:
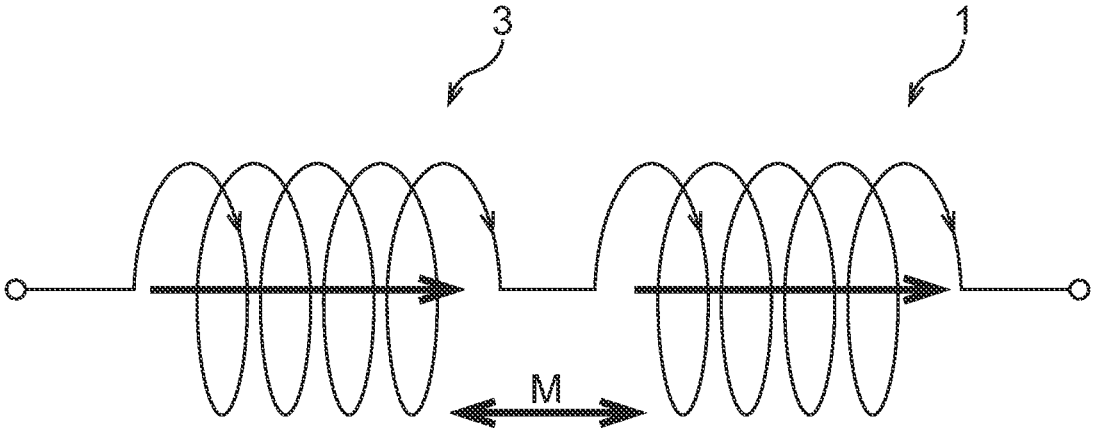
FIG. 5B is a view illustrating a second example of the directions of the magnetic fluxes generated in the first coil and the second coil, together with the circuit symbols of the first coil and the second coil.
Figure 6A:
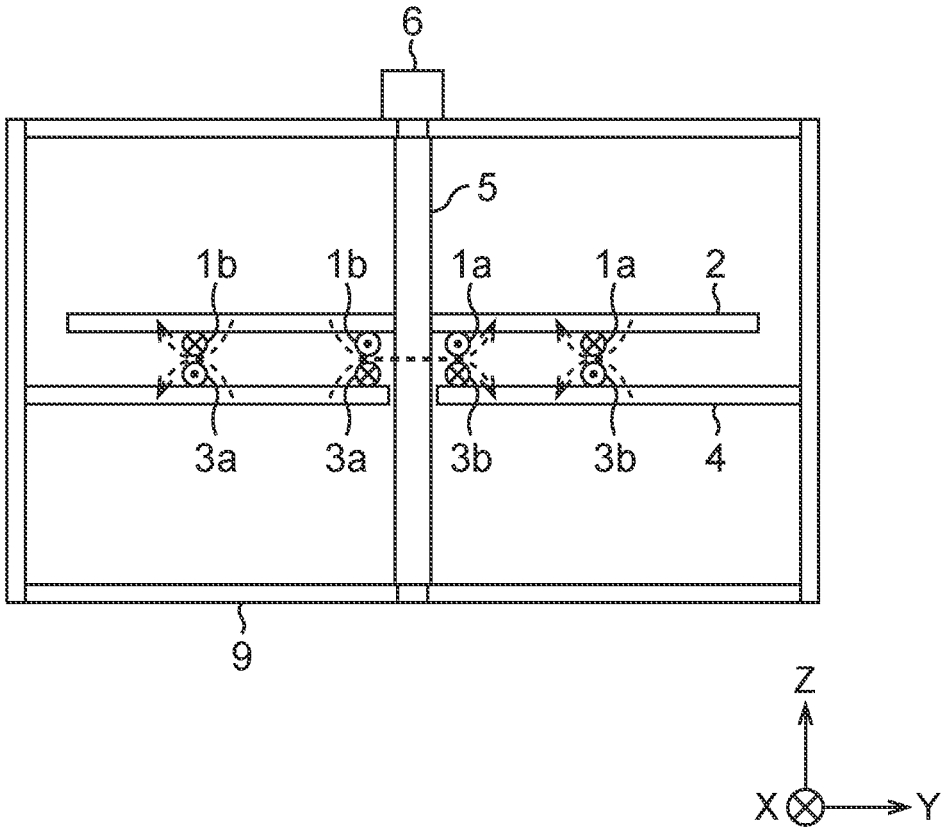
FIG. 6A is a view illustrating the first example of the magnetic fluxes generated in the first coil and the second coil, together with the first coil and the second coil in a state of being arranged in the inductance adjusting device.
Figure 6B:
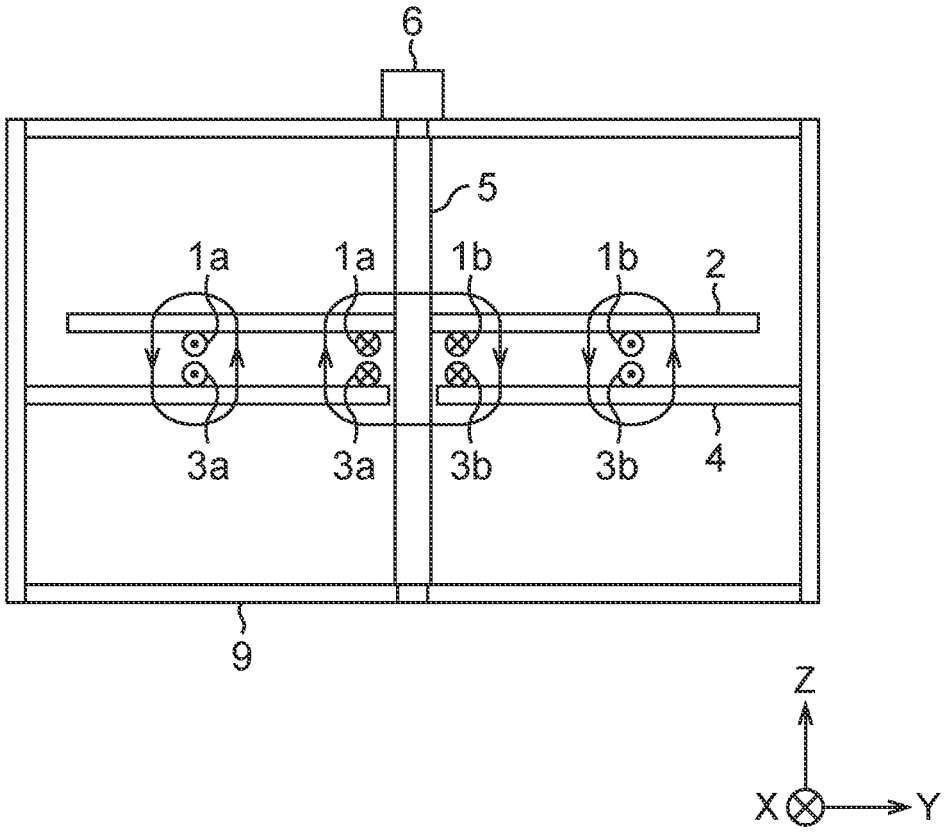
FIG. 6B is a view illustrating the second example of the magnetic fluxes generated in the first coil and the second coil, together with the first coil and the second coil in a state of being arranged in the inductance adjusting device.

FIG. 5A, FIG. 5B, FIG. 6A, and FIG. 6B are views each illustrating one example of directions of magnetic fluxes to occur when the alternating current is applied to the First coil 1 and the second coil 3. In FIG. 5A and FIG. 5B, the directions of the magnetic fluxes are illustrated together with circuit symbols indicating the first coil 1 and the second coil 3. In FIG. 6A and FIG. 6B, the directions of the magnetic fluxes are illustrated together with the first coil 1 and the second coil 3 in a state of being arranged in the inductance adjusting device.

FIG. 5A and FIG. 6A are views each illustrating the directions of the magnetic fluxes when the combined inductance CL becomes the minimum value. FIG. 5B and FIG. 6B are views each illustrating the directions of the magnetic fluxes when the combined inductance CL becomes the maximum value.

In FIG. 5A and FIG. 5B, the arrows attached to the first coil 1 and the second coil 3 each indicate the direction of the alternating current. Further, the arrow lines passing through the first coil 1 and the second coil 3 each indicate the direction of the magnetic flux. In FIG. 6A and FIG. 6B, the marks of ● and X each added inside ○ indicate the direction of the alternating current. The mark of ● added inside ○ indicates the direction from the far side of the sheet toward the near side, and the mark of X added inside ○ indicates the direction from the near side of the sheet toward the far side. Further, the arrow lines indicated by a dotted line in FIG. 6A and the loops indicated by a solid line together with the arrows in FIG. 65 indicate the directions of the magnetic fluxes.

In the second state illustrated on the top of FIG. 4, the first circumferential portion 1*a* of the first coil 1 and the fourth circumferential portion 3*b* of the second coil 3 are faced to each other, and the second circumferential portion 1*b* of the first coil 1 and the third circumferential portion 3*a* of the second coil 3 are faced to each other. Then, the direction of the alternating current flowing through the first circumferential portion 1*a* of the first coil 1 and the direction of the alternating current flowing through the fourth circumferential portion 3*b* of the second coil 3 are opposite. Similarly, the direction of the alternating current flowing through the second circumferential portion 1*b* of the first coil 1 and the direction of the alternating current flowing through the third circumferential portion 3*a* of the second coil 3 are opposite.

Thus, as illustrated in FIG. 5A, the magnetic fluxes generated from the first coil 1 and the second coil 3 are weakened mutually. The combined inductance GL in this case is expressed by (1) Equation below when a self-inductance of the first coil 1 is set to L1, a self-inductance of the second coil 3 is set to L2, and a mutual inductance of the first coil 1 and the second coil 3 is set to M.

$$GL=L1+L2-2M \tag{1}$$

The combined inductance GL expressed by (1) Equation becomes the minimum value of the combined inductance GL.

Here, the mutual inductance M of the first coil 1 and the second coil 3 is expressed by (2) Equation below when the coupling coefficient between the first coil 1 and the second coil 3 is set to k.

$$M=\pm k\hat{}(L1\cdot L2) \tag{2}$$

The coupling coefficient k is determined by the shapes, sizes, and relative positions of the first coil 1 and the second coil 3, and the relationship of $0 \leq k \leq 1$ is established. k=1 indicates the case of no leakage flux, but the leakage flux occurs actually, resulting in that the coupling coefficient k becomes a value of less than 1.

At this time, the magnetic fluxes to occur by applying the alternating current to the first coil 1 and the second coil 3 are as illustrated in FIG. 6A.

The first state illustrated on the bottom of FIG. 4 is a state where the first coil 1 is rotated by 180° from the second state illustrated on the top of FIG. 4. In the first state, the first circumferential portion 1*a* of the first coil 1 and the third circumferential portion 3*a* of the second coil 3 are faced to each other, and the second circumferential portion 1*b* of the first coil 1 and the fourth circumferential portion 3*b* of the second coil 3 are faced to each other. Then, the direction of the alternating current flowing through the first circumferential portion 1*a* of the first coil 1 and the direction of the alternating current flowing through the third circumferential portion 3*a* of the second coil 3 are the same. Similarly, the direction of the alternating current flowing through the second circumferential portion 1*b* of the first coil 1 and the direction of the alternating current flowing through the fourth circumferential portion 3*b* of the second coil 3 are the same.

Thus, as illustrated in FIG. 5B, the magnetic fluxes generated from the first coil 1 and the second coil 3 are intensified mutually. The combined inductance GL in this case is expressed by (3) Equation below.

$$GL=L1+L2+2M \tag{3}$$

The combined inductance GL expressed by (3) Equation becomes the maximum value of the combined inductance GL.

As above, when the first coil 1 is rotated by 180° from the second state illustrated on the top of FIG. 4, the first state illustrated on the bottom of FIG. 4 is made. Rotating the first coil 1 makes it possible to make the directions of the alternating currents flowing through the first coil 1 and the second coil 3 the same or opposite.

Thus, as long as the first coil 1 is rotated within a range of 0° to 180° when the rotation angle of the first coil 1 in the second state illustrated on the top of FIG. 4 is set to 0°, it is possible to change the combined inductance CL from the minimum value to the maximum value. Accordingly, in this embodiment, the drive unit 6 rotates the first coil 1 within a range of 0° to 180°. Incidentally, unless otherwise noted, the rotation angle of the first coil 1 described below is also set to the angle in the case where the rotation angle of the first coil 1 in the second state illustrated on the top of FIG. 4 is set to 0°.

The state illustrated in the middle of FIG. 4 is the state between the state illustrated on the top of FIG. 4 and the state illustrated on the bottom of FIG. 4. Thus, the combined inductance GL in this state indicates the value between the maximum value expressed by (3) Equation and the minimum value expressed by (1) Equation. This value is determined according to the rotation angle of the first coil 1.

In this embodiment, the combined inductance CL is changed by rotating the first coil 1 in this manner, thereby making it possible to adjust the inductance of the electric circuit to which the inductance adjusting device is connected online.

In the case where the rotation angle of the first coil 1 is changed between 0° and 180° continuously, the variable magnification β of the combined inductance GL when seen from the alternating-current power supply circuit is expressed by the value obtained by dividing the combined inductance GL in the case of the rotation angle of the first coil 1 being 180° by the combined inductance GL in the case of the rotation angle of the first coil 1 being 0°. Thus, the variable magnification β of the combined inductance GL when seen from the alternating-current power supply circuit is expressed by (4) Equation below.

$$\beta=(2L+2M)\div(2L-2M)=(2L+2kL)\div(2L-2kL)=(1+k)\div(1-k) \quad (4)$$

However, in order to simplify explanation here, the self-inductances L1, L2 of the first coil 1 and the second coil 3 are set to L (L1=L2=L). In this case, the coupling coefficient k between the first coil 1 and the second coil 3 is expressed by (5) Equation below.

$$M=\pm k\sqrt{(L1\cdot L2)}=\pm k\sqrt{(L\cdot L)}=\pm kL \quad (5)$$

When k=0.5 is assumed, for example, the variable magnification β of the combined inductance GL when seen from the alternating-current power supply circuit triples (β=(1+0.5)÷(1−0.5)=3). In the case of k=0.5 times or more, for example, the variable magnification β of the combined inductance GL when seen from the alternating-current power supply circuit can be made 3 or more. Increasing the coupling coefficient k between the first coil 1 and the second coil 3 makes it possible to increase the variable magnification β of the combined inductance GL when seen from the alternating-current power supply circuit. Thus, the shapes, the sizes, and the relative positions of the first coil 1 and the second coil 3 are preferably determined so that the coupling coefficient k between the first coil 1 and the second coil. 3 increases.

As above, in this embodiment, the first coil 1 is rotated, to thereby adjust the combined inductance GL. Thus, changing the occupancy ratio of the magnetic body in the solenoid coil like the technique described in Patent Literature 1 is no longer required, and further, extending and contracting the coil like the technique described in Patent Literature 2 is also no longer required. Accordingly, it is possible to simplify the structure of the inductance adjusting device and at the same time, downsize the inductance adjusting device. This leads to the reduction in cost of the inductance adjusting device.

Further, as described previously, the coil surface of the first coil 1 and the coil surface of the second coil 3 are parallel. Further, the first coil 1 (the first circumferential portion 1*a* and the second circumferential portion 1*b*) and the second coil 3 (the third circumferential portion 3*a* and the fourth circumferential portion 3*b*) are arranged at the positions opposite to each other across the center shaft 5 (positions to be 2-fold symmetry). Further, the first circumferential portion 1*a*, the second circumferential portion 1*b*, the third circumferential portion 3*a*, and the fourth circumferential portion 3*b* are the same in size and shape. Thus, even when a large current is applied to the first coil 1 and the second coil 3 and an attractive force and a repulsive force occur between the first coil 1 and the second coil 3, the aforementioned repulsive force and attractive force are well-balanced between both sides of the first coil 1 (the first circumferential portion 1*a* side and the second circumferential portion 1*b* side) and both sides of the second coil 3 (the third circumferential portion 3*a* side and the fourth circumferential portion 3*b* side). Accordingly, as compared to the case of the structure supporting the coil ends as described in Patent Literature 3, it is possible to easily prevent the coil from moving by the aforementioned repulsive force and attractive force. Accordingly, the first supporting member 2 and the second supporting member 4 each only need to have strength capable of supporting the first coil 1 and the second coil 3 so as to prevent the positions in the Z-axis direction from being displaced as much as possible. Therefore, it is possible to easily design the strengths of the first supporting member 2 and the second supporting member 4.

Further, in the technique described in Patent Literature 3, the two coils each have only one coaxial circumferential portion. Thus, when the rotation angle of the other coil corresponding to one coil becomes larger than 90°, the two coils no longer overlap with each other. Therefore, the rate of change of magnitude of a mutual inductance of the two coils (change per unit angle) decreases. Thus, the change of the inductance is proportional to the logarithm of the rotation angle.

In this embodiment on the other hand, the mutual inductance M of the first coil 1 and the second coil 3 can be changed in the same manner in the range of 0° to 90° and in the range of 90° to 180° in terms of the rotation angle of the first coil 1 except the reference numerals and symbols. Thus, the relationship between the magnitude of the combined inductance GL and the rotation angle of the first coil 1 exhibits a linear relationship better than that in the technique described in Patent Literature 3. Accordingly, it is possible to perform the frequency control with high accuracy.

Figure 7A:
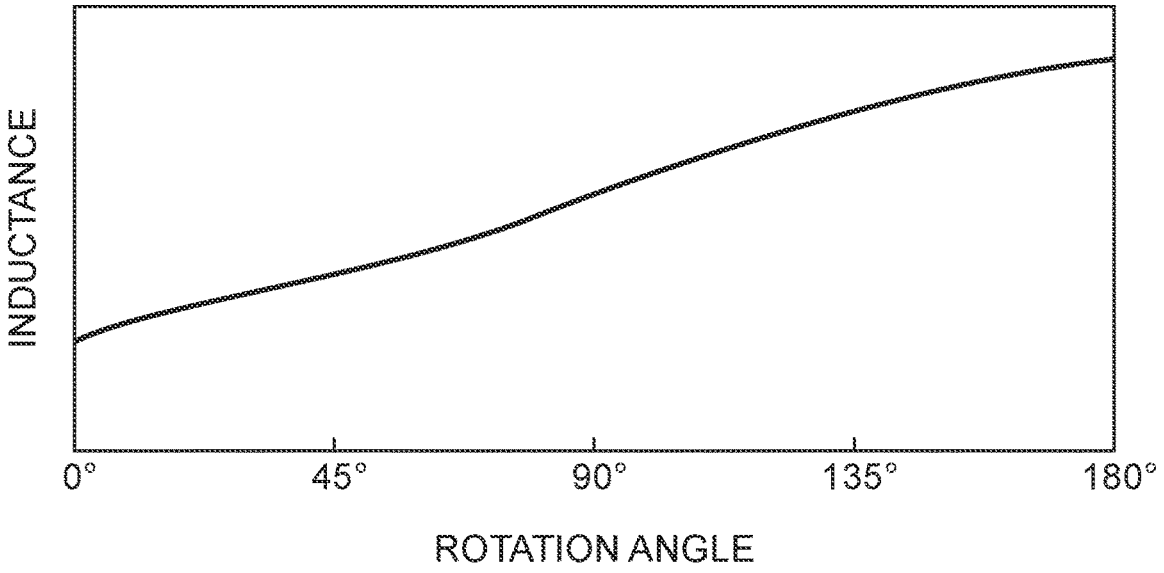
FIG. 7A is a view illustrating one example of the relationship between an inductance and a rotation angle in the inductance adjusting device in this embodiment.
Figure 7B:
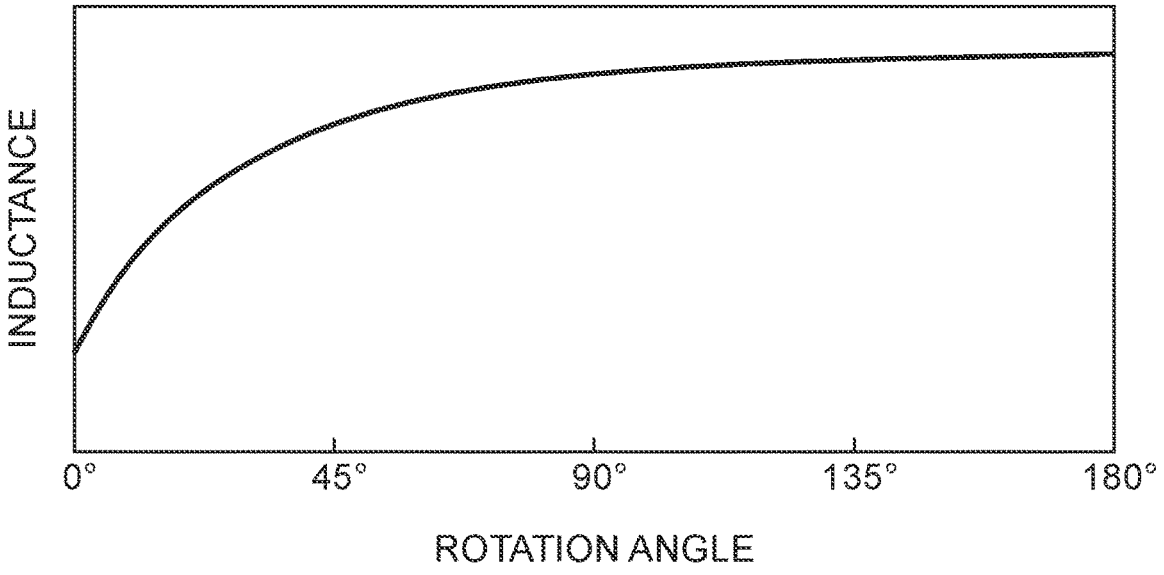
FIG. 7B is a view illustrating one example of the relationship between an inductance and a rotation angle in the technique described in Patent Literature 3.

FIG. 7A is a view illustrating one example of the relationship between an inductance and a rotation angle in the inductance adjusting device in this embodiment. Here, the inductance is the combined inductance GL and the rotation angle is the rotation angle of the first coil 1. FIG. 7B is a view illustrating one example of the relationship between an inductance and a rotation angle in the technique described in Patent Literature 3. Here, the inductance is the combined inductance of the two coils described in Patent Literature 3, and the rotation angle is the sum of absolute values of angles when the two coils rotate about the coil ends as a shaft.

As illustrated in FIG. 7A, in the inductance adjusting device in this embodiment, the rate of change of the inductance to change of the rotation angle (namely, the gradient of the graph illustrated in FIG. 7A) becomes constant generally regardless of the rotation angle. In contrast to this, in the technique described in Patent Literature 3, when the rotation angle is small, the rate of change of the inductance to change of the rotation angle increases. Then, as the rotation angle becomes larger, the rate of change of the inductance to change of the rotation angle decreases. Thus, in the technique described in Patent Literature 3, adjustment of the inductance is no longer easy.

MODIFIED EXAMPLES

Modified Example 1

Modified Example 1-1

The shape formed by the first circumferential portion, the second circumferential portion, and the first connecting portion is not limited to the figure of 8 in Arabic numerals. Similarly, the shape formed by the third circumferential portion, the fourth circumferential portion, and the second connecting portion is also not limited to the figure of 8 in Arabic numerals. For example, such shapes as illustrated in FIG. 8A and FIG. 8B may be applied.

Figure 8A:
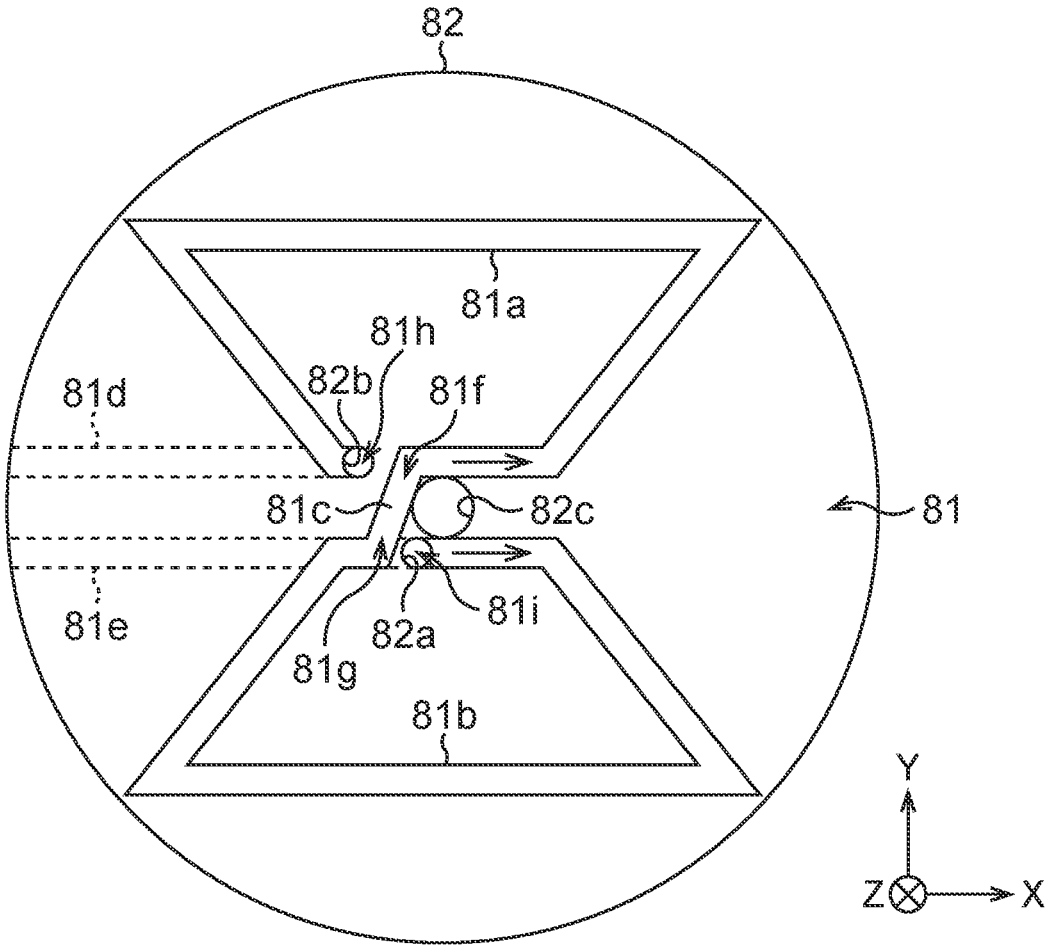
FIG. 8A is a view illustrating a first modified example of the first coil and the first supporting member.
Figure 8B:
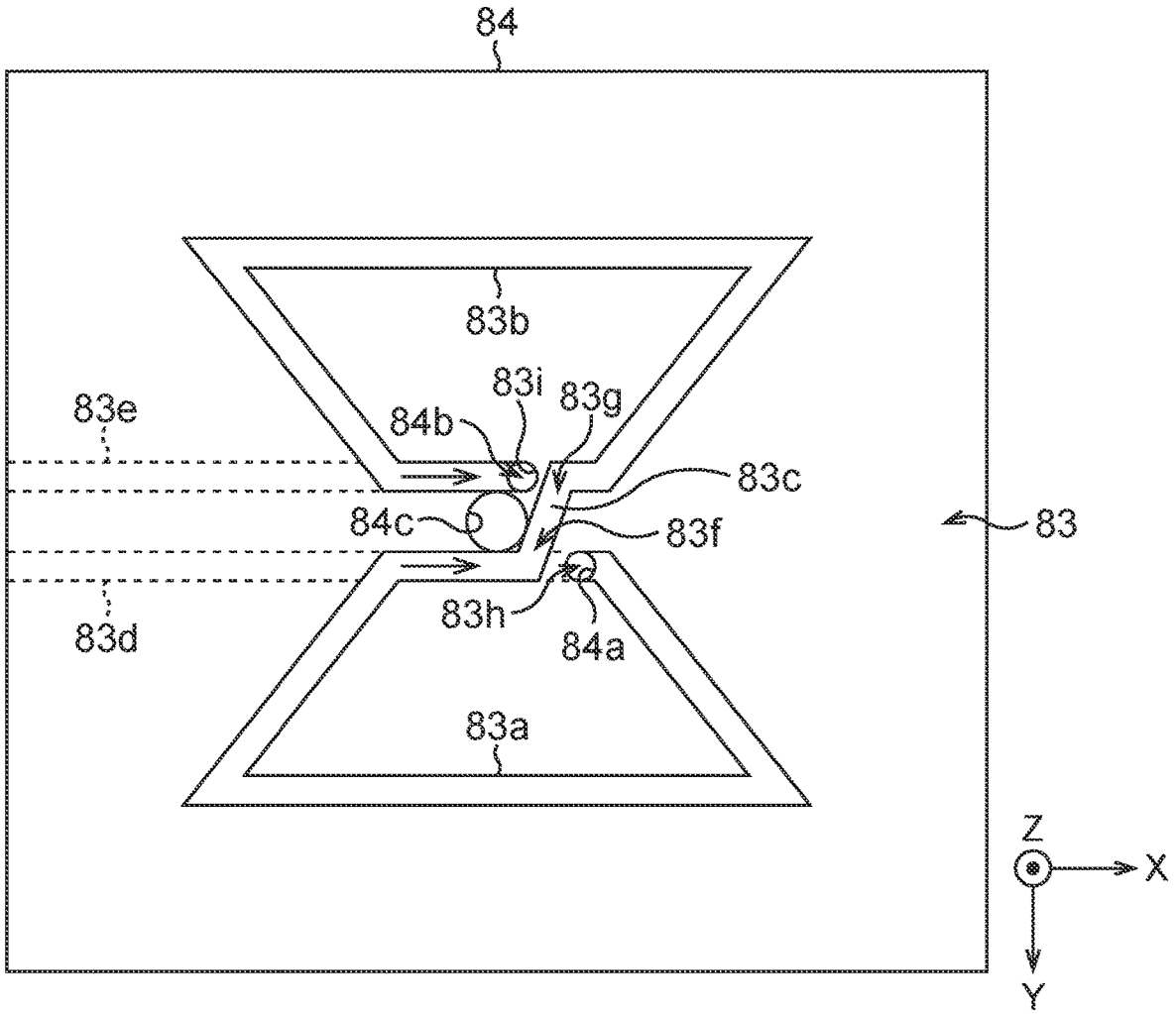
FIG. 8B is a view illustrating a first modified example of the second coil and the second supporting member.

FIG. 8A is a view illustrating a first modified example of a first coil 81 and a first supporting member 82. FIG. 8B is a view illustrating a first modified example of a second coil 83 and a second supporting member 84. FIG. 8A is a view corresponding to FIG. 2A, and FIG. 8B is a view corresponding to FIG. 2B.

The first supporting member 82 is a member for supporting the first coil 81. The first coil 81 is attached to the first supporting member 82 to be fixed on the first supporting member 82. As illustrated in FIG. 8A, holes 82*a*, 82*b* intended for attaching the first coil 81 are formed in the first supporting member 82. Further, in the center of the first supporting member 82, a hole 82*c* intended for attaching the first supporting member 82 to a center shaft 5 is formed. The first coil 81 and the first supporting member 82 rotate with rotation of the first supporting member 82. The first supporting member 82 can be fabricated by the same one as that of the first supporting member 2 illustrated in FIG. 2A.

The first coil 81 has a first circumferential portion 81*a*, a second circumferential portion 81*b*, a first connecting portion 81*c*, a first lead-out portion 81*d*, and a second lead-out portion 81*e*. The first circumferential portion 81*a*, the second circumferential portion 81*b*, the first connecting portion 81*c*, the first lead-out portion 81*d*, and the second lead-out portion 81*e* are integrated.

The first circumferential portion 81*a* is a portion circling so as to surround an inner region thereof. The second circumferential portion 81*b* is also a portion circling so as to surround an inner region thereof. The first circumferential portion 81*a* and the second circumferential portion 81*b* are arranged on the same horizontal plane (X-Y plane).

The first connecting portion 81*c* is a portion that connects a first end 81*f* of the first circumferential portion 81*a* and a first end 81*g* of the second circumferential portion 81*b* mutually, and is a non-circumferential portion.

The first lead-out portion 81*d* is connected to a second end 81*h* of the first circumferential portion 81*a*. The second end 81*h* of the first circumferential portion 81*a* is positioned at the hole 82*b*. The second lead-out portion 81*e* is connected to a second end 81*i* of the second circumferential portion 81*b*. The second end 81*i* of the second circumferential portion 81*b* is positioned at the hole 82*a*.

The second supporting member 84 is a member for supporting the second coil 83. The second supporting member 84 is attached to a casing 9 so as to be coaxial with the center shaft 5 and is fixed to the casing 9. The second coil 83 is attached to the second supporting member 84 to be fixed on the second supporting member 84. As illustrated in FIG. 8B, in the second supporting member 84, holes 84*a*, 84*b* intended for attaching the second coil 83 are formed. Further, in the center of the second supporting member 84, there is formed a hole 84*c* intended for arranging the second supporting member 84 coaxially with the center shaft 5. The hole 84*c* is formed so as to have an interval between the second supporting member 84 and the center shaft 5 when the center shaft 5 is passed through the hole 84*e*. In this manner, even when the center shaft 5 rotates, the second supporting member 84 is brought into a state of being fixed to the casing 9 without rotation. The second supporting member 84 can be fabricated by the same one as that of the second supporting member 4 illustrated in FIG. 2B.

The second coil 83 has a third circumferential portion 83*a*, a fourth circumferential portion 83*b*, a second connecting portion 83*c*, a third lead-out portion 83*d*, and a fourth lead-out portion 83*e*. The third circumferential portion 83*a*, the fourth circumferential portion 83*b*, the second connecting portion 83*c*, the third lead-out portion 83*d*, and the fourth lead-out portion 83*e* are integrated.

The third circumferential portion 83*a* is a portion circling so as to surround an inner region thereof. The fourth circumferential portion 83*b* is also a portion circling so as to surround an inner region thereof. The third circumferential portion 83*a* and the fourth circumferential portion 83*b* are arranged on the same horizontal plane (X-Y plane).

The second connecting portion 83*c* is a portion that connects a first end 83*f* of the third circumferential portion 83*a* and a first end 83*g* of the fourth circumferential portion 83*b* mutually, and is a non-circumferential portion.

The third lead-out portion 83*d* is connected to a second end 83*h* of the third circumferential portion 83*a*. The second end 83*h* of the third circumferential portion 83*a* is positioned at the hole 84*a*. The fourth lead-out portion 83*e* is connected to a second end 83*i* of the fourth circumferential portion 83*b*. The second end 83*i* of the fourth circumferential portion 83*b* is positioned at the hole 84*b*.

Incidentally, the outermost peripheral contour shapes of the first circumferential portion, the second circumferential portion, the third circumferential portion, and the fourth circumferential portion may be another shape (for example, a perfect circle, an oval, or a rectangle).

Modified Example 1-2

The connection between the first circumferential portion and the second circumferential portion and the connection between the third circumferential portion and the fourth circumferential portion are not limited to the connections illustrated in FIG. 2A and FIG. 2B. That is, the directions of the alternating currents flowing through the first circumferential portion and the second circumferential portion and the directions of the alternating currents flowing through the third circumferential portion and the fourth circumferential portion are not limited to the directions illustrated in FIG. 2A and FIG. 2B.

Figure 9A:
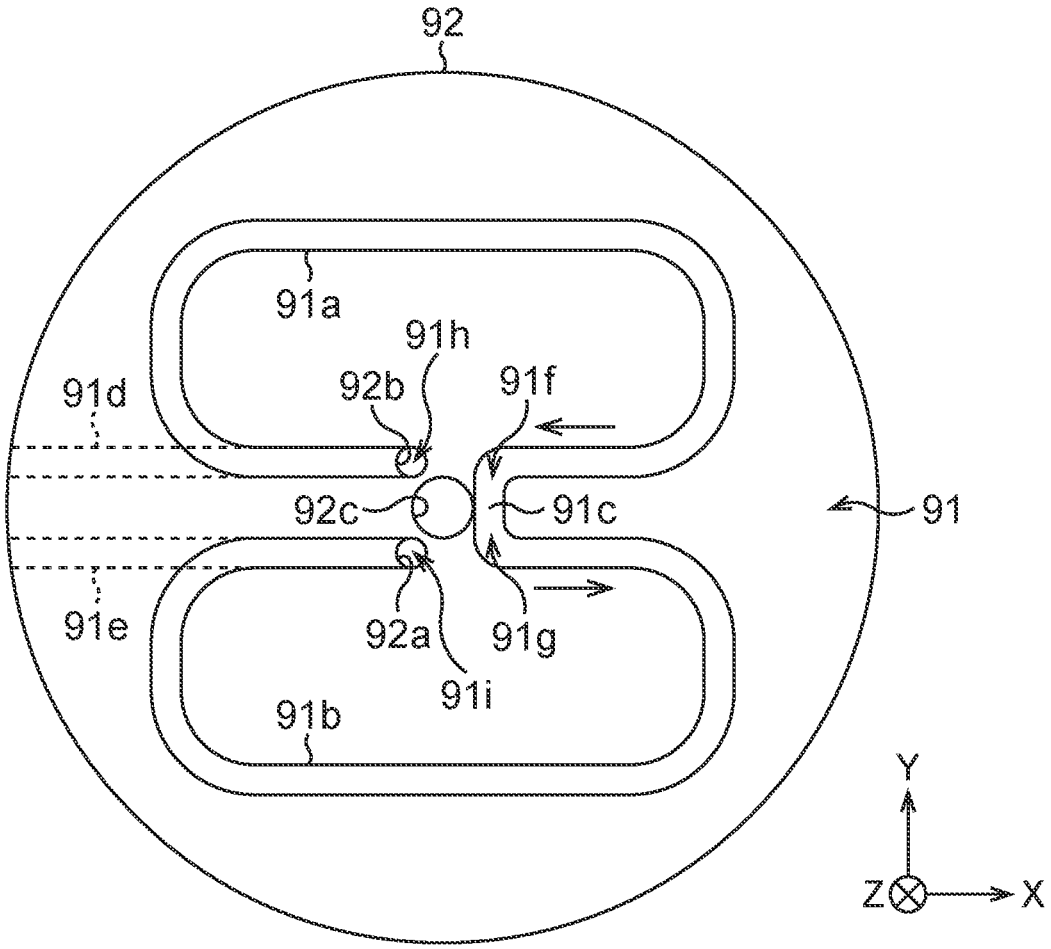
FIG. 9A is a view illustrating a second modified example of the first coil and the first supporting member.
Figure 9B:
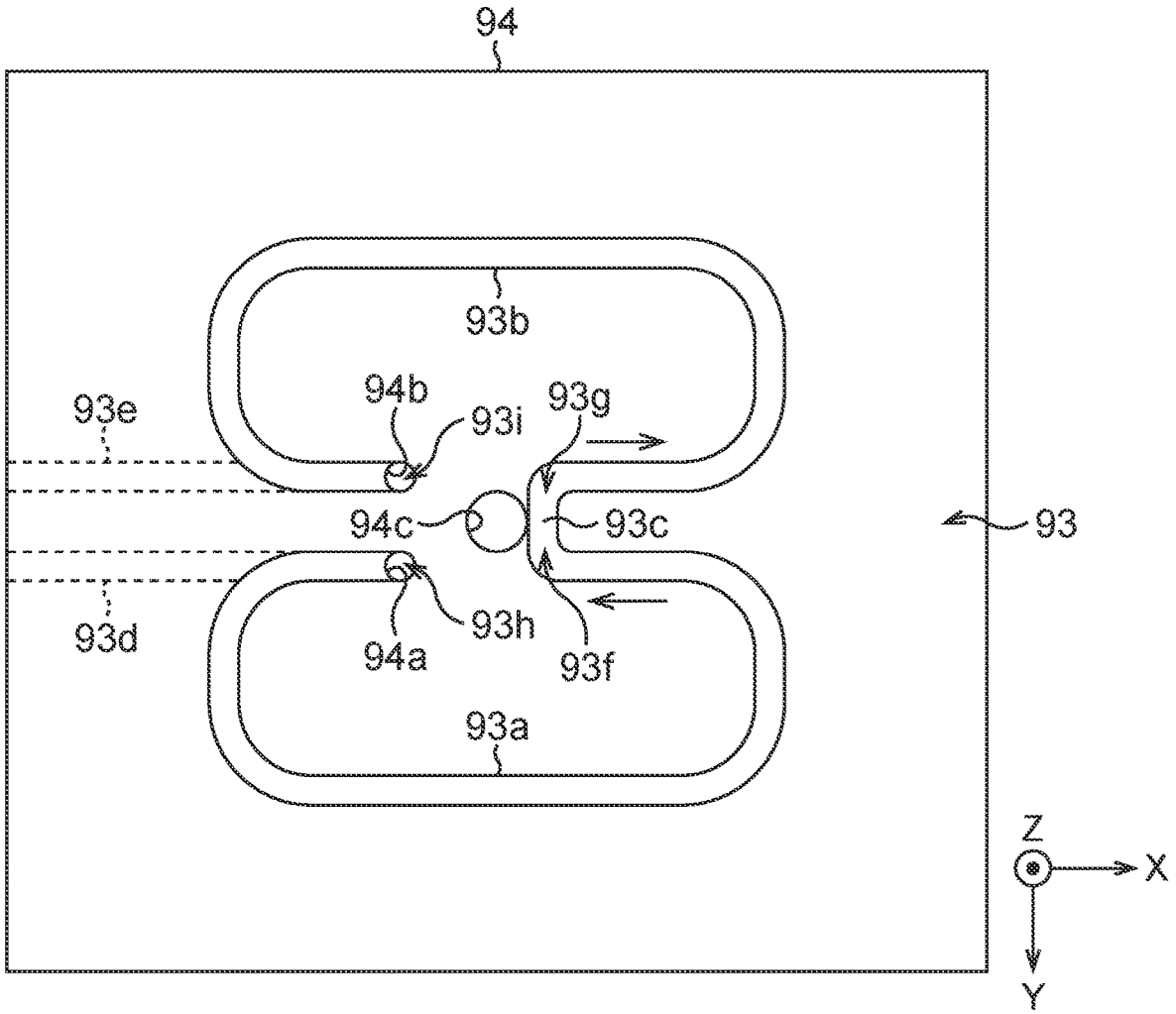
FIG. 9B is a view illustrating a second modified example of the second coil and the second supporting member.

FIG. 9A is a view illustrating a second modified example of a first coil 91 and a first supporting member 92. FIG. 9B is a view illustrating a second modified example of a second coil 93 and a second supporting member 94. FIG. 9A is a view corresponding to FIG. 2A, and FIG. 9B is a view corresponding to FIG. 2B.

The first supporting member 92 is a member for supporting the first coil 91. The first coil 91 is attached to the first supporting member 92 to be fixed on the first supporting member 92. As illustrated in FIG. 9A, holes 92*a*, 92*b* intended for attaching the first coil 91 are formed in the first supporting member 92. Further, in the center of the first supporting member 92, a hole 92*c* intended for attaching the first supporting member 92 to a center shaft 5 is formed. The first coil 91 and the first supporting member 92 rotate with rotation of the first supporting member 92. The first supporting member 92 can be fabricated by the same one as that of the first supporting member 2 illustrated in FIG. 2A.

The first coil 91 has a first circumferential portion 91*a*, a second circumferential portion 91*b*, a first connecting portion 91*c*, a first lead-out portion 91*d*, and a second lead-out portion 91*e*. The first circumferential portion 91*a*, the second circumferential portion 91*b*, the first connecting portion 91*c*, the first lead-out portion 91*d*, and the second lead-out portion 91*e* are integrated.

The first circumferential portion 91*a* is a portion circling so as to surround an inner region thereof. The second circumferential portion 91*b* is also a portion circling so as to surround an inner region thereof. The first circumferential portion 91*a* and the second circumferential portion 91*b* are arranged on the same horizontal plane (X-Y plane).

The first connecting portion 91*c* is a portion that connects a first end 91*f* of the first circumferential portion 91*a* and a first end 91*g* of the second circumferential portion 91*b* mutually, and is a non-circumferential portion.

The first lead-out portion 91*d* is connected to a second end 91*h* of the first circumferential portion 91*a*. The second end 91*h* of the first circumferential portion 91*a* is positioned at the hole 92*b*. The second lead-out portion 91*e* is connected to a second end 91*i* of the second circumferential portion 91*b*. The second end 91*i* of the second circumferential portion 91*b* is positioned at the hole 92*a*.

The second supporting member 94 is a member for supporting the second coil 93. The second supporting member 94 is attached (fixed) to a casing 9 so as to be coaxial with the center shaft 5. The second coil 93 is attached to the second supporting member 94 to be fixed on the second supporting member 94. As illustrated in FIG. 9B, in the second supporting member 94, holes 94*a*, 94*b* intended for attaching the second coil 93 are formed. Further, in the center of the second supporting member 94, there is formed a hole 94*c* intended for arranging the second supporting member 94 coaxially with the center shaft 5. The hole 94*c* is formed so as to have an interval between the second supporting member 94 and the center shaft 5 when the center shaft 5 is passed through the hole 94*c*. In this manner, even when the center shaft 5 rotates, the second supporting member 94 is brought into a state of being fixed to the casing 9 without rotation. The second supporting member 94 can be fabricated by the same one as that of the second supporting member 4 illustrated in FIG. 2B.

The second coil 93 has a third circumferential portion 93*a*, a fourth circumferential portion 93*b*, a second connecting portion 93*c*, a third lead-out portion 93*d*, and a fourth lead-out portion 93*e*. The third circumferential portion 93*a*, the fourth circumferential portion 93*b*, the second connecting portion 93*c*, the third lead-out portion 93*d*, and the fourth lead-out portion 93*e* are integrated.

The third circumferential portion 93*a* is a portion circling so as to surround an inner region thereof. The fourth circumferential portion 93*b* is also a portion circling so as to surround an inner region thereof. The third circumferential portion 93*a* and the fourth circumferential portion 93*b* are arranged on the same horizontal plane (X-Y plane).

The second connecting portion 93*c* is a portion that connects a first end 93*f* of the third circumferential portion 93*a* and a first end 93*g* of the fourth circumferential portion 93*b* mutually, and is a non-circumferential portion.

The third lead-out portion 93*d* is connected to a second end 93*h* of the third circumferential portion 93*a*. The second end 93*h* of the third circumferential portion 93*a* is positioned at the hole 94*a*. The fourth lead-out portion 93*e* is connected to a second end 93*i* of the fourth circumferential portion 93*b*. The second end 93*i* of the fourth circumferential portion 93*b* is positioned at the hole 94*b*.

In the structure illustrated in FIG. 2A and FIG. 2B, at the same time, the current flows counterclockwise in the first circumferential portion 1*a*, the current flows clockwise in the second circumferential portion 1*b*, the current flows clockwise in the third circumferential portion 3*a*, and the current flows counterclockwise in the fourth circumferential portion 3*b* with respect to the sheets of FIG. 2A and FIG. 2B. Thus, the directions of the currents flowing through the two circumferential portions (the first circumferential portion 1*a* and the second circumferential portion 1*b*, the third circumferential portion 3*a* and the fourth circumferential portion. 3*b*) are opposite.

In contrast to this, in the structure illustrated in FIG. 9A and FIG. 9B, at the same time, the current flows clockwise in the first circumferential portion 97*a* and the second circumferential portion 91*b*, and the current flows counterclockwise in the third circumferential portion 93*a* and the fourth circumferential portion 93*b* with respect to the sheets of FIG. 9A and FIG. 9B. Thus, the directions of the currents flowing through the two circumferential portions (the first circumferential portion 91*a* and the second circumferential portion 91*b*, the third circumferential portion 93*a* and the fourth circumferential portion 93*b*) are the same (see the arrow lines illustrated beside the first coil 91 and the second coil 93 in FIG. 9A and FIG. 9B). The variable magnification β of the combined inductance GL when seen from the alternating-current power supply circuit in the case illustrated in FIG. 9A and FIG. 9B differs from that in the case of the structure illustrated in FIG. 2A and FIG. 2B, but the principle that changes the combined inductance CL is the same in all the structures illustrated in FIG. 2A, FIG. 2B and FIG. 9A, FIG. 9B.

Modified Example 2

In this embodiment, the case where the center shaft 5 is rotated to thereby rotate the first coil 1 attached to the center shaft 5 has been explained as an example. However, as long as at least one of the first coil 1 and the second coil 3 is designed to rotate substantially coaxially with the center shaft 5, this embodiment is not necessarily required to be structured in this manner.

In place of the drive unit 6, for example, there may be provided a drive unit that rotates the first supporting member 2 so that the first coil 1 rotates substantially coaxially with the center shaft 5. That is, the drive unit may be attached not to the center shaft 5, but to the first supporting member 2.

Further, the second coil 3 may be rotated in addition to the first coil 1. In this case, a drive unit that rotates the second supporting member 4 coaxially with the center shaft 5 is required. In this case, the total of the absolute value of the rotation angle of the first coil 1 in a first direction (for example, clockwise direction) and the absolute value of the rotation angle of the second coil 3 in a second direction (direction opposite to the first direction, for example, counterclockwise direction) preferably ranges from 0° to 180° (namely, the maximum value of the total is preferably set to) 180°. In this way, the first coil 1 and the second coil 3 are both rotated, thereby making it possible to continuously obtain the first state illustrated on the bottom of FIG. 4, the second state illustrated on the top of FIG. 4, and the state between these states.

Modified Example 3

In this embodiment, the case where the first coil 1 and the second coil 3 are connected in series has been explained as an example. However, the first coil 1 and the second coil 3 may be connected in parallel. For example, out of the both end portions of the first coil 1, one end portion led out through the hole 2*a* of the first supporting member 2 (the second end 1*i* of the second circumferential portion 1*b*) and out of the both end portions of the second coil 3, one end portion led out through the hole 4*a* of the second supporting member 4 (the second end 3*h* of the third circumferential portion 3*a*) can be electrically connected to each other, and at the same time, out of the both end portions of the first coil 1, the other end portion led out through the hole 2*b* of the first supporting member 2 (the second end 1*h* of the first circumferential portion 1*a*) and out of the both end portions of the second coil 3, the other end portion led out through the hole 4*b* of the second supporting member 4 (the second end 3*i* of the fourth circumferential portion 3*b*) can be electrically connected to each other. In this case, the alternating-current power is designed to be supplied to these connected portions from the not-illustrated alternating-current power supply circuit. For example, out of the both end portions of the first coil 1, one end portion led out through the hole 2*a* of the first supporting member 2 and out of the both end portions of the second coil 3, one end portion led out through the hole 4*a* of the second supporting member 4 can be connected to the power feeding terminal 7*a*, out of the both end portions of the first coil 1, the other end portion led out through the hole 2*b* of the first supporting member 2 and out of the both end portions of the second coil 3, the other end portion led out through the hole 4*b* of the second supporting member 4 can be connected to the power feeding terminal 7*b*, and the not-illustrated alternating-current power supply circuit can be connected to the power feeding terminals 7*a*, 7*b*.

In the case where the first coil 1 and the second coil 3 are connected in parallel, the variable magnification β of the combined inductance GL when seen from the alternating-current power supply circuit is the same as that in the case where these are connected in series (β=(1+k)÷(1−k)). On the other hand, a variable range of the combined inductance GL becomes (2L−2kL)÷4 to (2L+2kL)÷4=(L−kL)÷2 to (L+kL)÷2. That is, when the first coil 1 and the second coil 3 are changed to a parallel circuit from a series circuit, the combined inductance GL becomes ¼ magnifications. However, here, the self-inductances L1, L2 of the first coil 1 and the second coil 3 are set to L in order to simplify the explanation.

Modified Example 4

In this embodiment, the case where the first coil 1 and the second coil 3 are arranged so as to make their coil surfaces substantially parallel to each other in a state of having the constant intervals G therebetween has been explained as an example. However, this embodiment is not necessarily required to be structured in this manner, and the interval G may be varied by moving at least one of the first coil 1 and the second coil 3 in the Z-axis direction.

Figure 10:
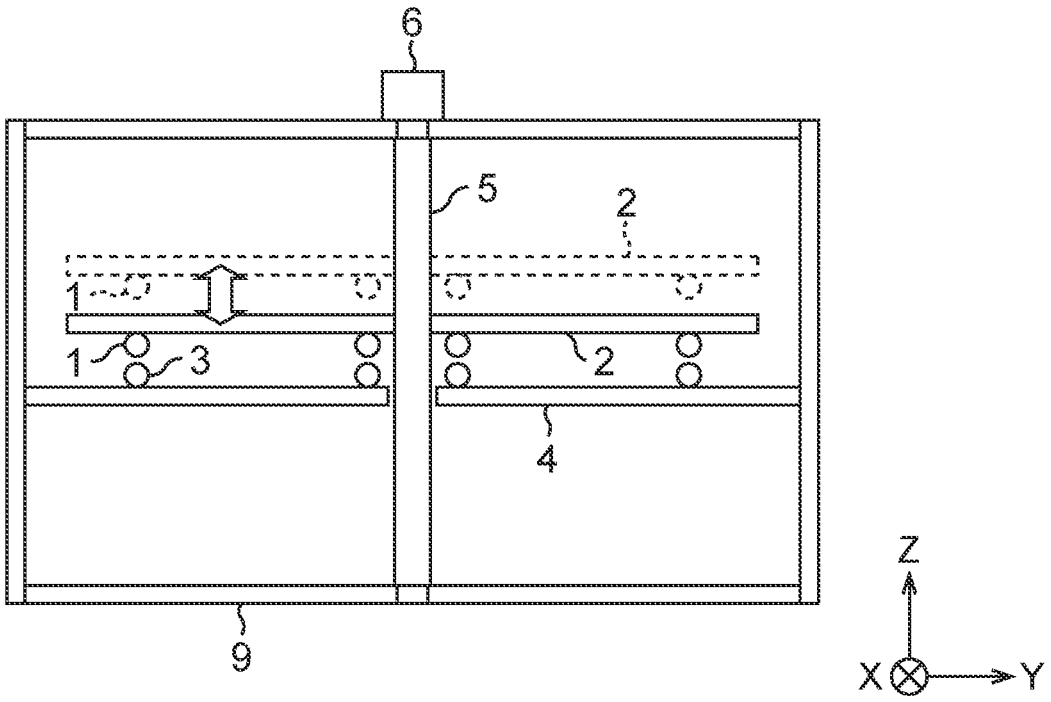
FIG. 10 is a view illustrating a modified example of the structure of the inductance adjusting device.

FIG. 10 is a view illustrating a structure of a modified example of the inductance adjusting device.

As illustrated in FIG. 10, the first supporting member 2 is attached to the center shaft 5 so as to be able to change the position of the center shaft 5 in the Z-axis direction (see the white arrow lines and the first coil 1 and the first supporting member 2 illustrated by a dotted line in FIG. 10). The first supporting member 2 is attached to the center shaft 5 so that a user can manually adjust the position of the first supporting member 2 in the Z-axis direction, for example. One example of such a case will be explained. There is prepared a fixture (jig) that makes the first supporting member 2 movable on the center shaft 5 and fixes the first supporting member 2. The user uses the fixture to fix the first supporting member 2 to an arbitrary position on the center shaft 5. Further, respective units may be configured so that the drive unit 6 can move the first supporting member 2 in the Z-axis direction as well as rotate the center shaft 5. In this case, the drive unit 6 can move the first supporting member 2 in the Z-axis direction when the electric circuit to which the inductance adjusting device is applied is in operation.

Modified Example 5

In this embodiment, the case where the first coil 1 and the second coil 3 are formed by using the water-cooled cables has been explained as an example. However, this embodiment is not necessarily required to be structured in this manner. For example, copper pipes or the like may be used to form each of the first coil 1 and the second coil 3 in a pipe shape. In this case, a cooling water is allowed to flow through hollow portions of the first coil 1 and the second coil 3. Further, the lead-out portions (the first lead-out portion 1*d*, the second lead-out portion 1*e*, the third lead-out portion 3*d*, and the fourth lead-out portion 3*e*) of the first coil 1 and the second coil 3 each are preferably formed of a flexible electric conductor. In this case, the electric conductors are electrically connected to the second ends 1*h*, 1*i*, 3*h*, and 3*i* of the first coil 1 and the second coil 3.

Further, when the large current is not applied to the electric circuit to which the inductance adjusting device is applied, for example, it is not necessary to water-cool the first coil 1 and the second coil 3.

Modified Example 6

In this embodiment, the case where the first coil 1 is rotated within the range of 0° to 180° has been explained as an example. However, the range of the rotation angle of the first coil 1 is not limited to 0° to 180° For example, the total of the absolute value of the rotation angle of the first coil 1 in the first direction (for example, clockwise direction) and the absolute value of the rotation angle of the second coil 3 in the second direction (for example, counterclockwise direction) may range from 0° to 360°. In this case, it is possible to set the range of the rotation angle of the first coil 1 to 0° to 360° without rotating the second coil 3, for example. Incidentally, as has been explained in the modified example 2, both the first coil 1 and the second coil 3 may be rotated. Further, the first coil 1 and the second coil 3 may be designed so as not to be brought into both or one of the first state illustrated on the bottom of FIG. 4 and the second state illustrated on the top of FIG. 4.

Modified Example 7

When the first coil 1 is designed to rotate so as to include the first state illustrated on the bottom of FIG. 4 and the second state illustrated on the top of FIG. 4 like this embodiment, it is preferable because it is possible to increase the variable magnification β of the combined inductance GL when seen from the alternating-current power supply circuit. However, at least one of these two states does not need to be included.

Modified Example 8

Two or more (some or all) of the above modified examples 1 to 8 may be combined.

SECOND EMBODIMENT

Next, there will be explained a second embodiment. In the first embodiment, the case where the number of turns of each of the first coil 1 and the second coil 3 is one has been explained as an example. In contrast to this, in this embodiment, the case where the number of turns of each of a first coil and a second coil is plural turns will be explained. As above, this embodiment and the first embodiment differ in the number of turns of the first coil and the second coil mainly. Thus, in the explanation of this embodiment, the same reference numerals and symbols as those added to FIG. 1A to FIG. 10 are added to the same parts as those in the first embodiment, or the like, and their detailed explanations are omitted.

First Example

Figure 11:
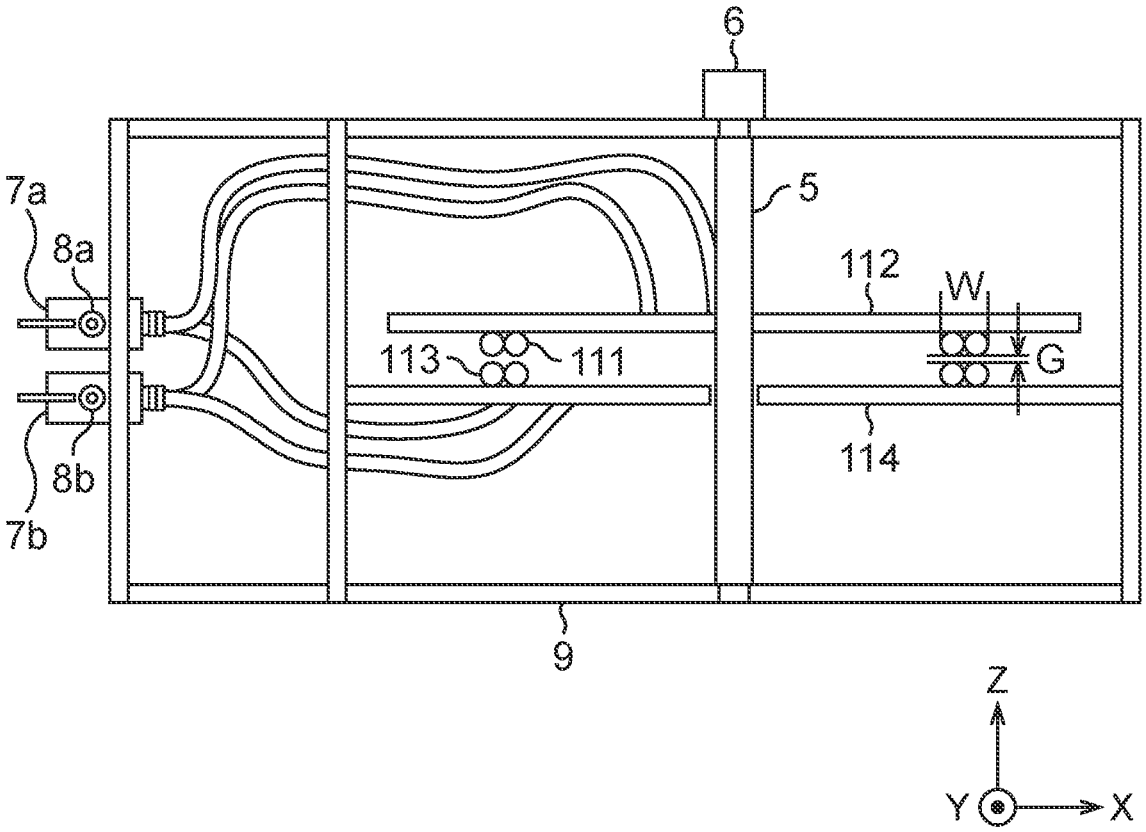
FIG. 11 is a view illustrating a second example of the structure of the inductance adjusting device.
Figure 12A:
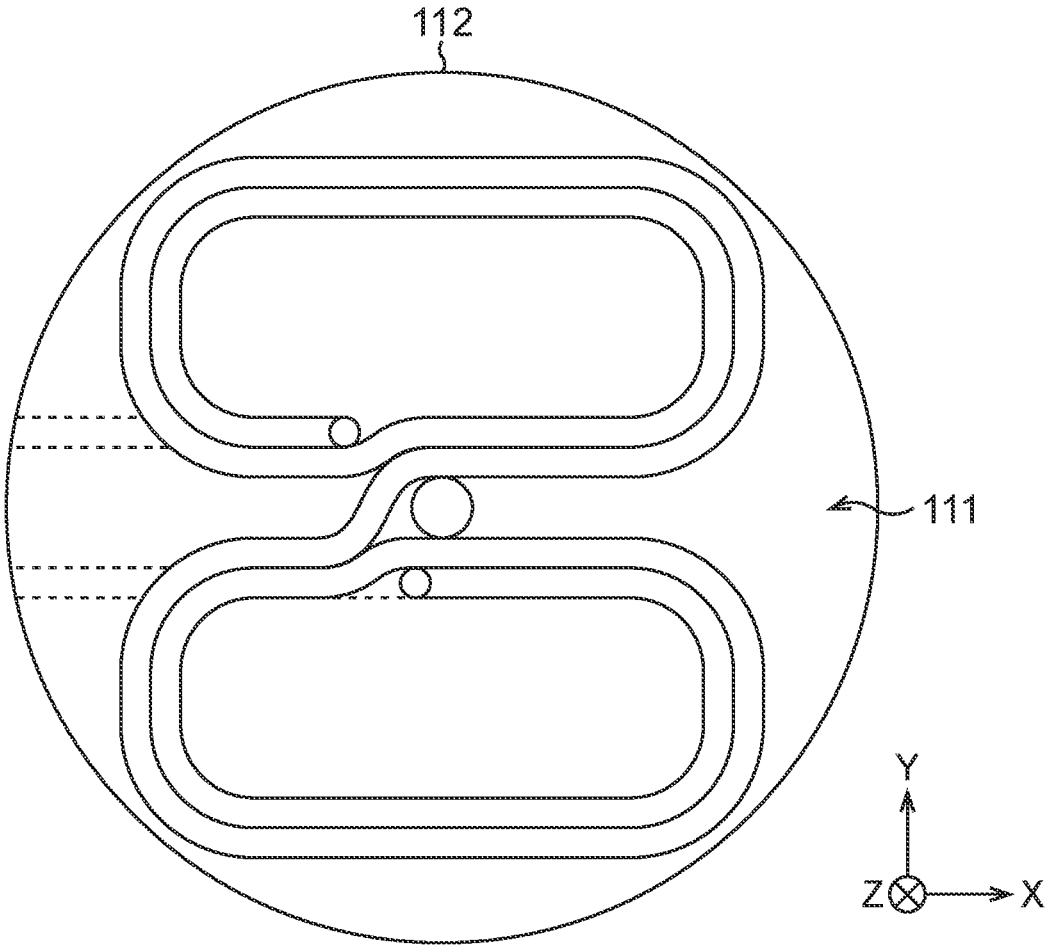
FIG. 12A is a view illustrating a second example of the first coil and the first supporting member.
Figure 12B:
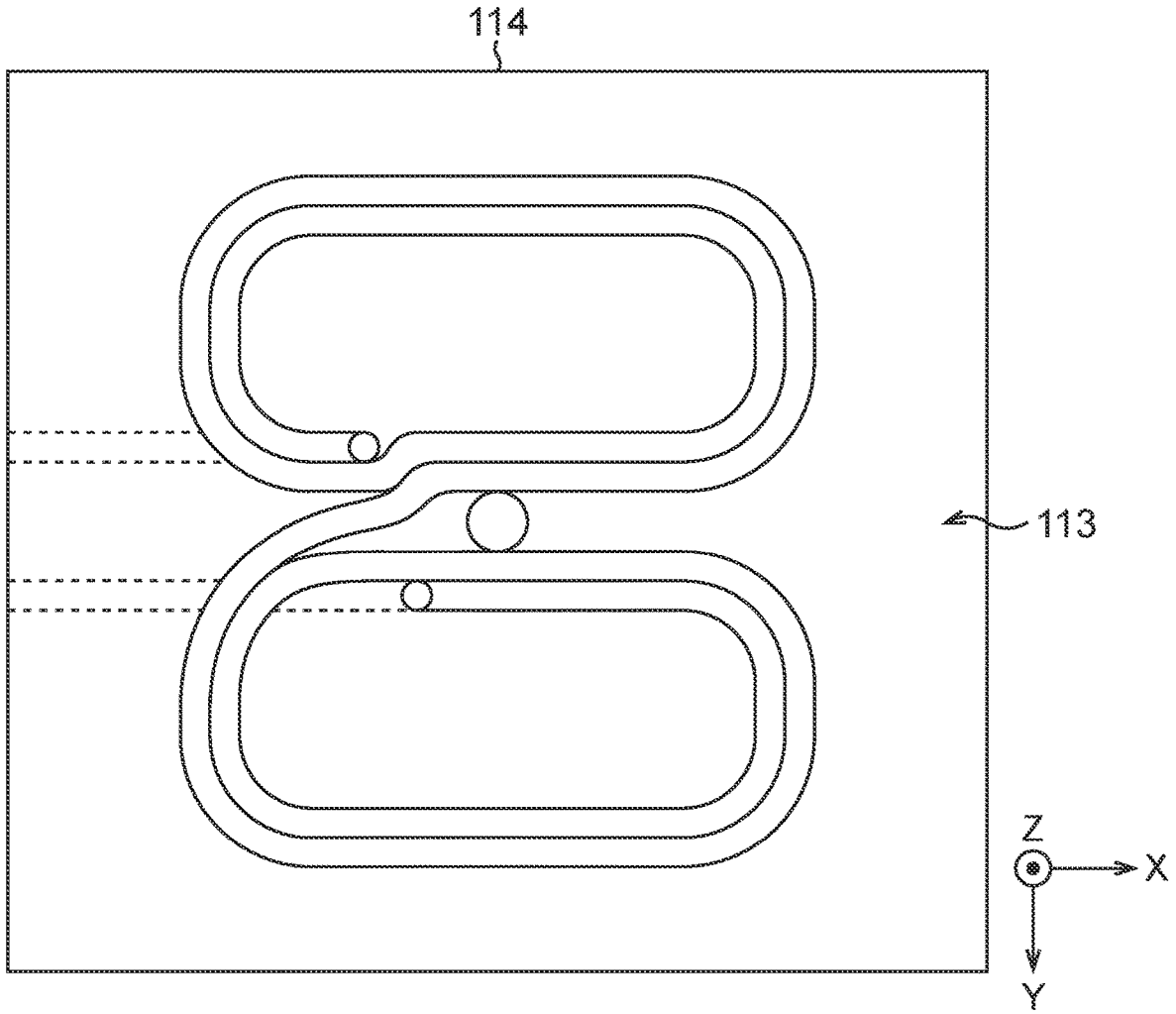
FIG. 12B is a view illustrating a second example of the second coil and the second supporting member.

FIG. 11 is a view illustrating a first example of a structure of an inductance adjusting device in this embodiment. FIG. 11 is a view corresponding to FIG. 1A. FIG. 12A is a view illustrating one example of a first coil 111 and a first supporting member 112. FIG. 12B is a view illustrating one example of a second coil 113 and a second supporting member 114. FIG. 12A is a view corresponding to FIG. 2A, and FIG. 12B is a view corresponding to FIG. 2R.

In this example, as illustrated in FIG. 11, FIG. 12A, and FIG. 12B, the number of turns of each of the first coil 111 and the second coil 113 is set to two turns, and the first coil 111 and the second coil 113 are set the same in the number of turns. Further, as illustrated in FIG. 11, FIG. 12A, and FIG. 12B, the shape of the first coil 111 and the second coil 113 is set to a flat spiral shape. Here, the flat spiral means that a water-cooled cable is wound around in a direction vertical to a shaft (center shaft 5) of the first coil 111 and the second coil 113 as illustrated in FIG. 11, FIG. 12A, and FIG. 12B. In other words, the water-cooled cables forming the first coil 111 and the second coil 113 are wound around so as to be arranged in a direction vertical to the shaft (center shaft 5) of the first coil 111 and the second coil 113.

The first coil 111 and the second coil 113 are each formed in a flat spiral shape, thereby making it possible to widen a coil width W illustrated in FIG. 11 when the first coil 111 and the second coil 113 are arranged so as to make their coil surfaces substantially parallel to each other with the intervals G provided therebetween. The coil width W means the length of a group of the water-cooled cables adjacent to each other in a direction vertical to the center shaft 5. As long as the intervals G are the same, as the coil width W is wider, magnetic fluxes do not easily pass through between the intervals G and magnetic reluctance becomes larger. Thus, it is possible to increase the coupling coefficient k. Therefore, it is possible to increase the variable magnification β of the combined inductance GL when seen from the alternating-current power supply circuit (see (4) Equation). In other words, in the case of the flat spiral shape, as the number of turns is larger, the variable magnification β of the combined inductance GL when seen from the alternating-current power supply circuit can be made larger.

Second Example

Figure 13:
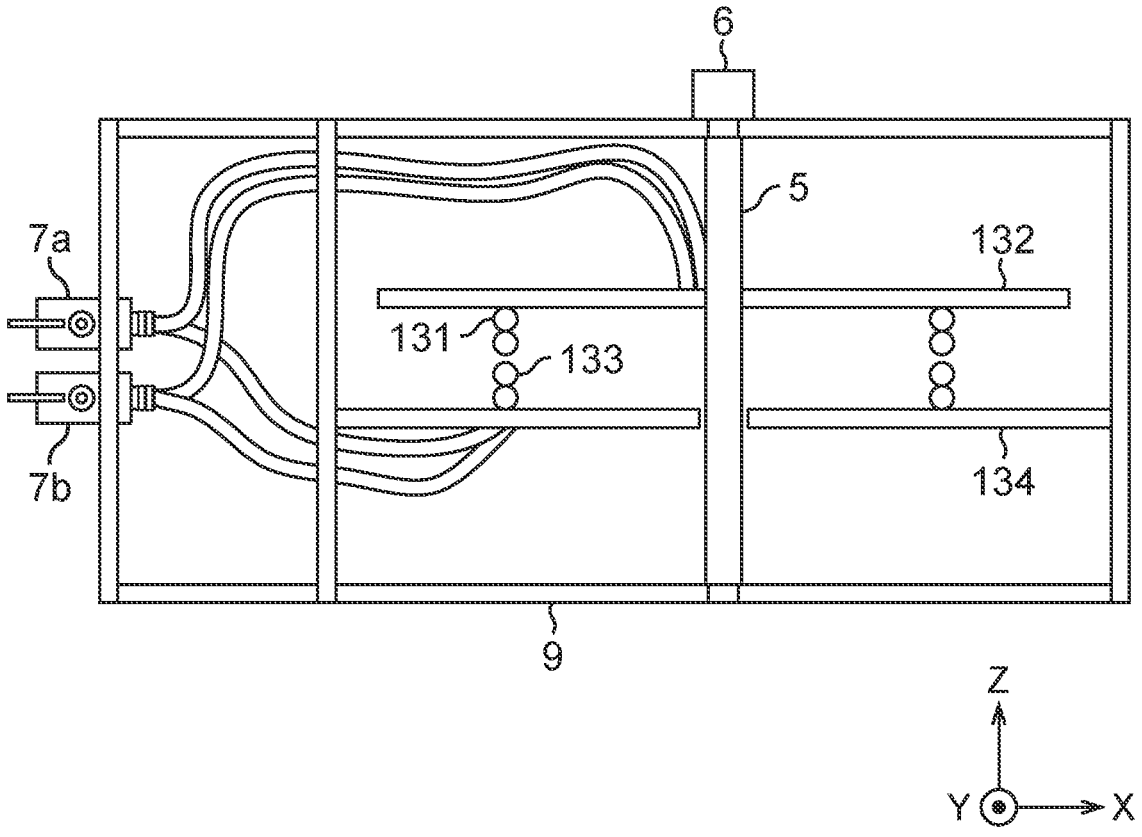
FIG. 13 is a view illustrating a third example of the structure of the inductance adjusting device.
Figure 14A:
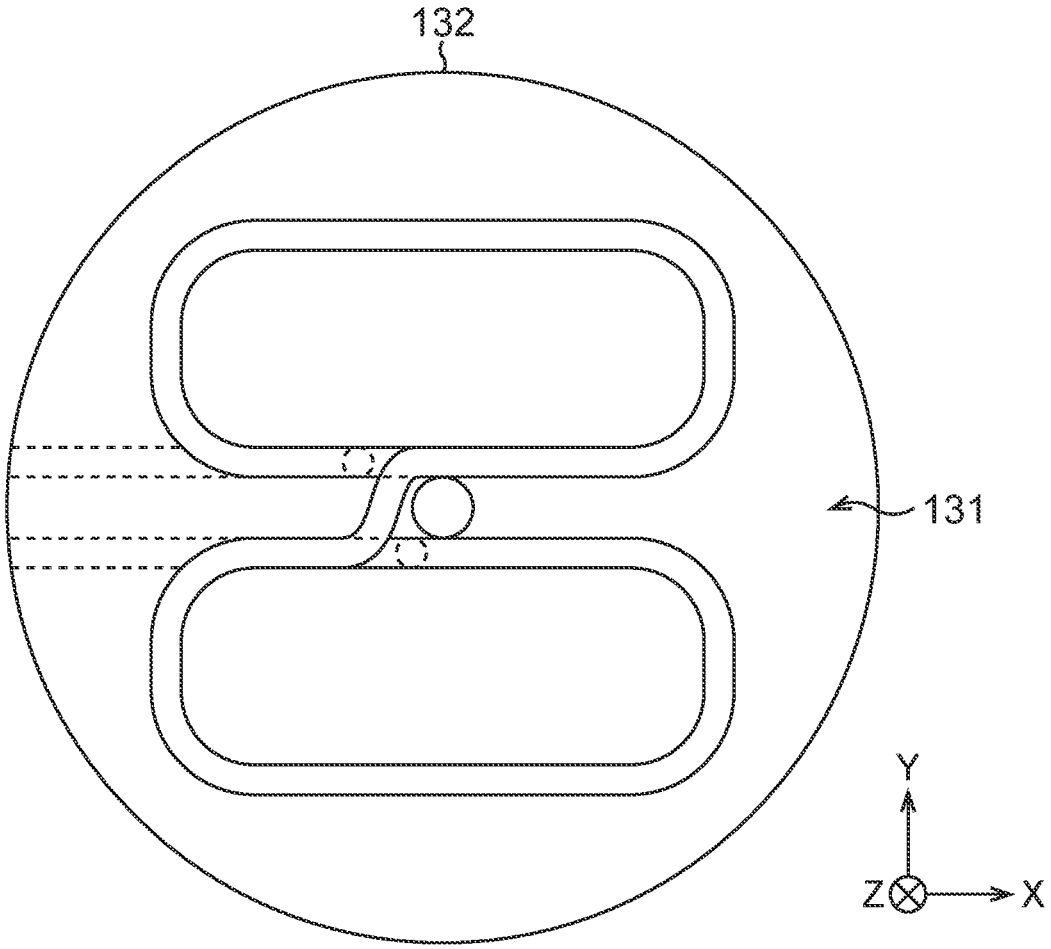
FIG. 14A is a view illustrating a third example of the first coil and the first supporting member.
Figure 14B:
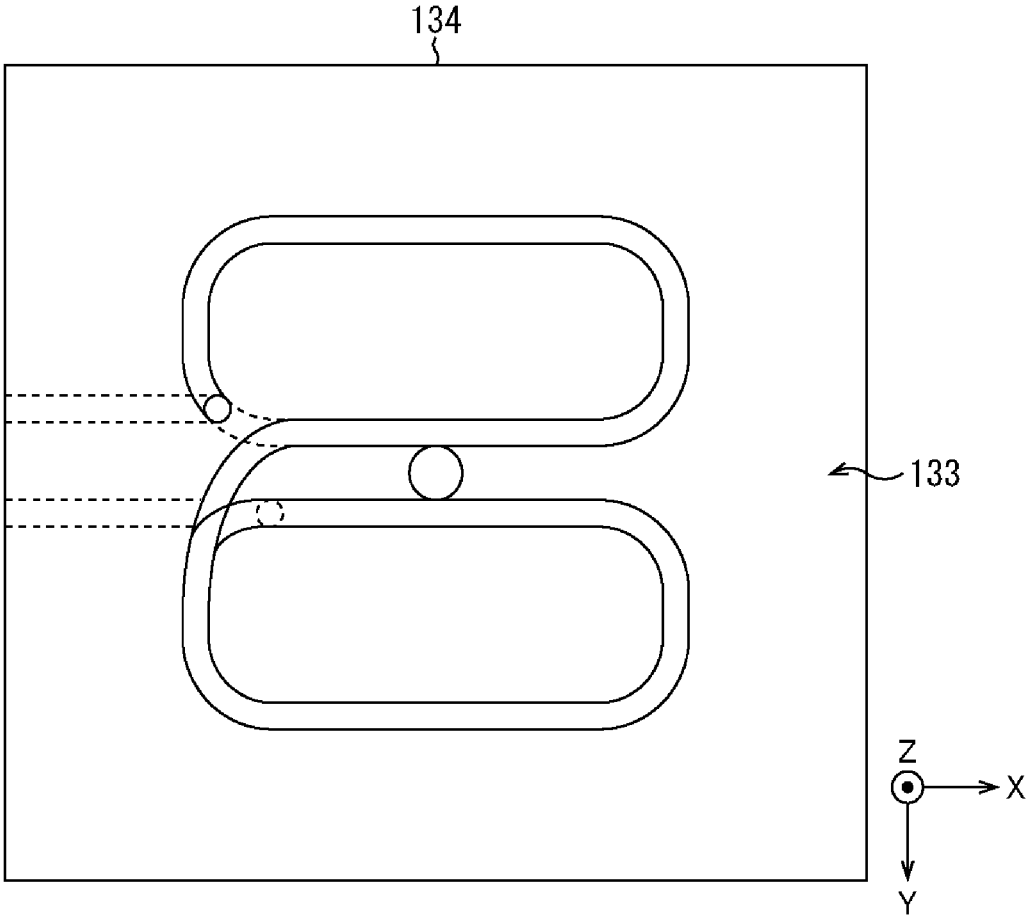
FIG. 14B is a view illustrating a third example of the second coil and the second supporting member.

FIG. 13 is a view illustrating a second example of the structure of the inductance adjusting device in this embodiment. FIG. 13 is a view corresponding to FIG. 1A. FIG. 14A is a view illustrating one example of a first coil 131 and a first supporting member 132. FIG. 14B is a view illustrating one example of a second coil 133 and a second supporting member 134. FIG. 14A is a view corresponding to FIG. 2A, and FIG. 14B is a view corresponding to FIG. 2B.

In this example, as illustrated in FIG. 13, FIG. 14A, and FIG. 14B, the number of turns of each of the first coil 131 and the second coil 133 is set to two turns, and the first coil 131 and the second coil 133 are set the same in the number of turns. Further, as illustrated in FIG. 13, FIG. 14A, and FIG. 14B, the shape of the first coil 131 and the second coil 133 is set to a longitudinally wound shape. Here, the longitudinally winding means that a water-cooled cable is wound around in a direction along a shaft (center shaft 5) of the first coil 131 and the second coil 133 as illustrated in FIG. 13, FIG. 14A, and FIG. 14B. In other words, the water-cooled cables forming the first coil 131 and the second coil 133 are wound around so as to be arranged in a direction along the shaft (center shaft 5) of the first coil 131 and the second coil 133.

In the case of the longitudinally wound shape as above, the coil width W is the same as that in the case where the number of turns is one turn. Thus, the variable magnification β of the combined inductance GL when seen from the alternating-current power supply circuit is the same as that in the case where the number of turns is one turn, and is smaller than that in the case of the flat spiral shape. However, the combined inductance GL is proportional to the square of the number of turns. Thus, regardless of the flat spiral shape mode or the longitudinally wound shape mode, it is possible to increase the combined inductance GL as compared to the case where the number of turns of the coil is one turn. Further, increasing the area of the coil makes it possible to increase the combined inductance GL.

<Modified examples>

In this embodiment, the case where the number of turns is two turns has been explained as an example. However, the number of turns is not limited to two turns, and may be three turns or more. The number of turns only needs to be determined according to the size of the inductance adjusting device, the variable magnification (3, the magnitude of the combined inductance GL, the cost of the inductance adjusting device, or the like. Further, in this embodiment, the case where the number of turns of the first coil 111 and the number of turns of the first coil 131 are the same has been explained as an example. However, they may be different in the number of turns of these.

Further, in this embodiment as well, the various modified examples explained in the first embodiment can be employed.

THIRD EMBODIMENT

Next, there will be explained a third embodiment. In this embodiment, a plurality of groups of a first coil and a second coil are provided. As above, this embodiment and the first and second embodiments mainly differ in structure because the number of groups of the first coil and the second coil differs. Thus, in the explanation of this embodiment, the same reference numerals and symbols as those added to FIG. 1A to FIG. 14B are added to the same parts as those in the first and second embodiments, or the like, and their detailed explanations are omitted.

Figure 15A:
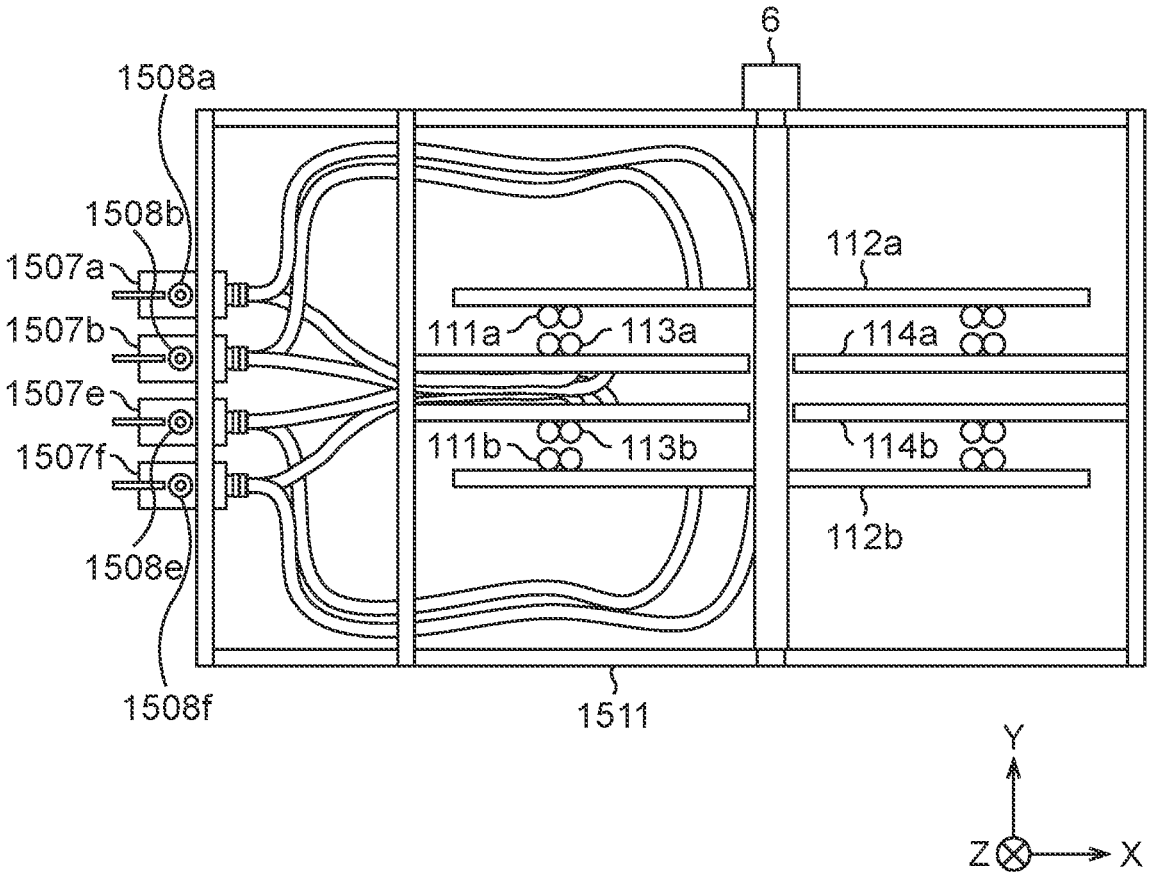
FIG. 15A is a view illustrating a fourth example of the structure of the inductance adjusting device.
Figure 15B:
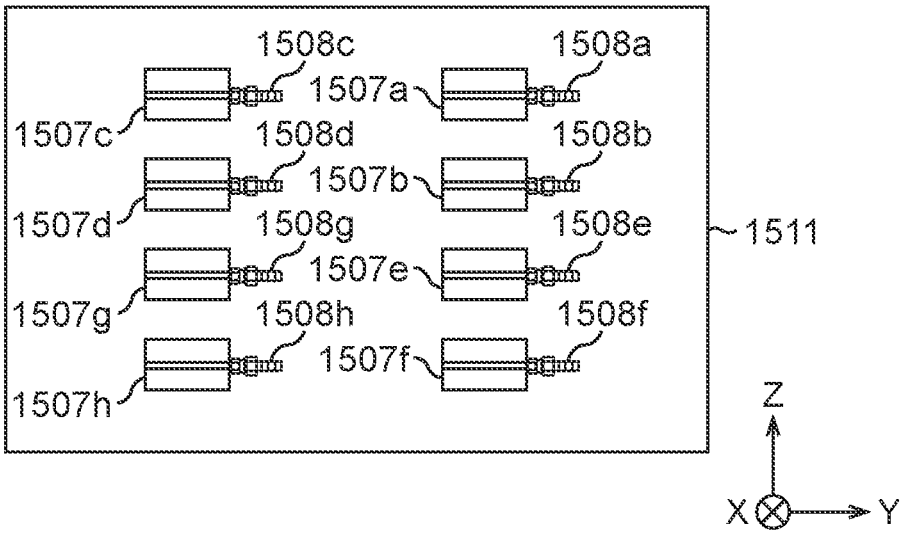
FIG. 15B is a view illustrating one example of an appearance of a surface where power feeding terminals of the inductance adjusting device in FIG. 15A are arranged.

FIG. 15A and FIG. 15*k* are views illustrating one example of a structure of an inductance adjusting device in this embodiment. FIG. 15A is a view corresponding to FIG. 11, and FIG. 15B is a view corresponding to FIG. 1B. In FIG. 15A, the case where two of the group of the first coil 111, the first supporting member 112, the second coil 113, and the second supporting member 114, which are illustrated in FIG. 11, are provided will be explained as an example. That, is, the inductance adjusting device in this embodiment includes: a group of a first coil 111*a*, a first supporting member 112*a*, a second coil 113*a*, and a second supporting member 114*a*; and a group of a first coil 111*b*, a first supporting member 112*b*, a second coil 113*b*, and a second supporting member 114*b*.

FIG. 16A to FIG. 16D are views each illustrating one example of a connecting method of the first coil 111*a*, the second coil 113*a*, the first coil 111*b*, and the second coil 113*b*. FIG. 16A to FIG. 16D are views corresponding to FIG. 5A to FIG. 5B.

Figure 16A:
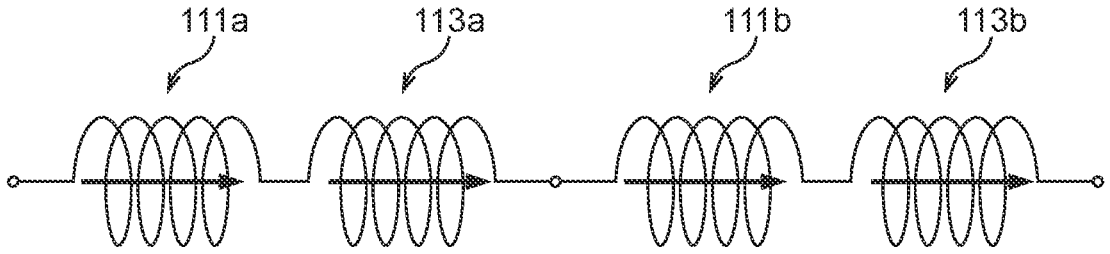
FIG. 16A is a view illustrating a first example of a connecting method of the first coil, the second coil, the first coil, and the second coil.
Figure 16B:
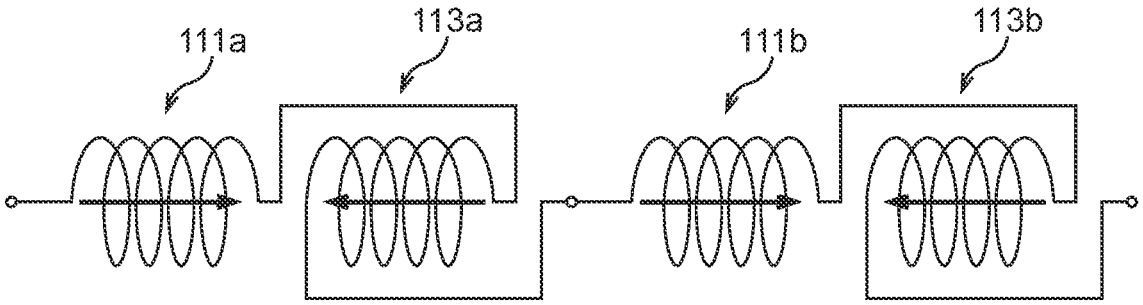
FIG. 16B is a view illustrating a second example of the connecting method of the first coil, the second coil, the first coil, and the second coil.
Figure 16C:
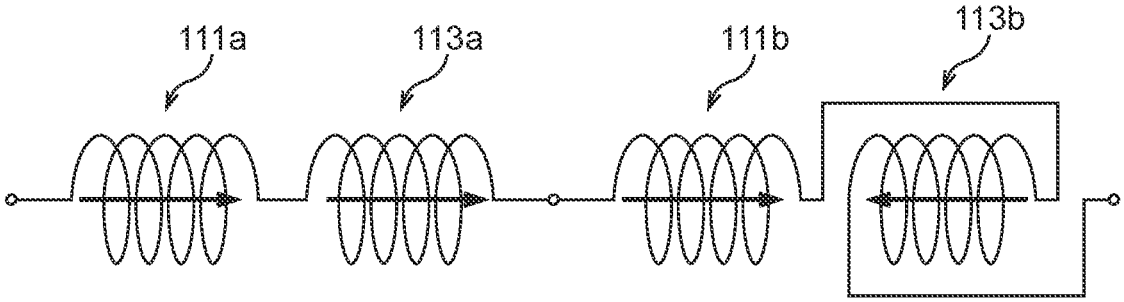
FIG. 16C is a view illustrating a third example of the connecting method of the first coil, the second coil, the first coil, and the second coil.

FIG. 16A, FIG. 16B, and FIG. 16C each illustrate an example where the first coil 111*a*, the second coil 113*a*, the first coil 111*b*, and the second coil 113*b* are connected in series.

FIG. 16A illustrates connection such that magnetic fluxes generated from the first coil 111*a* and the second coil 113*a* and magnetic fluxes generated from the first coil 111*b* and the second coil 113*b* are intensified mutually. FIG. 16B illustrates connection such that magnetic fluxes generated from the first coil 111*a* and the second coil 113*a* and magnetic fluxes generated from the first coil 111*b* and the second coil 113*b* are weakened mutually. FIG. 16C illustrates connection such that magnetic fluxes generated from the first coil 111*a* and the second coil 113*a* are intensified mutually and magnetic fluxes generated from the first coil 111*b* and the second coil 113*b* are weakened mutually.

Figure 16D:
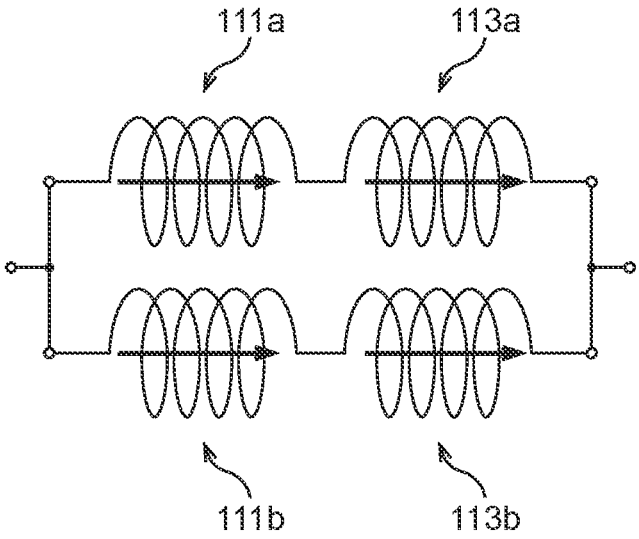
FIG. 16D is a view illustrating a fourth example of the connecting method of the first coil, the second coil, the first coil, and the second coil.

FIG. 16D illustrates an example where the first coil 111*a* and the second coil 113*a* are connected in series, the first coil 111*b* and the second coil 113*b* are connected in series, and the series-connected first coil 111*a* and second coil 113*a* and the series-connected first coil 111*b* and second coil 113*b* are connected in parallel.

Incidentally, both ends of each circuit illustrated in FIG. 16A to FIG. 16D are connected to the alternating-current power supply circuit.

Further, the connecting method of the first coil 111*a*, the second coil 113*a*, the first coil 111*b*, and the second coil 113*b* is not limited to the ones illustrated in FIG. 16A to FIG. 16D as long as the group of the first coils and the second coils that are connected in series or parallel is connected to another group in series or parallel. For example, the first coil 111*a*, the second coil 113*a*, the first coil 111*b*, and the second coil 113*b* may be connected in parallel.

As illustrated in FIG. 15B, the inductance adjusting device in this embodiment includes: power feeding terminals 1507*a* to 1507*h*; and water feeding terminals 1508*a* to 1508*h*. According to the connecting method of the first coil 711*a*, the second coil 113*a*, the first coil 111*b*, and the second coil 113*b*, end portions of the first coil 111*a*, the second coil 113*a*, the first coil 111*b*, and the second coil 113*b* are electrically connected to some of the power feeding terminals 1507*a* to 1507*h*.

This embodiment is structured as above, thereby making it possible to increase the variable magnification β of the combined inductance GL when seen from the alternating-current power supply circuit.

Modified Examples

In this embodiment, the case where two of the group of the first coil 111 and the second coil 113 in the first example (the structure illustrated in FIG. 11) of the second embodiment are provided has been explained as an example. However, in the first embodiment (the structure illustrated in FIG. 1A to FIG. 2B) and the second example of the second embodiment (the structure illustrated in FIG. 13 to FIG. 14B), two of the group of the first coils 1, 131 and the second coils 3, 133 may be provided.

Further, the number of groups of the first coil and the second coil is not limited to two groups, and may be three groups or more. In the case where the number of groups of the first coil and the second coil is set to N groups, it is possible to switch the variable magnification β of the combined inductance GL when seen from the alternating-current power supply circuit in a range of $(L-kL)\div 2N$ to $(L+kL)\times 2N$. Incidentally, in order to simplify the explanation here, the self-inductances L1, L2 of the first coil and the second coil are set to L. The number of groups of the first coil and the second coil is increased, thereby making it possible to fabricate a more general-purpose inductance adjusting device. This leads to a reduction in cost of the inductance adjusting device.

Further, this embodiment can be applied to both the first embodiment and the second embodiment. Furthermore, in this embodiment as well, the various modified examples explained in the first and second embodiments can be employed.

FOURTH EMBODIMENT

Next, there will be explained a fourth embodiment. In the first to third embodiments, the case where the first coil and the second coil are arranged in a direction vertical to their shaft (the center shaft 5) one by one has been explained as an example. In contrast to this, in this embodiment, the case where a plurality of the first coils and a plurality of the second coils are arranged in a direction vertical to their shaft (the center shaft 5) will be explained. As above, this embodiment and the first to third embodiments mainly differ in structure because the number of first coils and second coils to be arranged in a direction vertical to the center shaft 5 differs. Thus, in the explanation in this embodiment, the same reference numerals and symbols as those added to FIG. 1A to FIG. 16D are added to the same parts as those in the first to third embodiments, or the like, and their detailed explanations are omitted.

Figure 17A:
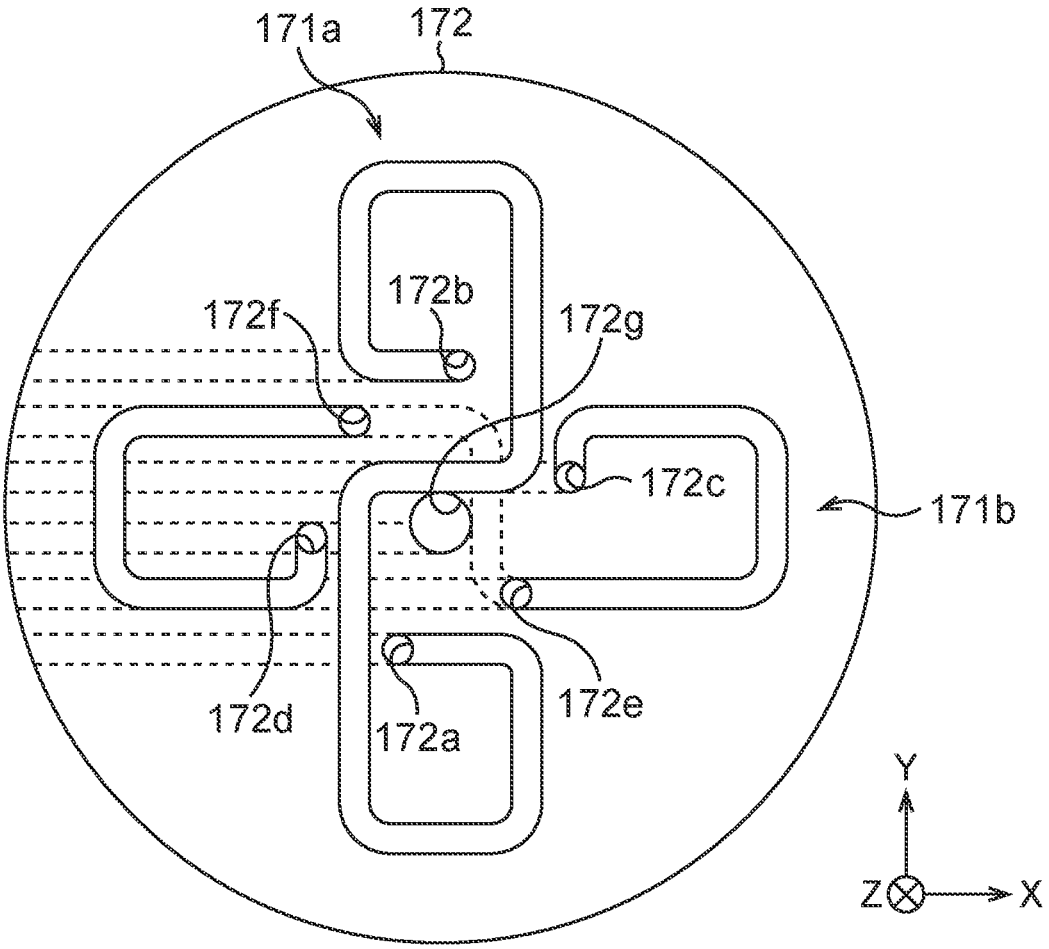
FIG. 17A is a view illustrating a fifth example of the first coil and the first supporting member.
Figure 17B:
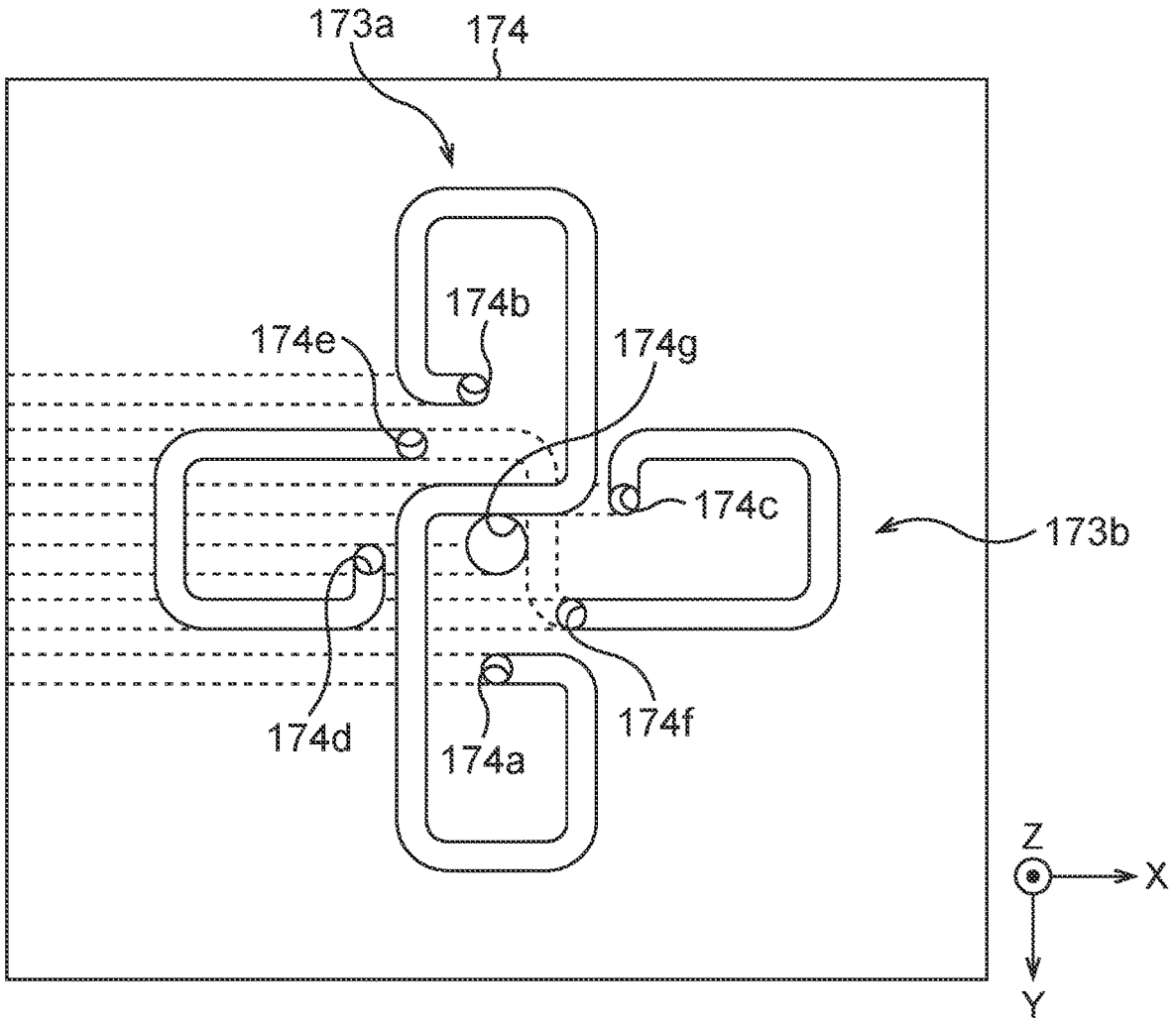
FIG. 17B is a view illustrating a fifth example of the second coil and the second supporting member.

FIG. 17A is a view illustrating one example of a structure of first coils 171*a* and 171*b* and a first supporting member 172. FIG. 17B is a view illustrating one example of a structure of second coils 173*a* and 173*b* and a second supporting member 174. FIG. 17A is a view corresponding to FIG. 2A, and FIG. 17B is a view corresponding to FIG. 2B.

The first coils 171*a* and 171*b* are arranged so as to make their rotation axes coaxial with the center shaft 5. Further, the first coils 171*a* and 171*b* are arranged on the same horizontal plane (X-Y plane). Further, the first coils 171*a* and 171*b* are arranged so as to maintain a state of being displaced by 90° in terms of angle in their rotation direction.

Similarly, the second coils 173*a* and 173*b* are arranged so as to make their rotation axes coaxial with the center shaft 5. Further, the second coils 173*a* and 173*b* are arranged on the same horizontal plane (X-Y plane). Further, the second coils 173*a* and 173*b* are arranged so as to maintain a state of being displaced by 90° in terms of angle in their rotation direction.

Further, as has been explained in the first to third embodiments, the first coils 171*a* and 171*b* and the second coils 173*a* and 173*b* are arranged so as to make coil surfaces of the first coils 171*a* and 171*b* and coil surfaces of the second coils 173*a* and 173*b* parallel in a state of having the intervals G therebetween. The interval G may be constant or variable.

As illustrated in FIG. 17A, in the first supporting member 172, holes 172*a*, 172*b* intended for attaching the first coil 171*a* are formed. Further, in the first supporting member 172, holes 172*c* to 172*f* intended for attaching the first coil 171*b* are formed. The holes 172*e*, 172*f* are to arrange a portion of the first coil 171*b* overlapping with the first coil 171*a* on a surface opposite to the surface illustrated in FIG. 17A so as to prevent the first coils 171*a* and 171*b* from interfering with each other on the surface illustrated in FIG. 17A. Further, in the center of the first supporting member 172, a hole 172*g* intended for attaching the first supporting member 172 to the center shaft 5 is formed.

As illustrated in FIG. 17B, in the second supporting member 174, holes 174*a*, 174*b* intended for attaching the second coil 173*a* are formed. Further, in the second supporting member 174, holes 174*c* to 174*f* intended for attaching the second coil 173*b* are formed. The holes 174*e*, 174*f* are to arrange a portion of the second coil 173*h* overlapping with the second coil 173*a* on a surface opposite to the surface illustrated in FIG. 17B so as to prevent the second coils 173*a* and 173*b* from interfering with each other on the surface illustrated in FIG. 17B. Further, in the center of the second supporting member 174, a hole 174*g* intended for arranging the second supporting member 174 substantially coaxially with the center shaft 5 is formed. The hole 174*g* is formed so as to have an interval between the second supporting member 174 and the center shaft 5 when the center shaft 5 is passed through the hole 174*g*.

In the first to third embodiments, the rotation angle of the first coils 1, 81, 91, 111, and 131 is set to range from 0° to 180°. In contrast to this, this embodiment is structured as above, and thereby it is possible to make the variable magnification β of the combined inductance GL when seen from the alternating-current power supply circuit the same as the value of the inductance adjusting devices in the first to third embodiments even when the rotation angle of the first coils 171*a*, 171*b* is set to range from 0° to 90°.

The range of the rotation angle of the first coils 171*a*, 171*b* is reduced as above, to thereby suppress great deformation of water-cooled cables forming the first coils 171*a*, 171*b*. Thus, more room for flexibility of the first coils 171*a*, 171*b* is made, thereby making it possible to improve control accuracy for rotating the first coils 171*a*, 171*b*.

However, similarly to the case explained in the modified example 6 of the first embodiment, the range of the rotation angle of the first coils 171*a*, 171*b* is not limited to 0° to 90°. For example, the rotation angle of the first coils 171*a*, 171*b* may range from 0° to 180°.

Modified Examples

In this embodiment, the case where the number of first coils and second coils to be arranged in a direction vertical to the center shaft 5 is two each, which are the first coils 171*a*, 171*b* and the second coils 173*a*, 173*b*, has been explained as an example. However, the number of first coils and second coils to be arranged in a direction vertical to the center shaft 5 may be three or more each. The number of first coils and second coils to be arranged in a direction vertical to the center shaft 5 is set to N (N is an integer of 2 or more) and the first coils are arranged so as to maintain a state of being displaced by 90/(N/2)° in terms of angle in their rotation direction, thereby making it possible to set the range of the rotation angle of the first coil to 0° to 180/N°.

Further, this embodiment can be applied to any of the first to third embodiments. Furthermore, in this embodiment as well, the various modified examples explained in the first to third embodiments can be employed.

FIFTH EMBODIMENT

Next, there will be explained a fifth embodiment. In the first to fourth embodiments, the case where the first coils 1, 81, 91, 111, 131, 171*a*, and 171*b* and the second coils 3, 83, 93, 113, 133, 173*a*, and 173*b* are connected in series or parallel and their connections are not changed has been explained as an example. In contrast to this, in this embodiment, the connection between the first coil and the second coil is changed automatically. As above, this embodiment and the first to fourth embodiments mainly differ in whether or not switching of the connection between the first coil and the second coil is performed. Thus, in the explanation of this embodiment, the same reference numerals and symbols as those added to FIG. 1A to FIG. 17B are added to the same parts as those in the first to fourth embodiments, or the like, and their detailed explanations are omitted.

Figure 18:
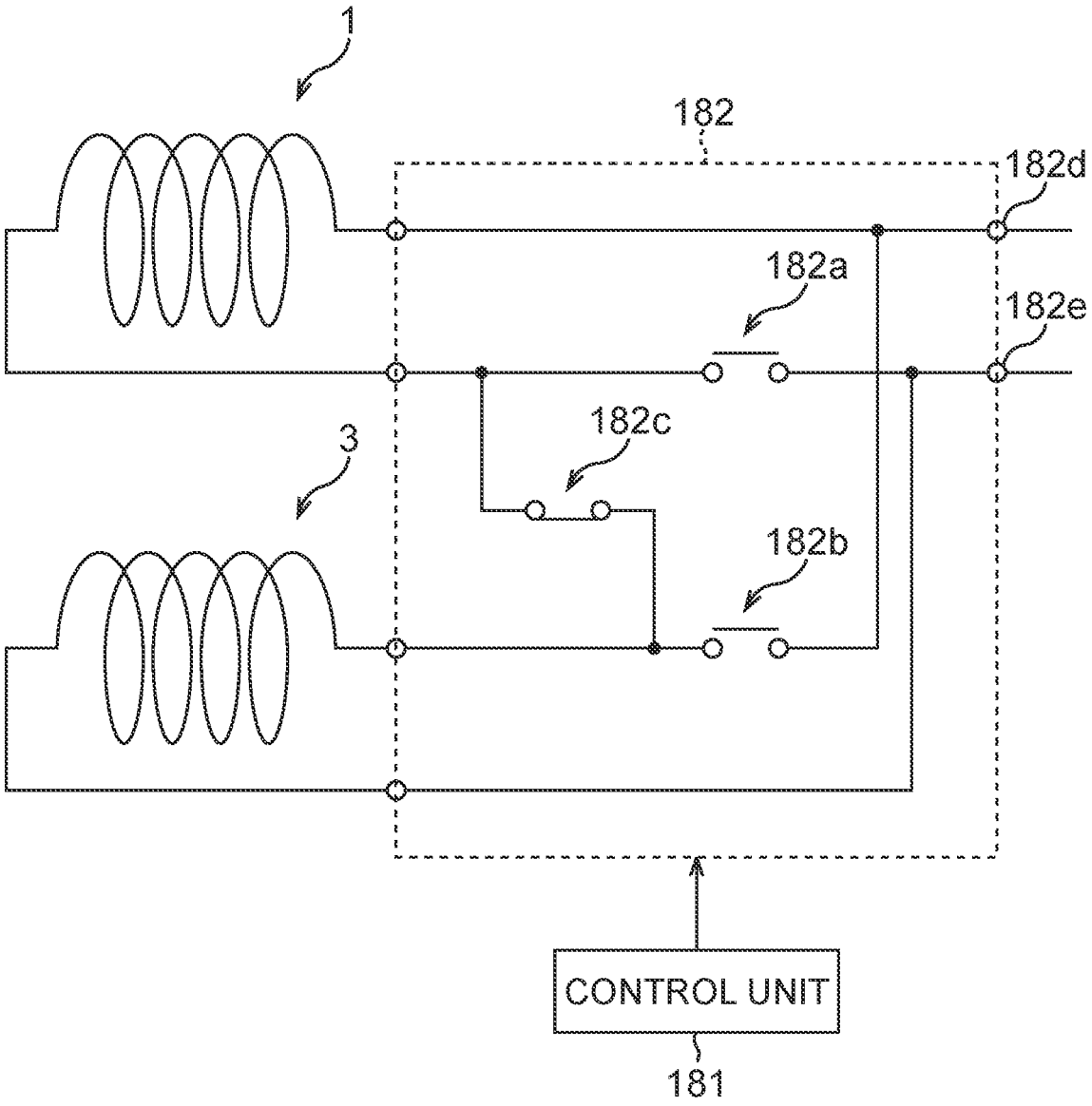
FIG. 18 is a view illustrating one example of a structure for switching of connection between the first coil and the second coil.

FIG. 18 is a view illustrating one example of a structure for switching of the connection between the first coil 1 and the second coil 3.

As illustrated in FIG. 18, an inductance adjusting device in this embodiment further includes a control unit 181 and a contact point switch 182 in the inductance adjusting device explained in the first embodiment. The control unit 181 and the contact point switch 182 are used, to thereby structure a switching device that automatically changes the connection between the first coil and the second coil.

The contact point switch 182 has contact points 182*a* to 182*c*. The control unit 181 outputs a switching instruction signal to the contact point switch 182. In the switching instruction signal, information indicating whether to open or close each of the contact points 182*a* to 182*c* is contained. The contact point switch 182 opens or closes the contact points 182*a* to 182*c* according to the information contained in the switching instruction signal output from the control unit 181. In the example illustrated in FIG. 18, when the contact points 182*a*, 182*b* are opened and the contact point 182*c* is closed, the first coil 1 and the second coil 3 are connected in series. On the other hand, when the contact points 182*a*, 182*b* are closed and the contact point 182*c* is opened, the first coil 1 and the second coil 3 are connected in parallel. FIG. 18 illustrates the state where the first coil 1 and the second coil 3 are connected in series.

Incidentally, the switching instruction signal may be generated based on an instruction given by an operator to the control unit 181 to be transmitted to the contact point switch 182, or may be generated based on a preset schedule to be transmitted to the contact point switch 182. Further, the switching instruction signal may also be generated by another method.

Further, in the example illustrated in FIG. 18, output ends 182*d*, 182*e* of the contact point switch 182 and power feeding terminals are electrically connected to each other. Thus, the output ends 182*d*, 182*e* of the contact point switch 182 and some of the power feeding terminals 7*a* to 7*d* illustrated in FIG. 1B only need to be electrically connected to each other. Further, in this case, the number of power feeding terminals does not need to be four, and two power feeding terminals are sufficient.

This embodiment is structured as above, thereby making it possible to switch the variable magnification β of the combined inductance GL when seen from the alternating-current power supply circuit in the range of (L−kL)÷2 to (L+kL)×2. However, in order to simplify the explanation here, the self-inductances L1, L2 of the first coil 1 and the second coil 3 are set to L. The connection between the first coil 1 and the second coil 3 is switched to the parallel connection from the series connection, and is switched to the series connection from the parallel connection, thereby making it possible to increase the variable magnification β of the combined inductance GL when seen from the alternating-current power supply circuit as compared to the first embodiment. Thus, it is possible to apply the inductance adjusting device to more application places and more variable purposes. Accordingly, it is possible to fabricate a more general-purpose inductance adjusting device, which leads to a reduction in cost of the inductance adjusting device.

Modified Examples

This embodiment can be applied to any of the first to fourth embodiments. Further, it is possible to switch the connection between the coils to either the series connection or the parallel connection in a unit of a single coil (the first coil, the second coil). For example, in the case where there are two first coils and two second coils, it is possible to connect the two first coils in series or parallel, connect the two second coils in series or parallel, and connect the series-connected or parallel-connected two first coils and the series-connected or parallel-connected two second coils in series or parallel.

Furthermore, in this embodiment as well, the various modified examples explained in the first to fourth embodiments can be employed.

Sixth Embodiment

Next, there will be explained a sixth embodiment. In the case where the inductance adjusting device is connected in the electric circuit, as disclosed in Patent Literature 1, it is general to connect the inductance adjusting device in series with or in parallel with a heating coil between a capacitor and the heating coil. In the case where the inductance adjusting device is connected in series with the heating coil, a potential to which in addition to an applied voltage to the heating coil, an applied voltage to the inductance adjusting device is added is applied to the inductance adjusting device. Therefore, reinforcement insulation is required so as to prevent occurrence of troubles such as a dielectric breakdown of the inductance adjusting device, resulting in that the inductance adjusting device becomes expensive. Further, in the case where the inductance adjusting device is connected in parallel with the heating coil, it is necessary to increase the inductance of the inductance adjusting device to about 10 times the inductance of the heating coil, for example, in order to reduce the current to flow through the inductance adjusting device. Therefore, losses of the coil and the magnetic body structuring the inductance adjusting device increase.

Thus, in this embodiment, there will be explained one example of a structure intended for reducing the potential to be applied to the inductance adjusting device, when the inductance adjusting device explained in each of the first to fifth embodiments is connected to an inductive load in series with respect to a resonant current and an electric circuit including the inductive load is energized, the inductance adjusting device. Further, in this embodiment, there will be explained a constitution intended for performing rotation of at least one of the first coil and the second coil so that the electric circuit becomes a resonant circuit when the electric circuit is in operation. An inductance adjusting device in this embodiment further includes a capacitor to be connected in series to the first coil and the second coil in the structure of the inductance adjusting device in each of the first to fifth embodiments. In the following explanation, this capacitor will be referred to as a voltage drop compensating capacitor as necessary. Further, the inductance adjusting device in this embodiment further includes a control unit that performs control for performing the rotation of at least one of the first coil and the second coil in the structure of the inductance adjusting device in each of the first to fifth embodiments.

As above, the inductance adjusting device in this embodiment becomes one in which the voltage drop compensating capacitor and the control unit are added to the inductance adjusting device in each of the first to fifth embodiments. Thus, in the explanation of this embodiment, the same reference numerals and symbols as those added to FIG. 1A to FIG. 18 are added to the same parts as those in the first to fifth embodiments, or the like, and their detailed explanations are omitted. Incidentally, connecting the inductance adjusting device to the inductive load in series with respect to the resonant current, which is described above, means that the inductance adjusting device is electrically connected to the resonant circuit, and thereby the inductance adjusting device is connected to the resonant circuit so as to prevent the resonant current from branching.

Figure 19A:
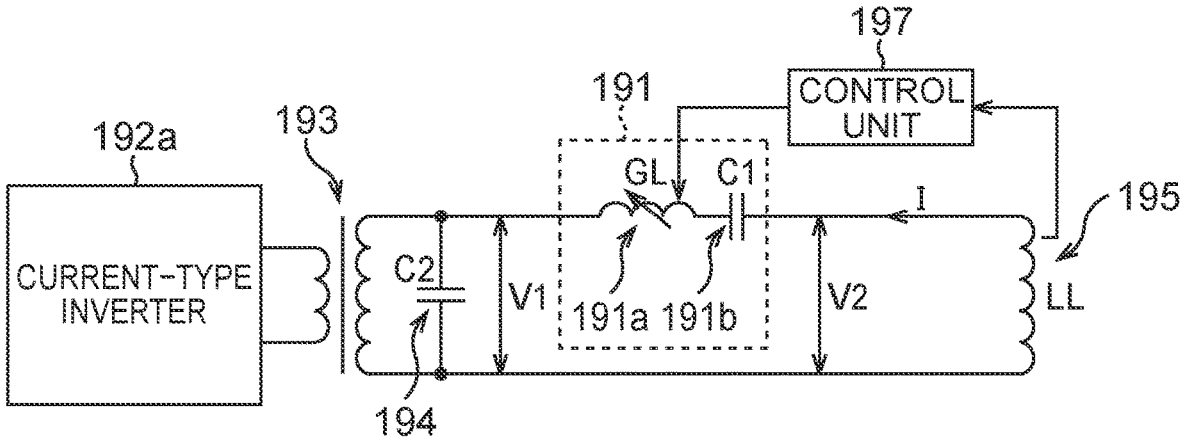
FIG. 19A is a view illustrating a first example of an electric circuit to which the inductance adjusting device is applied.

FIG. 19A to FIG. 190 are views illustrating connection examples of the inductance adjusting device. Here, the case where the inductance adjusting device is connected to an induction heating device will be explained as an example. In the induction heating device, by an eddy current generated when a magnetic field generated by application of an alternating current to a heating coil penetrates a metal plate such as a steel plate, the metal plate is inductively heated.

In FIG. 19A to FIG. 190, the first coil and the second coil mutually electrically connected are illustrated as a coil 191*a* summarily for convenience of illustration. One end of the coil 191*a* is electrically connected to one end of a voltage drop compensating capacitor 191*b*. Thus, the voltage drop compensating capacitor 191*b* is electrically connected to the first coil and the second coil. The other end of the coil 191*a* and the other end of the voltage drop compensating capacitor 191*b* are connected to the outside of the inductance adjusting device. Thus, in the examples illustrated in FIG. 19A to FIG. 19D, the other end of the coil 191*a* and the other end of the voltage drop compensating capacitor 191*b* are electrically connected to some of the power feeding terminals 7*a* to 7*d*. Further, in the case where the voltage drop compensating capacitor 191*b* is provided in the inductance adjusting device in the fifth embodiment, in the previously-described explanation, one end and the other end of the coil 191*a* are replaced with the output ends 182*d* and 182*e* of the contact point switch 182 respectively.

In this embodiment, the case where one of a current-type inverter 192*a* and a voltage-type inverter 192*b* is used as the alternating-current power supply circuit will be explained as an example.

In the first example illustrated in FIG. 19A, an inductance adjusting device 191 is connected to an induction heating device including the current-type inverter 192*a*, a transformer 193, a resonant capacitor 194, and a heating coil 195. In the first example illustrated in FIG. 19A, when seen from the current-type inverter 192*a*, the resonant capacitor 194 and the heating coil 195 are connected in parallel, and the inductance adjusting device 191 is connected between the resonant capacitor 194 and the heating coil 195. In the first example illustrated in FIG. 19A, a large current generated in parallel resonance flows through the heating coil 195, and thereby the induction heating is performed. A resonant current I flows through a path circulating through the inductance adjusting device 191, the resonant capacitor 194, and the heating coil 195.

Figure 19B:
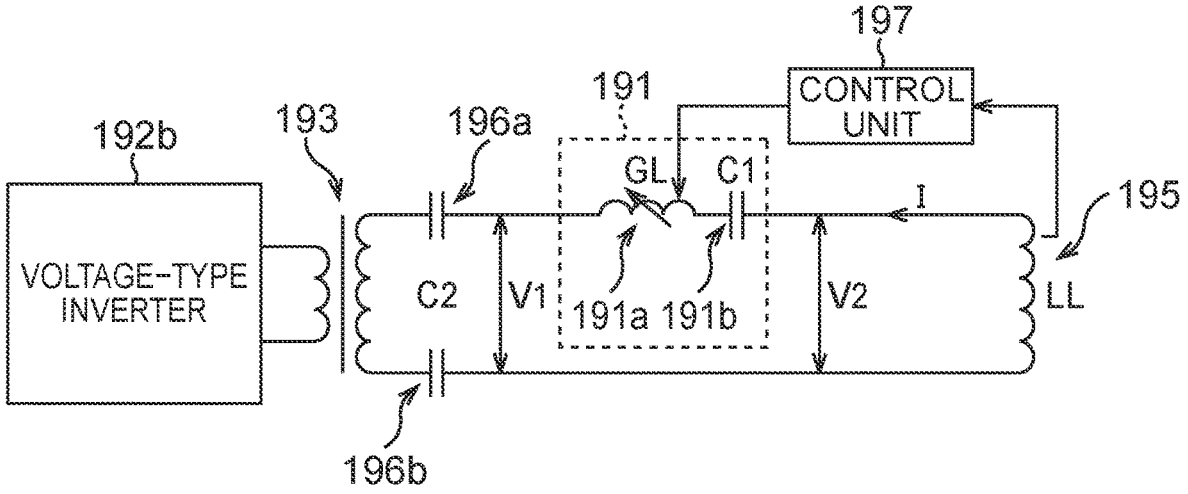
FIG. 19B is a view illustrating a second example of the electric circuit to which the inductance adjusting device is applied.

In the second example illustrated in FIG. 19B, the inductance adjusting device 191 is connected to an induction heating device including the voltage-type inverter 192*b*, the transformer 193, resonant capacitors 196*a*, 196*b*, and the heating coil 195. In the second example illustrated in FIG. 19B, when seen from the voltage-type inverter 192*b*, the resonant capacitors 196*a*, 196*b* and the heating coil 195 are connected in series, and the inductance adjusting device 191 is connected between the resonant capacitor 196*a* and the heating coil 195. In the second example illustrated in FIG. 19B, a large current generated in series resonance flows through the heating coil 195, and thereby the induction heating is performed. The resonant current I flows through a path circulating through the inductance adjusting device 191, the resonant capacitor 196*a*, (a secondary winding of) the transformer 193, the resonant capacitor 196*b*, and the heating coil 195.

In the first and second examples illustrated in FIG. 19A and FIG. 19B, the inductance of the coil 191*a* is the aforementioned combined inductance GL. Further, an electrostatic capacitance of the resonant capacitor 194 and a combined electrostatic capacitance of the resonant capacitors 196*a*, 196*b* are each set to C2, an electrostatic capacitance of the voltage drop compensating capacitor 191*b* is set to C1, and an inductance of the heating coil 195 is set to LL. Then, a combined inductance LT of the inductance of the coil 191*a* (namely, the combined inductance GL) and the inductance LL of the heating coil 195 is expressed by (6) Equation below. Further, a combined electrostatic capacitance CT of the electrostatic capacitance C2 of the resonant capacitor 194 or the combined electrostatic capacitance C2 of the resonant capacitors 196*a*, 196*b* and the electrostatic capacitance C1 of the voltage drop compensating capacitor 191*b* is expressed by (7) Equation below. Then, a resonance frequency f is expressed by (8) Equation below.

$$LT=GL+LL \tag{6}$$

$$CT=C1\cdot C2/(C1+C2) \tag{7}$$

$$f=\tfrac{1}{2\pi}\sqrt{(LT\cdot CT)} \tag{8}$$

Figure 19C:
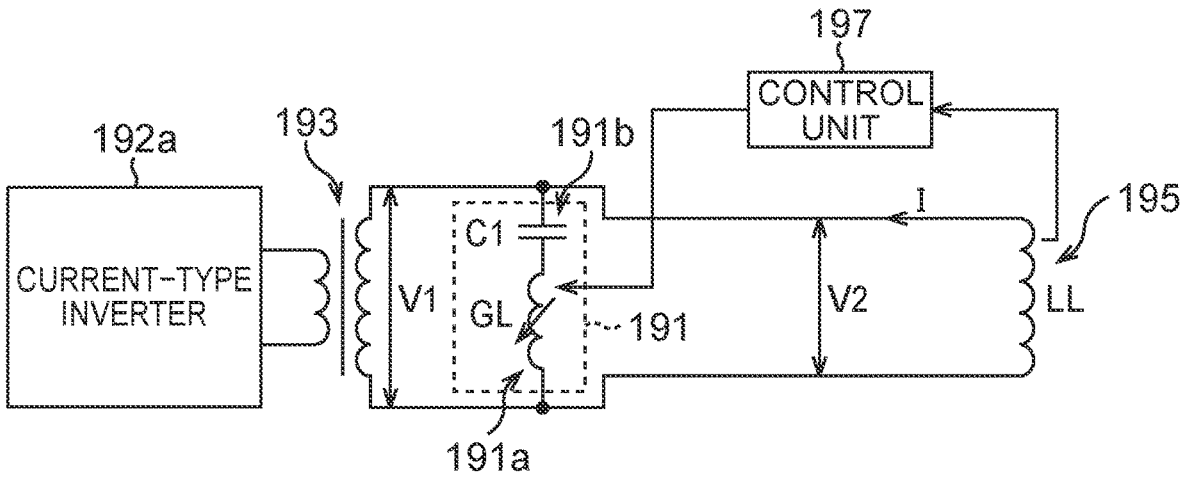
FIG. 19C is a view illustrating a third example of the electric circuit to which the inductance adjusting device is applied.

In the third example illustrated in FIG. 19C, the inductance adjusting device 191 is connected to an induction heating device including the current-type inverter 192*a*, the transformer 193, and the heating coil 195. In the third example illustrated in FIG. 19C, when seen from the current-type inverter 192*a*, the inductance adjusting device 191 and the heating coil 195 are connected in parallel. In the third example illustrated in FIG. 19C, a large current generated in parallel resonance flows through the heating coil 195, and thereby the induction heating is performed. The resonant current I flows through a path circulating through the inductance adjusting device 191 and the heating coil 195.

In the fourth example illustrated in FIG. 199, the inductance adjusting device 191 is connected to an induction heating device including the voltage-type inverter 192*b*, the transformer 193, and the heating coil 195. In the fourth example illustrated in FIG. 199, when seen from the voltage-type inverter 192*b*, the inductance adjusting device 191 and the heating coil 195 are connected in series. In the fourth example illustrated in FIG. 199, a large current generated in series resonance flows through the heating coil 195, and thereby the induction heating is performed. The resonant current I flows through a path circulating through the inductance adjusting device 191, the heating coil 195, and (the secondary winding of) the transformer 193.

Figure 19D:
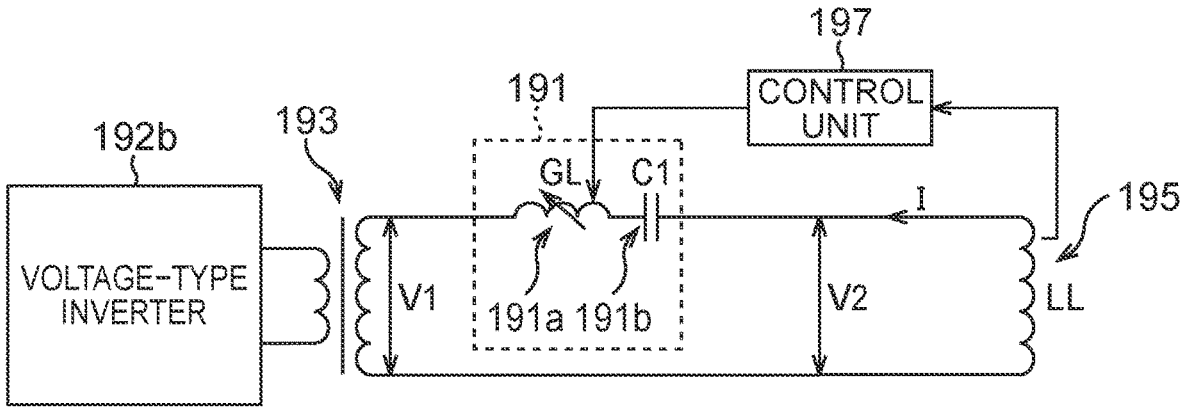
FIG. 19D is a view illustrating a fourth example of the electric circuit to which the inductance adjusting device is applied.

In the third and fourth examples illustrated in FIG. 19C and FIG. 19D, the combined inductance LT of the inductance of the coil 191*a* (namely, the combined inductance GL) and the inductance LL of the heating coil 195 is expressed by (6) Equation described previously. Then, the resonance frequency f is expressed by (9) Equation below.

$$f=\tfrac{1}{2\pi}\sqrt{(LT\cdot C1)} \tag{9}$$

As described previously, it is possible to automatically continuously change the combined inductance GL of the inductance adjusting device 191 by the rotation of the first coil or the like. Thus, it is possible to continuously change the inductance in the resonant circuit without turning off power (namely, without stopping operation of the current-type inverter 192*a* or the voltage-type inverter 192*b*). Thereby, it is possible to stably operate the induction heating device. The electrostatic capacitance C1 of the voltage drop compensating capacitor can be selected according to (10) Equation below so as to be able to compensate for a delay of the combined inductance GL of the inductance adjusting device 191.

$$C1=1/\{(2\pi f)^2*GL\} \tag{10}$$

As the combined inductance GL in (10) Equation, a representative value of the combined inductance GL in the inductance adjusting device 191 is employed. The representative value of the combined inductance GL in the inductance adjusting device 191 is the value of ½ (namely, the average value) of the variable range (the maximum value and the minimum value) of the combined inductance GL in the inductance adjusting device 191, for example. Further, f in (10) Equation is the resonance frequency.

Further, in the case where the inductance adjusting device 191 is connected in series to the heating coil 195 with respect to the resonant current I, to the inductance adjusting device 191, the potential to which, in addition to the applied voltage (=V2) to the heating coil 195, the applied voltage (=V1-V2) to the inductance adjusting device 191 is added is applied. Therefore, when high-voltage measures (insulation measures) of the inductance adjusting device are performed, the inductance adjusting device becomes extremely expensive. The reason why the voltage becomes high is because by a lagging current flowing through the heating coil 195 being the inductive load, a drop amount of the voltage of the inductance adjusting device 191 is added to the applied voltage to the heating coil 195.

Thus, in this embodiment, as illustrated in FIG. 19A to 19B, the voltage drop compensating capacitor 191*b* is connected to the load side of the coil 191*a* in series. This embodiment is structured in this manner, to thereby compensate for the drop amount of the voltage of the inductance adjusting device 191 by the lagging current. Thereby, the applied voltage to the inductance adjusting device 191 decreases and it becomes unnecessary to perform the high-voltage measures for the inductance adjusting device 191. As a result, it is possible to fabricate the inductance adjusting device 191 inexpensively.

The control unit 197 monitors the value of the inductance of the heating coil 195. The control unit 197 changes the combined inductance GI in the inductance adjusting device 191 according to the value of the inductance of the heating coil 195. Changing the combined inductance GL in the inductance adjusting device 191 is performed by rotating at least one of the first coil and the second coil. At this time, the control unit 197 changes the combined inductance CL in the inductance adjusting device 191 so that the frequency of the current flowing through the heating coil 195 becomes the resonance frequency f. In this manner, the electric circuit including the heating coil 195 becomes the resonant circuit.

The method of determining the rotation angle of at least one of the first coil and the second coil is as follows, for example. First, the relationship between the rotation angle of at least one of the first coil and the second coil and the combined inductance GL in the inductance adjusting device 191 is examined beforehand. The control unit 197 stores information indicating this relationship. The control unit 197 calculates, according to the value of the inductance of the heating coil 195, the value of the combined inductance CL in the inductance adjusting device 191 in order for the frequency of the current flowing through the heating coil 195 to be the resonance frequency f. Then, the control unit 197 derives the rotation angle corresponding to the calculated value from the aforementioned relationship.

Incidentally, in this embodiment as well, the various modified examples explained in the first to fifth embodiments can be employed.

Further, in each of the embodiments, it is possible to regard the difference in size and the direction deviation as not existent within a design tolerance range.

EXAMPLES

Next, there will be explained examples.

Example 1

In this example, the inductance adjusting device in the first embodiment was used.

The shapes of the first circumferential portion 1*a*, the second circumferential portion 1*b*, the third circumferential portion 3*a*, and the fourth circumferential portion 3*b* are the shapes illustrated in FIG. 2A and FIG. 2B. Of each of the first circumferential portion 1*a*, the second circumferential portion 1*b*, the third circumferential portion 3*a*, and the fourth circumferential portion 3*b*, the length in the long side direction was set to 300 mm and the length in the short side direction was set to 150 mm.

One made by passing a Litz wire of 45 sq through a hose was set as each of the first coil 1 and the second coil 3 and the first coil 1 and the second coil 3 were connected in series. The combined inductance GL in the case where the rotation angle of the first coil 1 in a state where an alternating current of 1500 A and 35 kHz is applied to the first coil 1 and the second coil 3 and magnetic fluxes generated from the first coil 1 and the second coil 3 are most weakened each other (the second state illustrated on the top of FIG. 4) was set to 0° and the first coil 1 was rotated by 30° pitch in the range of 0° to 180° and the power loss of the inductance adjusting device were measured. Results thereof are illustrated below.

Minimum value of the combined inductance GL) (0°): 0.59 μH

Maximum value of the combined inductance GL) (180°): 1.93 μH

Variable magnification $\beta=1.93/0.59\approx3.27$ magnifications

Power loss W=4.3 kW

Further, the relationship between the rotation angle of the first coil 1 and the combined inductance GL became a substantially proportional relationship.

Comparative Example 1

As an inductance adjusting device to be a comparative example of the example 1, a solenoid coil with three turns was fabricated by a water-cooled copper pipe, and one made by arranging a magnetic core in this solenoid coil as described in Patent Literature 1 was fabricated. In a state of an alternating current of 1500 A and 35 kHz applied to this solenoid coil, an occupancy ratio of the magnetic core to the solenoid coil was changed, and the inductance of the inductance adjusting device and the power loss of the inductance adjusting device were measured. Results thereof are illustrated below.

Minimum value of the inductance: 0.025 μH

Maximum value of the inductance: 0.08 μH

Variable magnification $\beta=0.08/0.025\approx3.3$ magnifications

Power loss W=131 kW

As above, the example 1 and the comparative example 1 were substantially equal in the variable magnification β of the combined inductance GL when seen from the alternating-current power supply circuit, but in the comparative example 1, the power loss W became about 30 times of the example 1.

Example 2

In this example, the inductance adjusting device in the first example of the second embodiment was used.

The shapes of the first circumferential portion, the second circumferential portion, the third circumferential portion, and the fourth circumferential portion are the shapes illustrated in FIG. 12A and FIG. 12B. Of each of the first circumferential portion, the second circumferential portion, the third circumferential portion, and the fourth circumferential portion, the length in the long side direction was set to 300 mm and the length in the short side direction was set to 150 mm. Further, the number of turns of each of the first coil 111 and the second coil 113 was set to two turns.

One made by passing a Litz wire of 45 sq through a hose was set as each of the first coil 111 and the second coil 113 and the first coil 111 and the second coil 113 were connected in series. The combined inductance GL in the case where the rotation angle of the first coil 111 in a state where an alternating current of 1500 A and 35 kHz is applied to the first coil 111 and the second coil 113 and magnetic fluxes generated from the first coil 111 and the second coil 113 are most weakened each other was set to 0° and the first coil 111 was rotated by 30° pitch in the range of 0° to 180° and the power loss of the inductance adjusting device were measured. Results thereof are illustrated below.

Minimum value of the combined inductance GL) (0°): 2.23 μH

Maximum value of the combined inductance GL) (180°): 7.70 μH

Variable magnification β=7.70/2.23≈3.45 magnifications

Power loss W=8.45 kW

Further, the relationship between the rotation angle of the first coil 111 and the combined inductance GL became a substantially proportional relationship.

In this example, as compared to the example 1, the variable magnification β of the combined inductance GL when seen from the alternating-current power supply circuit increased, and in this example as well, as compared to the comparative example 1, it was possible to drastically reduce the power loss.

Example 3

In this example, the inductance adjusting device in the second example of the second embodiment was used.

The shapes of the first circumferential portion, the second circumferential portion, the third circumferential portion, and the fourth circumferential portion are the shapes illustrated in FIG. 13, FIG. 14A, and FIG. 14B. Of each of the first circumferential portion, the second circumferential portion, the third circumferential portion, and the fourth circumferential portion, the length in the long side direction was set to 300 mm and the length in the short side direction was set to 150 mm. Further, the number of turns of each of the first coil 131 and the second coil 133 was set to two turns.

One made by passing a Litz wire of 45 sq through a hose was set as each of the first coil 131 and the second coil 133 and the first coil 131 and the second coil 133 were connected in series. The combined inductance GL in the case where the rotation angle of the first coil 131 in a state where an alternating current of 1500 A and 35 kHz is applied to the first coil 131 and the second coil 133 and magnetic fluxes generated from the first coil 131 and the second coil 133 are most weakened each other was set to 0° and the first coil 131 was rotated by 30° pitch in the range of 0° to 180° and the power loss of the inductance adjusting device were measured.

Results thereof are illustrated below.

Minimum value of the combined inductance GL) (0°): 2.69 μH

Maximum value of the combined inductance CL) (180°): 7.56 μH

Variable magnification β=7.56/2.69≈2.8 magnifications

Power loss W=8.63 kW

Further, the relationship between the rotation angle of the first coil 131 and the combined inductance GL became a substantially proportional relationship.

In this example, the first coil 131 and the second coil 133 each having the longitudinally wound shape were used, and thus as compared to the example 2, the variable magnification β of the combined inductance GL when seen from the alternating-current power supply circuit decreases, but the value is at a problem-free level practically. Further, as compared to the comparative example 1, it was possible to drastically reduce the power loss.

Example 4

In this example, the combined inductance GL and the power loss of the inductance adjusting device were measured under the same condition as that of the example 2 except that the first coil 111 and the second coil 113 were connected in parallel. Results thereof are illustrated below.

Minimum value of the combined inductance GL) (0°): 0.56 μH

Maximum value of the combined inductance GL) (180°): 1.93 μH

Variable magnification β=0.93/0.56 ≈3.45 magnifications

Power loss W==8.6 kW

Further, the relationship between the rotation angle of the first coil 111 and the combined inductance GL became a substantially proportional relationship.

In this example, as compared to the example 1, the variable magnification β of the combined inductance GL when seen from the alternating-current power supply circuit increased. Further, in this example as well, as compared to the comparative example 1, it was possible to drastically reduce the power loss. Further, a comparison between this example and the example 2 reveals that they were the same in the variable magnification β of the combined inductance GL when seen from the alternating-current power supply circuit, but in this example, the magnitude of the combined inductance GL became ¼ of that of the example 2. Thus, the inductance adjusting device is structured like the fifth embodiment and the connection between the first coil 111 and the second coil 113 is switched, thereby making it possible to widen the range of the combined inductance GL.

Example 5

In this example, the potential (=V1) to be applied to the inductance adjusting device 191 connected to the induction heating device illustrated in FIG. 19A was calculated under the following conditions. As a result, V1≈5 kV was found.

Electric Constant Condition

Inductance LL of the heating coil 195=5.7 μH

Electrostatic capacitance C2 of the resonant capacitor 194=3.66 μF

Combined inductance GL=8.5 μH

Electrostatic capacitance C1 of the voltage drop compensating capacitor 191*b*=2.43 μF However, in (10) Equation, GL was set to 8.5 μH, the resonance frequency f was set to 35 kHz, and then the electrostatic capacitance C1 of the voltage drop compensating capacitor 191*b* was roughly estimated.

Operation condition

Operating frequency f=35 kHz

Resonant current I to be applied to the heating coil 195=4000 A

Example 6

In this example, the potential (=V1) to be applied to the inductance adjusting device in the example 5 formed without providing the voltage drop compensating capacitor 191*b* was calculated under the following conditions. As a result, V1≈ 12.5 kV was found, and it was confirmed that the potential higher than that of the example 5 is applied to the inductance adjusting device. However, the potential is within the range allowing the high-voltage measures to be performed, and thus the potential causes no problem practically as long as the high-voltage measures are performed.

Electric Constant Condition

Inductance LL of the heating coil 195=5.7 μH

Electrostatic capacitance C2 of the resonant capacitor 194=1.46 μF

Combined inductance GL=8.5 μH

Electrostatic capacitance C1 of the voltage drop compensating capacitor 191*b*=0 μF (the voltage drop compensating capacitor 191*b* is not provided)

Operation Condition

Operating frequency f=35 kHz Resonant current I to be applied to the heating coil 195=4000 A Incidentally, the above-explained embodiments and examples of the present invention each merely illustrate a concrete example of implementing the present invention, and the technical scope of the present invention is not to be construed in a restrictive manner by these. That is, the present invention may be implemented in various forms without departing from the technical spirit or main features thereof.

INDUSTRIAL APPLICABILITY

The present invention can be utilized for an electric circuit including an inductive load, and so on.

The invention claimed is:

1. An inductance adjusting device that adjusts an inductance of an electric circuit, the inductance adjusting device comprising:

a first coil having a first circumferential portion, a second circumferential portion, and a first connecting portion; and a second coil having a third circumferential portion, a fourth circumferential portion, and a second connecting portion, wherein the first circumferential portion, the second circumferential portion, the third circumferential portion, and the fourth circumferential portion each are a portion circling so as to surround an inner region thereof, the first connecting portion is a portion that connects one end of the first circumferential portion and one end of the second circumferential portion mutually, the second connecting portion is a portion that connects one end of the third circumferential portion and one end of the fourth circumferential portion mutually, the first coil and the second coil are connected in series or parallel, the first circumferential portion and the second circumferential portion exist on the same plane, the third circumferential portion and the fourth circumferential portion exist on the same plane, a set of the first circumferential portion and the second circumferential portion and a set of the third circumferential portion and the fourth circumferential portion are arranged in a parallel state with an interval provided therebetween, at least one of the first coil and the second coil rotates about a shaft of the first coil and the second coil as a rotation shaft, the shaft is a shaft passing through a middle position between the center of the first circumferential portion and the center of the second circumferential portion and a middle position between the center of the third circumferential portion and the center of the fourth circumferential portion, the first circumferential portion and the second circumferential portion are arranged so as to maintain a state where at least one of the first coil and the second coil is displaced by 180° in terms of angle in a rotation direction, and the third circumferential portion and the fourth circumferential portion are arranged so as to maintain a state where at least one of the first coil and the second coil is displaced by 180° in terms of angle in the rotation direction.

2. The inductance adjusting device according to claim 1, wherein at least one of the first coil and the second coil rotates so as to include both states or one state of a first state and a second state, the first state is a state where the first circumferential portion and the third circumferential portion are at positions facing each other and the second circumferential portion and the fourth circumferential portion are at positions facing each other, and the second state is a state where the first circumferential portion and the fourth circumferential portion are at positions facing each other and the second circumferential portion and the third circumferential portion are at positions facing each other.

3. The inductance adjusting device according to claim 1 or 2, wherein the total of an absolute value of a rotation angle of the first coil in a first direction and an absolute value of a rotation angle of the second coil in a second direction being a direction opposite to the first direction ranges from 0° to 180°.

4. The inductance adjusting device according to claim 1 or 2, wherein shapes and sizes of the first circumferential portion, the second circumferential portion, the third circumferential portion, and the fourth circumferential portion are the same in a portion of 60% or more of the total length of the first circumferential portion, the second circumferential portion, the third circumferential portion, and the fourth circumferential portion.

5. The inductance adjusting device according to claim 1 or 2, wherein the first coil rotates and the second coil does not rotate.

6. The inductance adjusting device according to claim 1 or 2, wherein the first coil and the second coil each are a coil wound two turns or more in a direction vertical to the shaft.

7. The inductance adjusting device according to claim 1 or 2, wherein there are a plurality of groups of the first coil and the second coil, and the plural groups are connected in series or parallel.

8. The inductance adjusting device according to claim 1 or 2, wherein a plurality of the first coils and a plurality of the second coils are arranged in a direction vertical to the shaft.

9. The inductance adjusting device according to claim 1 or 2, further comprising:

a switching device that switches between the series connection and the parallel connection.

10. The inductance adjusting device according to claim 1 or 2, wherein the rotation is performed while the electric circuit is operating.

11. The inductance adjusting device according to claim 1 or 2, further comprising:

a capacitor electrically connected to the first coil and the second coil, wherein the capacitor is a capacitor for reducing a potential to be applied to the inductance adjusting device when the electric circuit is energized.

12. The inductance adjusting device according to claim 1 or 2, wherein of at least one of the first coil and the second coil, a position in a direction along the shaft is changed.

13. The inductance adjusting device according to claim 1 or 2, wherein the first coil and the second coil are connected to the electric circuit so as to prevent a resonant current to be applied to the electric circuit from branching.

* * * * *